US011236964B2

(12) United States Patent
Bednar et al.

(10) Patent No.: US 11,236,964 B2
(45) Date of Patent: Feb. 1, 2022

(54) CROSSBOW WITH DE-COCKING MECHANISM

(71) Applicant: Hunter's Manufacturing Company, Inc., Suffield, OH (US)

(72) Inventors: Richard Bednar, Akron, OH (US); Michael Shaffer, Mogadore, OH (US); Gary Smith, Jr., East Canton, OH (US); Eric VanKeulen, North Canton, OH (US)

(73) Assignee: Hunter's Manufacturing Company, Inc., Suffield, OH (US)

( * ) Notice: Subject to any disclaimer, the term of this patent is extended or adjusted under 35 U.S.C. 154(b) by 0 days.

(21) Appl. No.: 17/314,821

(22) Filed: May 7, 2021

(65) Prior Publication Data

US 2021/0348875 A1 Nov. 11, 2021

Related U.S. Application Data

(60) Provisional application No. 63/021,930, filed on May 8, 2020.

(51) Int. Cl.
*F41B 5/12* (2006.01)
*F41B 5/14* (2006.01)
*F41B 5/18* (2006.01)

(52) U.S. Cl.
CPC ..... *F41B 5/1469* (2013.01); *F41B 5/123* (2013.01)

(58) Field of Classification Search
CPC ..... F41B 5/12; F41B 5/123; F41B 5/1469
USPC ..... 124/25, 35.2, 86
See application file for complete search history.

(56) References Cited

U.S. PATENT DOCUMENTS 2,092,361 A * 9/1937 Shirn ..... F41B 5/12 124/25
2,747,838 A * 5/1956 Riemann ..... B66D 1/06 254/357
3,043,287 A * 7/1962 Nelson ..... F41B 5/12 124/25
3,670,711 A * 6/1972 Firestone ..... F41B 5/12 124/25
4,603,676 A * 8/1986 Luoma ..... F41B 5/1469 124/25
4,649,892 A * 3/1987 Bozek ..... F41B 5/10 124/25
4,699,117 A * 10/1987 Waiser ..... F41B 5/12 124/25
4,719,897 A * 1/1988 Gaudreau ..... F41B 5/1469 124/25
4,942,861 A * 7/1990 Bozek ..... F41B 5/12 124/25
5,115,795 A * 5/1992 Farris ..... F41B 5/1469 124/25
5,220,906 A * 6/1993 Choma ..... F41B 5/12 124/25
5,243,956 A * 9/1993 Luehring ..... F41B 5/12 124/86

(Continued)

*Primary Examiner* — Alexander R Niconovich
(74) *Attorney, Agent, or Firm* — Emerson Thomson Bennett, LLC

(57) ABSTRACT

A crossbow may have a de-cocking mechanism that includes a trigger mechanism, a trigger latch mechanism and a winch assembly. The winch assembly may be used to move the trigger mechanism to simultaneously move the bowstring from a cocked position to an un-cocked position.

20 Claims, 44 Drawing Sheets

(56) References Cited

U.S. PATENT DOCUMENTS 5,437,260 A * 8/1995 King ..... F41B 5/12 124/25
5,649,520 A * 7/1997 Bednar ..... F41B 5/12 124/25
5,746,192 A * 5/1998 Gissel ..... F41B 5/14 124/1
5,779,171 A * 7/1998 Milano, Jr. ..... A01K 89/028 242/299
6,095,128 A * 8/2000 Bednar ..... F41B 5/1469 124/25
6,286,496 B1 * 9/2001 Bednar ..... F41B 5/123 124/25
6,874,491 B2 * 4/2005 Bednar ..... F41B 5/10 124/25
6,913,007 B2 * 7/2005 Bednar ..... F41B 5/123 124/25
7,100,590 B2 * 9/2006 Chang ..... F41B 5/123 124/25
7,174,884 B2 * 2/2007 Kempf ..... F41B 5/105 124/25
7,624,725 B1 * 12/2009 Choma ..... F41B 5/1469 124/25
7,748,370 B1 * 7/2010 Choma ..... F41B 5/1469 124/25
7,784,453 B1 * 8/2010 Yehle ..... F41B 5/12 124/25
8,091,540 B2 * 1/2012 Matasic ..... F41B 5/12 124/31
8,104,461 B2 1/2012 Kempf
8,240,299 B2 * 8/2012 Kronengold ..... F41A 11/02 124/25
8,375,928 B1 * 2/2013 Bednar ..... F41B 5/1469 124/25
8,443,790 B2 * 5/2013 Pestrue ..... F41B 5/12 124/25
8,453,631 B1 6/2013 Kronengold et al.
8,499,753 B2 * 8/2013 Bednar ..... F41B 5/123 124/25
8,752,535 B2 6/2014 Barber et al.
9,285,182 B2 * 3/2016 Bednar ..... F41B 5/1469
9,303,944 B2 4/2016 Barber
9,341,432 B1 * 5/2016 Wohleb ..... F16H 25/20
9,341,434 B2 * 5/2016 McPherson ..... F41B 5/1469
9,383,159 B2 7/2016 Pulkrabek et al.
9,404,706 B2 * 8/2016 Khoshnood ..... F41B 5/12
9,435,605 B2 * 9/2016 McPherson ..... F41B 5/12
9,494,379 B2 * 11/2016 Yehle ..... F41B 5/066
9,494,380 B1 * 11/2016 Yehle ..... F41B 5/12
9,494,381 B1 * 11/2016 Jeske ..... F41B 5/1469
9,752,844 B1 * 9/2017 Huang ..... F41B 5/1469
9,797,674 B2 10/2017 Barber
9,879,936 B2 * 1/2018 Yehle ..... F41B 5/066
9,958,232 B1 * 5/2018 Egerdee ..... F41B 5/1403
10,077,965 B2 * 9/2018 Yehle ..... F41B 5/123
10,082,359 B2 * 9/2018 Yehle ..... F41B 5/10
10,126,088 B2 * 11/2018 Yehle ..... F41B 5/066
10,139,188 B2 * 11/2018 Shaffer ..... F41B 5/12
10,175,023 B2 * 1/2019 Yehle ..... F41B 5/123
10,209,026 B2 * 2/2019 Yehle ..... F41B 5/10
10,254,073 B2 * 4/2019 Yehle ..... F41B 5/1449
10,295,295 B2 * 5/2019 Shaffer ..... F41B 5/12
10,295,299 B2 * 5/2019 Vergara ..... B66D 1/04
10,458,743 B1 * 10/2019 Kempf ..... F41B 5/123
10,539,388 B2 1/2020 Shaffer et al.
10,605,555 B1 * 3/2020 Shaffer ..... F41A 19/10
10,866,055 B1 * 12/2020 Hensel ..... F41A 19/06
10,948,257 B1 * 3/2021 Huang ..... B65H 75/4494
11,002,505 B1 * 5/2021 Shaffer ..... F41B 5/123
11,009,310 B1 5/2021 Shaffer et al.
11,015,892 B1 * 5/2021 Jessup ..... F41B 5/1469
2006/0086346 A1 * 4/2006 Middleton ..... F41B 5/12 124/25
2010/0170488 A1 * 7/2010 Rasor ..... F41A 19/12 124/25
2010/0269807 A1 * 10/2010 Kempf ..... F41B 5/12 124/25
2012/0152220 A1 * 6/2012 Barber ..... F41B 5/1469 124/35.1
2014/0261360 A1 * 9/2014 Pulkrabek ..... F41B 5/1469 124/35.2
2014/0305417 A1 * 10/2014 Barber ..... F41B 5/12 124/25
2015/0000646 A1 * 1/2015 Schley ..... F41B 5/12 124/86
2017/0131059 A1 * 5/2017 McPherson ..... F41B 5/123
2018/0321011 A1 * 11/2018 Yehle ..... F41B 5/1469
2019/0154392 A1 5/2019 Yehle

* cited by examiner

CROSSBOW WITH DE-COCKING MECHANISM

This application is a non-provisional application which claims priority to U.S. Provisional Patent Application No. 63/021,930, filed May 8, 2020, entitled CROSSBOW COMPONENTS, which is incorporated herein by reference.

I. BACKGROUND

A. Field of the Invention

This invention generally relates to apparatuses and methods regarding crossbows; and more specifically to apparatuses and methods regarding cocking crossbows, de-cocking crossbows and a winch that may be used for cocking and/or de-cocking a crossbow.

B. Description of Related Art

Crossbows have been used for many years as a weapon for hunting and fishing, and for target shooting. A crossbow has a bowstring adapted to be cocked to energize the crossbow and prepare it to fire. Retention and release of the cocked bowstring is of interest.

It is also of interest to provide an interlock to prevent the release of the cocked bowstring without an arrow operationally loaded into the crossbow. When cocked, the bow stores a large amount of energy. Dry firing a crossbow is known to be undesirable for multiple reasons including for a high potential to cause harm to the crossbow. It is of interest to develop apparatuses and methods for the safe and efficient de-cocking of a crossbow without dry firing the crossbow.

It remains desirable to improve the apparatuses and methods by which the bowstring of a crossbow is cocked, retained, de-cocked, fired, or some combination thereof.

II. SUMMARY

According some embodiment of this invention, a crossbow may include: a longitudinally extending main beam; a bow mechanism including: 1) a pair of outwardly extending bow limbs extending transversely from opposite lateral sides of the main beam; and 2) a bowstring operatively engaged to the outwardly extending bow limbs and movable between: (a) an un-cocked position; and (b) a cocked position; a trigger mechanism operable to hold the bowstring in the cocked position and to release the bowstring to fire the crossbow; and a winch assembly including: 1) a winch housing supported to the main beam and defining: (a) a first housing axis; (b) a second housing axis offset from the first housing axis; and (c) a third housing axis offset from the first housing axis and offset from the second housing axis; 2) a spool that is selectively rotatable about the first housing axis with respect to the winch housing; 3) a tensile member having: (a) a first end operatively engaged with the spool; and (b) a second end selectively operatively engageable with the bowstring; 4) a spool gear: (a) including spool gear teeth; (b) operatively engaged with the spool; and (c) selectively rotatable about the first housing axis with respect to the winch housing; 5) a drive gear: (a) including drive gear teeth operatively engaged with the spool gear teeth; (b) selectively rotatable about the second housing axis in a first drive gear direction with respect to the winch housing; and (c) selectively rotatable about the second housing axis in a second drive gear direction, opposite the first drive gear direction, with respect to the winch housing; 6) a plate gear: (a) including plate gear teeth; (b) selectively operatively engageable with the drive gear; and (c) selectively rotatable about the second housing axis with respect to the winch housing; 7) a one way bearing selectively rotatable about the third housing axis in only one direction with respect to the winch housing; and 8) a brake gear: (a) including brake gear teeth operatively engaged with the plate gear teeth; (b) operatively engaged with the one way bearing; and (c) selectively rotatable about the third housing axis in the only one direction with respect to the winch housing. When the plate gear is operatively engaged with the drive gear, the drive gear may only be rotated about the second housing axis in one of the first drive gear direction and the second drive gear direction. When the plate gear is not operatively engaged with the drive gear, the drive gear may optionally be rotated about the second housing axis in either the first drive gear direction or the second drive gear direction. The winch assembly may be selectively operable, when the bowstring is in the un-cocked position, to: (a) receive a first rotational input to rotate the drive gear in a spool in direction about the second housing axis; to (b) rotate the spool gear about the first housing axis; to (c) rotate the spool about the first housing axis; to (d) wrap the tensile member around the spool; to (e) move the bowstring from the un-cocked position to the cocked position. The winch assembly may be selectively operable when the bowstring is in the cocked position to: (a) receive a second rotational input to rotate the drive gear in a spool out direction about the second housing axis; to (b) rotate the spool gear about the first housing axis; to (c) rotate the spool about the first housing axis; to (d) unwrap the tensile member from around the spool; to (e) move the bowstring from the cocked position to the un-cocked position.

According to some embodiments of this invention, a crossbow method may include the steps of: A) providing a crossbow including: 1) a longitudinally extending main beam; 2) a bow mechanism including: (a) a pair of outwardly extending bow limbs extending transversely from opposite lateral sides of the main beam; and (b) a bowstring operatively engaged to the outwardly extending bow limbs and movable between: (i) an un-cocked position; and (ii) a cocked position; and 3) a trigger mechanism operable to hold the bowstring in the cocked position and to release the bowstring to fire the crossbow; and B) providing a winch assembly including: 1) a winch housing supported to the main beam and defining; (a) a first housing axis; (b) a second housing axis offset from the first housing axis; and (c) a third housing axis offset from the first housing axis and offset from the second housing axis; 2) a spool that is selectively rotatable about the first housing axis with respect to the winch housing; 3) a tensile member having: (a) a first end operatively engaged with the spool; and (b) a second end selectively operatively engageable with the bowstring; 4) a spool gear: (a) including spool gear teeth; (b) operatively engaged with the spool; and (c) selectively rotatable about the first housing axis with respect to the winch housing; 5) a drive gear: (a) including drive gear teeth operatively engaged with the spool gear teeth; (b) selectively rotatable about the second housing axis in a first drive gear direction with respect to the winch housing; and (c) selectively rotatable about the second housing axis in a second drive gear direction, opposite the first drive gear direction, with respect to the winch housing; 6) a plate gear: (a) including plate gear teeth; and (b) selectively operatively engageable with the drive gear; and (c) selectively rotatable about the second housing axis with respect to the winch housing; 7) a one way bearing selectively rotatable about the third housing axis in only one direction with respect to the winch housing; and 8) a brake gear: (a) including brake gear teeth operatively engaged with the plate gear teeth; (b) operatively engaged with the one way bearing; and (c) selectively rotatable about the third housing axis in the only one direction with respect to the winch housing; C) providing the drive gear, when the plate gear is operatively engaged with the drive gear, to only be rotatable about the second housing axis in one of the first drive gear direction and the second drive gear direction; D) providing the drive gear, when the plate gear is not operatively engaged with the drive gear, to be optionally rotatable about the second housing axis in either the first drive gear direction or the second drive gear direction; E) providing the winch assembly to be selectively operable when the bowstring is in the un-cocked position to: 1) receive a first rotational input to rotate the drive gear in a spool in direction about the second housing axis; to 2) rotate the spool gear about the first housing axis; to 3) rotate the spool about the first housing axis; to 4) wrap the tensile member around the spool; to 5) move the bowstring from the un-cocked position to the cocked position; and F) providing the winch assembly to be selectively operable when the bowstring is in the cocked position to: 1) receive a second rotational input to rotate the drive gear in a spool out direction about the second housing axis; to 2) rotate the spool gear about the first housing axis; to 3) rotate the spool about the first housing axis; to 4) unwrap the tensile member from around the spool; to 5) move the bowstring from the cocked position to the un-cocked position.

According to some embodiments of this invention, a crossbow may include: a longitudinally extending main beam; a bow mechanism including: 1) a pair of outwardly extending bow limbs extending transversely from opposite lateral sides of the main beam; and 2) a bowstring operatively engaged to the outwardly extending bow limbs and movable between: (a) an un-cocked position; and (b) a cocked position; a trigger mechanism operable to hold the bowstring in the cocked position and to release the bowstring to fire the crossbow; and a winch assembly including: 1) a winch housing supported to the main beam and defining; (a) a first housing axis; (b) a second housing axis offset from the first housing axis; and (c) a third housing axis offset from the first housing axis and offset from the second housing axis; 2) a spool that is selectively rotatable about the first housing axis with respect to the winch housing; 3) a tensile member having: (a) a first end operatively engaged with the spool; and (b) a second end selectively operatively engageable with the bowstring; 4) a spool gear: (a) including spool gear teeth; (b) operatively engaged with the spool; and (c) selectively rotatable about the first housing axis with respect to the winch housing; 5) a drive gear: (a) including drive gear teeth operatively engaged with the spool gear teeth; (b) selectively rotatable about the second housing axis in a first drive gear direction with respect to the winch housing; (c) selectively rotatable about the second housing axis in a second drive gear direction opposite the first drive gear direction with respect to the winch housing; and (d) that rotates with a drive shaft that has threads; 6) a pressure plate gear: (a) including plate gear teeth; (b) selectively operatively engageable with the drive gear; and (c) selectively rotatable about the second housing axis with respect to the winch housing; 7) a one way bearing selectively rotatable about the third housing axis in only one direction with respect to the winch housing; 8) a brake gear: (a) including brake gear teeth operatively engaged with the plate gear teeth; (b) operatively engaged with the one way bearing; and (c) selectively rotatable about the third housing axis in the only one direction with respect to the winch housing; and 9) a clutch gear assembly that: (a) is selectively operatively engageable to the drive gear; and (b) includes a receiver having threads that engage the drive shaft threads. When the pressure plate gear is operatively engaged with the drive gear, the drive gear may only be rotated about the second housing axis in one of the first drive gear direction and the second drive gear direction. When the pressure plate gear is not operatively engaged with the drive gear, the drive gear may optionally be rotated about the second housing axis in either the first drive direction or the second drive gear direction. The winch assembly may be selectively operable when the bowstring is in the un-cocked position to: (a) receive a first rotational input to rotate the drive gear in a spool in direction about the second housing axis; to (b) rotate the spool gear about the first housing axis; to (c) rotate the spool about the first housing axis; to (d) wrap the tensile member around the spool; to (e) move the bowstring from the un-cocked position to the cocked position. The winch assembly may be selectively operable when the bowstring is in the cocked position to: (a) receive a second rotational input to rotate the drive gear in a spool out direction about the second housing axis; to (b) rotate the spool gear about the first housing axis; to (c) rotate the spool about the first housing axis; to (d) unwrap the tensile member from around the spool; to (e) move the bowstring from the cocked position to the un-cocked position. When the clutch gear assembly is operatively engaged to the drive gear: (a) the drive gear may rotate freely in the spool in direction; and (b) the drive gear may rotate subject to a damping load in the spool out direction. When the clutch gear assembly is operatively disengaged from the drive gear: the drive gear may rotate freely in both the spool in direction and the spool out direction. The receiver may be operable when rotated sufficiently: (a) in a first receiver direction with respect to the drive shaft, to operatively engage the clutch gear assembly to the drive gear; and (b) in a second receiver direction with respect to the drive shaft, opposite the first receiver direction, to operatively disengage the clutch gear assembly from the drive gear.

According to some embodiments of this invention, a crossbow may include: a longitudinally extending main beam; a bow mechanism including: 1) a pair of outwardly extending bow limbs extending transversely from opposite lateral sides of the main beam; and 2) a bowstring operatively engaged to the outwardly extending bow limbs and movable between: (a) an un-cocked position; and (b) a cocked position; a cocking mechanism including: 1) a trigger mechanism; 2) a trigger latch mechanism; and 3) a winch assembly; the trigger mechanism including: 1) a trigger housing; 2) a trigger surface supported to the trigger housing; and 3) a string catch supported to the trigger housing and selectively movable between: (a) a first string catch position that does not hold the bowstring; and (b) a second string catch position that holds the bowstring; the trigger latch mechanism including a trigger latch supported to the main beam and selectively movable between: 1) a first trigger latch position that does not engage the trigger surface; and 2) a second trigger latch position that engages the trigger surface to hold the trigger mechanism to the main beam at a longitudinal position; and the winch assembly including: 1) a winch housing supported to the main beam; 2) a spool that is selectively rotatable with respect to the winch housing; 3) a tensile member having; (a) a first end operatively engaged with the spool; and (b) a second end operatively engaged with the trigger housing; 4) a spool gear: (a) operatively engaged with the spool; and (b) selectively rotatable with respect to the winch housing; and 5) a drive gear: (a) operatively engaged with the spool gear; and (b) selectively rotatable with respect to the winch housing; and 6) a clutch gear assembly that: (a) is selectively operatively engageable to the drive gear; (b) when operatively engaged to the drive gear, is adapted to enable the drive gear to rotate: (i) freely in a spool in direction; and (ii) subject to a damping load in a spool out direction; and (c) when operatively disengaged from the drive gear, is adapted to enable the drive gear to rotate freely in both the spool in direction and the spool out direction. When the bowstring is in the un-cocked position, the trigger mechanism may be selectively moveable along the main beam to the bowstring; 2) when the bowstring is in the un-cocked position and the trigger mechanism is positioned at the bowstring, the string catch is selectively movable from: (a) the first string catch position that does not hold the bowstring; to (b) the second string catch position that holds the bowstring. When the bowstring is in the un-cocked position and the string catch is in the second string catch position holding the bowstring, the winch assembly may be selectively operable: (a) to receive a first rotational input to rotate the drive gear in the spool in direction; to (b) rotate the spool gear; to (c) rotate the spool; to (d) wrap the tensile member around the spool; to (e) move the trigger mechanism along the main beam to the trigger latch mechanism; to (f) move the bowstring from the un-cocked position to the cocked position. As the trigger mechanism is moved to the trigger latch mechanism, the trigger latch may be selectively movable from the first trigger latch position into the second trigger latch position to hold the trigger mechanism to the main beam. When the trigger latch is in the second trigger latch position holding the trigger mechanism to the main beam and the string catch is in the second string catch position holding the bowstring, the winch assembly may be selectively operable: (a) to receive a second rotational input to rotate the drive gear in the spool out direction; to (b) rotate the spool gear; to (c) rotate the spool; to (d) relieve tension from the tensile member. When the tension has been relieved from the tensile member, the trigger latch remains in the second trigger latch position holding the trigger mechanism to the main beam and the string catch remains in the second string catch position holding the bowstring, the trigger mechanism may be selectively operable to move the string catch into the first string latch position to release the bowstring to fire the crossbow.

According to some embodiments of this invention, a crossbow method may include the steps of: A) providing a crossbow including: 1) a longitudinally extending main beam; 2) a bow mechanism including: (a) a pair of outwardly extending bow limbs extending transversely from opposite lateral sides of the main beam; and (b) a bowstring operatively engaged to the outwardly extending bow limbs and movable between: (i) an un-cocked position; and (ii) a cocked position; B) providing a cocking mechanism including: 1) a trigger mechanism; 2) a trigger latch mechanism; and 3) a winch assembly; C) providing the trigger mechanism with: 1) a trigger housing; 2) a trigger surface supported to the trigger housing; and 3) a string catch supported to the trigger housing and selectively movable between: (a) a first string catch position that does not hold the bowstring; and (b) a second string catch position that holds the bowstring; D) providing the trigger latch mechanism with a trigger latch supported to the main beam and selectively movable between: 1) a first trigger latch position that does not engage the trigger surface; and 2) a second trigger latch position that engages the trigger surface to hold the trigger mechanism to the main beam at a longitudinal position; E) providing the winch assembly with: 1) a winch housing supported to the main beam; 2) a spool that is selectively rotatable with respect to the winch housing; 3) a tensile member having: (a) a first end operatively engaged with the spool; and (b) a second end operatively engaged with the trigger housing; 4) a spool gear: (a) operatively engaged with the spool; and (b) selectively rotatable with respect to the winch housing; 5) a drive gear: (a) operatively engaged with the spool gear; and (b) selectively rotatable with respect to the winch housing; and 6) a clutch gear assembly that: (a) is selectively operatively engageable to the drive gear; (b) when operatively engaged to the drive gear, is adapted to enable the drive gear to rotate: (i) freely in a spool in direction; and (ii) subject to a damping load in a spool out direction; and (c) when operatively disengaged from the drive gear, is adapted to enable the drive gear to rotate freely in both the spool in direction and the spool out direction; F) providing the trigger mechanism, when the bowstring is in the un-cocked position, to be selectively moveable along the main beam to the bowstring; G) providing the string catch, when the bowstring is in the un-cocked position and the trigger mechanism is positioned at the bowstring, to be selectively movable from: 1) the first string catch position that does not hold the bowstring; to 2) the second string catch position that holds the bowstring; H) providing the winch assembly, when the bowstring is in the un-cocked position and the string catch is in the second string catch position holding the bowstring, to be selectively operable: 1) to receive a first rotational input to rotate the drive gear in the spool in direction; to 2) rotate the spool gear; to 3) rotate the spool; to 4) wrap the tensile member around the spool; to 5) move the trigger mechanism along the main beam to the trigger latch mechanism; to 6) move the bowstring from the un-cocked position to the cocked position; I) providing the trigger latch, as the trigger mechanism is moved to the trigger latch mechanism, to be selectively movable from: 1) the first trigger latch position; into 2) the second trigger latch position to hold the trigger mechanism to the main beam; J) providing the winch assembly, when the trigger latch is in the second trigger latch position holding the trigger mechanism to the main beam and the string catch is in the second string catch position holding the bowstring, to be selectively operable: 1) to receive a second rotational input to rotate the drive gear in the spool out direction; to 2) rotate the spool gear; to 3) rotate the spool; to 4) relieve tension from the tensile member; and K) providing the trigger mechanism, when the tension has been relieved from the tensile member, the trigger latch remains in the second trigger latch position holding the trigger mechanism to the main beam and the string catch remains in the second string catch position holding the bowstring, to be selectively operable to move the string catch into the first string latch position to release the bowstring to fire the crossbow.

According to some embodiments of this invention, a crossbow may include: a longitudinally extending main beam; a bow mechanism including: 1) a pair of outwardly extending bow limbs extending transversely from opposite lateral sides of the main beam; and 2) a bowstring operatively engaged to the outwardly extending bow limbs and movable between: (a) an un-cocked position; and (b) a cocked position; a cocking mechanism including: 1) a trigger mechanism; 2) a trigger latch mechanism; and 3) a winch assembly; the trigger mechanism including: 1) a trigger housing; 2) a trigger surface supported to the trigger housing; and 3) a string catch supported to the trigger housing and selectively movable between: (a) a first string catch position that does not hold the bowstring; and (b) a second string catch position that holds the bowstring; the trigger latch mechanism including a trigger latch supported to the main beam and selectively movable between: (a) a first trigger latch position that does not engage the trigger surface; and (b) a second trigger latch position that engages the trigger surface to hold the trigger mechanism to the main beam at a longitudinal position; and the winch assembly including: 1) a winch housing supported to the main beam; 2) a spool that is selectively rotatable with respect to the winch housing; 3) a tensile member having: (a) a first end operatively engaged with the spool; and (b) a second end operatively engaged with the trigger housing; 4) a spool gear: (a) operatively engaged with the spool; and (b) selectively rotatable with respect to the winch housing; and 5) a drive gear: (a) operatively engaged with the spool gear; and (b) selectively rotatable with respect to the winch housing with a drive shaft that has threads; 6) a clutch gear assembly that: (a) includes a pressure plate gear; (b) includes a receiver having threads that engage the drive shaft threads; (c) is selectively operatively engageable to the drive gear; (d) when operatively engaged to the drive gear: (i) the drive gear and pressure plate gear rotate together with the drive shaft; and (ii) is adapted to enable the drive gear to rotate: freely in a spool in direction; and subject to a damping load in a spool out direction; and (e) when operatively disengaged from the drive gear: (i) the drive gear rotates with the drive shaft; (ii) the pressure plate gear does not rotate with the drive shaft; and (iii) is adapted to enable the drive gear to rotate freely in both the spool in direction and the spool out direction; 7) a one way bearing selectively rotatable in only one direction with respect to the winch housing; and 8) a brake gear: (a) operatively engaged with the pressure plate gear teeth; (b) operatively engaged with the one way bearing; and (c) selectively rotatable in the only one direction with respect to the winch housing. When the bowstring is in the un-cocked position, the trigger mechanism may be selectively moveable along the main beam to the bowstring. When the bowstring is in the un-cocked position and the trigger mechanism is positioned at the bowstring, the string catch may be selectively movable from: (a) the first string catch position that does not hold the bowstring; to (b) the second string catch position that holds the bowstring. When the bowstring is in the un-cocked position and the string catch is in the second string catch position holding the bowstring, the winch assembly may be selectively operable: (a) to receive a first rotational input to rotate the drive gear in the spool in direction; to (b) rotate the spool gear; to (c) rotate the spool; to (d) wrap the tensile member around the spool; to (e) move the trigger mechanism along the main beam to the trigger latch mechanism; to (f) move the bowstring from the un-cocked position to the cocked position. As the trigger mechanism is moved to the trigger latch mechanism, the trigger latch may be selectively movable from the first trigger latch position into the second trigger latch position to hold the trigger mechanism to the main beam. When the trigger latch is in the second trigger latch position holding the trigger mechanism to the main beam and the string catch is in the second string catch position holding the bowstring, the winch assembly may be selectively operable: (a) to receive a second rotational input to rotate the drive gear in the spool out direction; to (b) rotate the spool gear; to (c) rotate the spool; to (d) relieve tension from the tensile member. When the tension has been relieved from the tensile member, the trigger latch remains in the second trigger latch position holding the trigger mechanism to the main beam and the string catch remains in the second string catch position holding the bowstring, the trigger mechanism may be selectively operable to move the string catch into the first string latch position to release the bowstring to fire the crossbow. When the clutch gear assembly is operatively engaged to the drive gear and the bowstring is positioned between the cocked position and the un-cocked position, defined as an intermediate bowstring position: removal of rotational input to the winch assembly may result in the bowstring remaining in the intermediate bowstring position. The receiver may be adapted when rotated sufficiently: (a) in a first receiver direction with respect to the drive shaft, to operatively engage the clutch gear assembly to the drive gear; and (b) in a second receiver direction with respect to the drive shaft, opposite the first receiver direction, to operatively disengage the clutch gear assembly from the drive gear.

According to some embodiments of this invention, a crossbow may include: a longitudinally extending main beam; a bow mechanism including: 1) a pair of outwardly extending bow limbs extending transversely from opposite lateral sides of the main beam; and 2) a bowstring operatively engaged to the outwardly extending bow limbs and movable between: (a) an un-cocked position; and (b) a cocked position; a de-cocking mechanism including: 1) a trigger mechanism; 2) a trigger latch mechanism; and 3) a winch assembly; the trigger mechanism including: 1) a trigger housing; 2) a trigger surface supported to the trigger housing; and 3) a string catch supported to the trigger housing and selectively movable between: (a) a first string catch position that does not hold the bowstring; and (b) a second string catch position that holds the bowstring; the trigger latch mechanism including a trigger latch supported to the main beam and selectively movable between: (a) a first trigger latch position that does not engage the trigger surface; and (b) a second trigger latch position that engages the trigger surface to hold the trigger mechanism to the main beam at a longitudinal position; and the winch assembly including: 1) a winch housing supported to the main beam; 2) a spool that is selectively rotatable with respect to the winch housing; 3) a tensile member having: (a) a first end operatively engaged with the spool; and (b) a second end operatively engaged with the trigger housing; 4) a spool gear: (a) operatively engaged with the spool; and (b) selectively rotatable with respect to the winch housing; 5) a drive gear: (a) operatively engaged with the spool gear; and (b) selectively rotatable with respect to the winch housing; and 6) a clutch gear assembly that: (a) is selectively operatively engageable to the drive gear; (b) when operatively engaged to the drive gear, is adapted to enable the drive gear to rotate: (i) freely in a spool in direction; and (ii) subject to a damping load in a spool out direction; and (c) when operatively disengaged from the drive gear, is adapted to enable the drive gear to rotate freely in both the spool in direction and the spool out direction. When the bowstring is in the cocked position, the trigger latch is in the second trigger latch position holding the trigger mechanism to the main beam at the longitudinal position, the string catch is in the second string catch position holding the bowstring, and tension has been relieved from the tensile member, the trigger latch mechanism may be selectively operable: to receive a trigger latch force on the trigger latch to relieve tension from the trigger latch mechanism. When the bowstring is in the cocked position, the trigger latch is in the second trigger latch position holding the trigger mechanism to the main beam at the longitudinal position, the string catch is in the second string catch position holding the bowstring, tension has been relieved from the trigger latch mechanism and the trigger latch force continues to be applied to the trigger latch; the winch assembly may be selectively operable: (a) to receive a first rotational input to rotate the drive gear in the spool in direction; to (b) rotate the spool gear; to (c) rotate the spool; to (d) apply tension to the tensile member; to (e) move the trigger latch into the first trigger latch position that does not engage the trigger surface. When the bowstring is in the cocked position, the trigger latch is in the first trigger latch position that does not engage the trigger surface and the string catch is in the second string catch position holding the bowstring, the winch assembly may be selectively operable: (a) to receive a second rotational input to rotate the drive gear in the spool out direction; to (b) rotate the spool gear; to (c) rotate the spool; to (d) unwrap the tensile member from the spool; to (e) move the trigger mechanism away from the trigger latch mechanism; to (f) move the bowstring from the cocked position to the un-cocked position.

According to some embodiments of this invention, a crossbow method may include the steps of: A) providing a crossbow including: 1) a longitudinally extending main beam; 2) a bow mechanism including: (a) a pair of outwardly extending bow limbs extending transversely from opposite lateral sides of the main beam; and (b) a bowstring operatively engaged to the outwardly extending bow limbs and movable between: (i) an un-cocked position; and (ii) a cocked position; B) providing a de-cocking mechanism including: 1) a trigger mechanism; 2) a trigger latch mechanism; and 3) a winch assembly; C) providing the trigger mechanism with: 1) a trigger housing; 2) a trigger surface supported to the trigger housing; and 3) a string catch supported to the trigger housing and selectively movable between: (a) a first string catch position that does not hold the bowstring; and (b) a second string catch position that holds the bowstring; D) providing the trigger latch mechanism with a trigger latch supported to the main beam and selectively movable between: 1) a first trigger latch position that does not engage the trigger surface; and 2) a second trigger latch position that engages the trigger surface to hold the trigger mechanism to the main beam at a longitudinal position; E) providing the winch assembly with: 1) a winch housing supported to the main beam; 2) a spool that is selectively rotatable with respect to the winch housing; 3) a tensile member having: (a) a first end operatively engaged with the spool; and (b) a second end operatively engaged with the trigger housing; 4) a spool gear: (a) operatively engaged with the spool; and (b) selectively rotatable with respect to the winch housing; 5) a drive gear: (a) operatively engaged with the spool gear; and (b) selectively rotatable with respect to the winch housing; and 6) a clutch gear assembly that: (a) is selectively operatively engageable to the drive gear; (b) when operatively engaged to the drive gear, is adapted to enable the drive gear to rotate: (i) freely in a spool in direction; and (ii) subject to a damping load in a spool out direction; and (c) when operatively disengaged from the drive gear, is adapted to enable the drive gear to rotate freely in both the spool in direction and the spool out direction; F) providing the trigger latch mechanism, when the bowstring is in the cocked position, the trigger latch is in the second trigger latch position holding the trigger mechanism to the main beam at the longitudinal position, the string catch is in the second string catch position holding the bowstring, and tension has been relieved from the tensile member, to be selectively operable: to receive a trigger latch force on the trigger latch to relieve tension from the trigger latch mechanism; G) providing the winch assembly, when the bowstring is in the cocked position, the trigger latch is in the second trigger latch position holding the trigger mechanism to the main beam at the longitudinal position, the string catch is in the second string catch position holding the bowstring, tension has been relieved from the trigger latch mechanism and the trigger latch force continues to be applied to the trigger latch, to be selectively operable: 1) to receive a first rotational input to rotate the drive gear in the spool in direction; to 2) rotate the spool gear; to 3) rotate the spool; to 4) apply tension to the tensile member; to 5) move the trigger latch into the first trigger latch position that does not engage the trigger surface; and H) providing the winch assembly, when the bowstring is in the cocked position, the trigger latch is in the first trigger latch position that does not engage the trigger surface and the string catch is in the second string catch position holding the bowstring, to be is selectively operable: 1) to receive a second rotational input to rotate the drive gear in the spool out direction; to 2) rotate the spool gear; to 3) rotate the spool; to 4) unwrap the tensile member from the spool; to 5) move the trigger mechanism away from the trigger latch mechanism; to 6) move the bowstring from the cocked position to the un-cocked position.

According to some embodiments of this invention, a crossbow may include: a longitudinally extending main beam; a bow mechanism including: 1) a pair of outwardly extending bow limbs extending transversely from opposite lateral sides of the main beam; and 2) a bowstring operatively engaged to the outwardly extending bow limbs and movable between: (a) an un-cocked position; and (b) a cocked position; a de-cocking mechanism including: 1) a trigger mechanism; 2) a trigger latch mechanism; and 3) a pawl-less winch assembly; the trigger mechanism including: 1) a trigger housing; 2) a trigger surface supported to the trigger housing; and 3) a string catch supported to the trigger housing and selectively movable between: (a) a first string catch position that does not hold the bowstring; and (b) a second string catch position that holds the bowstring; the trigger latch mechanism including a trigger latch supported to the main beam and selectively movable between: (a) a first trigger latch position that does not engage the trigger surface; and (b) a second trigger latch position that engages the trigger surface to hold the trigger mechanism to the main beam at a longitudinal position; and the pawl-less winch assembly including: 1) a winch housing supported to the main beam; 2) a spool that is selectively rotatable with respect to the winch housing; 3) a tensile member having: (a) a first end operatively engaged with the spool; and (b) a second end operatively engaged with the trigger housing; 4) a spool gear: (a) operatively engaged with the spool; and (b) selectively rotatable with respect to the winch housing; 5) a drive gear: (a) operatively engaged with the spool gear; and (b) selectively rotatable with a drive shaft having threads with respect to the winch housing; and 6) a clutch gear assembly that: (a) includes a pressure plate gear; (b) includes a receiver having threads that engage the drive shaft threads; (b) is selectively operatively engageable to the drive gear; (c) when operatively engaged to the drive gear, is adapted to enable the drive gear to rotate: (i) freely in a spool in direction; and (ii) subject to a damping load in a spool out direction; and (d) when operatively disengaged from the drive gear, is adapted to enable the drive gear to rotate freely in both the spool in direction and the spool out direction. When the bowstring is in the cocked position, the trigger latch is in the second trigger latch position holding the trigger mechanism to the main beam at the longitudinal position, the string catch is in the second string catch position holding the bowstring, and tension has been relieved from the tensile member, the trigger latch mechanism may be selectively operable: to receive a trigger latch force on the trigger latch to relieve tension from the trigger latch mechanism. When the bowstring is in the cocked position, the trigger latch is in the second trigger latch position holding the trigger mechanism to the main beam at the longitudinal position, the string catch is in the second string catch position holding the bowstring, tension has been relieved from the trigger latch mechanism and the trigger latch force continues to be applied to the trigger latch; the winch assembly may be selectively operable: (a) to receive a first rotational input of at least 360 degrees to rotate the drive gear in the spool in direction; to (b) rotate the spool gear; to (c) rotate the spool; to (d) apply tension to the tensile member; to (e) move the trigger latch into the first trigger latch position that does not engage the trigger surface; 3) when the bowstring is in the cocked position, the trigger latch is in the first trigger latch position that does not engage the trigger surface and the string catch is in the second string catch position holding the bowstring, the winch assembly is selectively operable: (a) to receive a second rotational input to rotate the drive gear in the spool out direction; to (b) rotate the spool gear; to (c) rotate the spool; to (d) unwrap the tensile member from the spool; to (e) move the trigger mechanism away from the trigger latch mechanism; to (f) move the bowstring from the cocked position to the un-cocked position. When the clutch gear assembly is operatively engaged to the drive gear, the drive gear and pressure plate gear may rotate together with the drive shaft. When the clutch gear assembly is operatively disengaged from the drive gear: (a) the drive gear may rotate with the drive shaft; and (b) the pressure plate gear may not rotate with the drive shaft. The receiver may be adapted when rotated sufficiently: (a) in a first receiver direction with respect to the drive shaft, to operatively engage the clutch gear assembly to the drive gear; and (b) in a second receiver direction with respect to the drive shaft, opposite the first receiver direction, to operatively disengage the clutch gear assembly from the drive gear.

Benefits and advantages of this invention will become apparent to those skilled in the art to which it pertains upon reading and understanding of the following detailed specification.

III. BRIEF DESCRIPTION OF THE DRAWINGS

The present subject matter may take physical form in certain parts and arrangement of parts, embodiments of which will be described in detail in this specification and illustrated in the accompanying drawings which form a part hereof and wherein.

IV. DEFINITIONS

The following definitions are controlling for the disclosed subject matter:

"Arrow" means a projectile that is shot with (or launched by) a bow assembly.

"Bow" means a bent, curved, or arched object.

"Bow Assembly" means a weapon including a bow and a bowstring that shoots or propels arrows powered by the elasticity of the bow and the drawn bowstring.

"Bowstring" means a string or cable attached to a bow.

"Compound Bow" means a crossbow that has wheels, pulleys or cams at each end of the bow through which the bowstring passes.

"Crossbow" means a weapon including a bow assembly and a trigger mechanism both mounted to a main beam.

"Draw Weight" means the amount of force required to draw or pull the bowstring on a crossbow into a cocked condition.

"Main Beam" means the longitudinal structural member of a weapon used to support the trigger mechanism and often other components as well. For crossbows, the main beam also supports the bow assembly. The main beam often includes a stock member, held by the person using the weapon, and a barrel, used to guide the projectile being shot or fired by the weapon.

"Power Stroke" means the linear distance that the bowstring is moved between the un-cocked condition and the cocked condition.

"Trigger Mechanism" means the portion of a weapon that shoots, fires or releases the projectile of a weapon. As applied to crossbows, trigger mechanism means any device that holds the bowstring of a crossbow in the drawn or cocked condition and which can thereafter be operated to release the bowstring out of the drawn condition to shoot an arrow.

"Weapon" means any device that can be used in fighting or hunting that shoots or fires a projectile including bow assemblies and crossbows.

V. DETAILED DESCRIPTION

Figure 1:
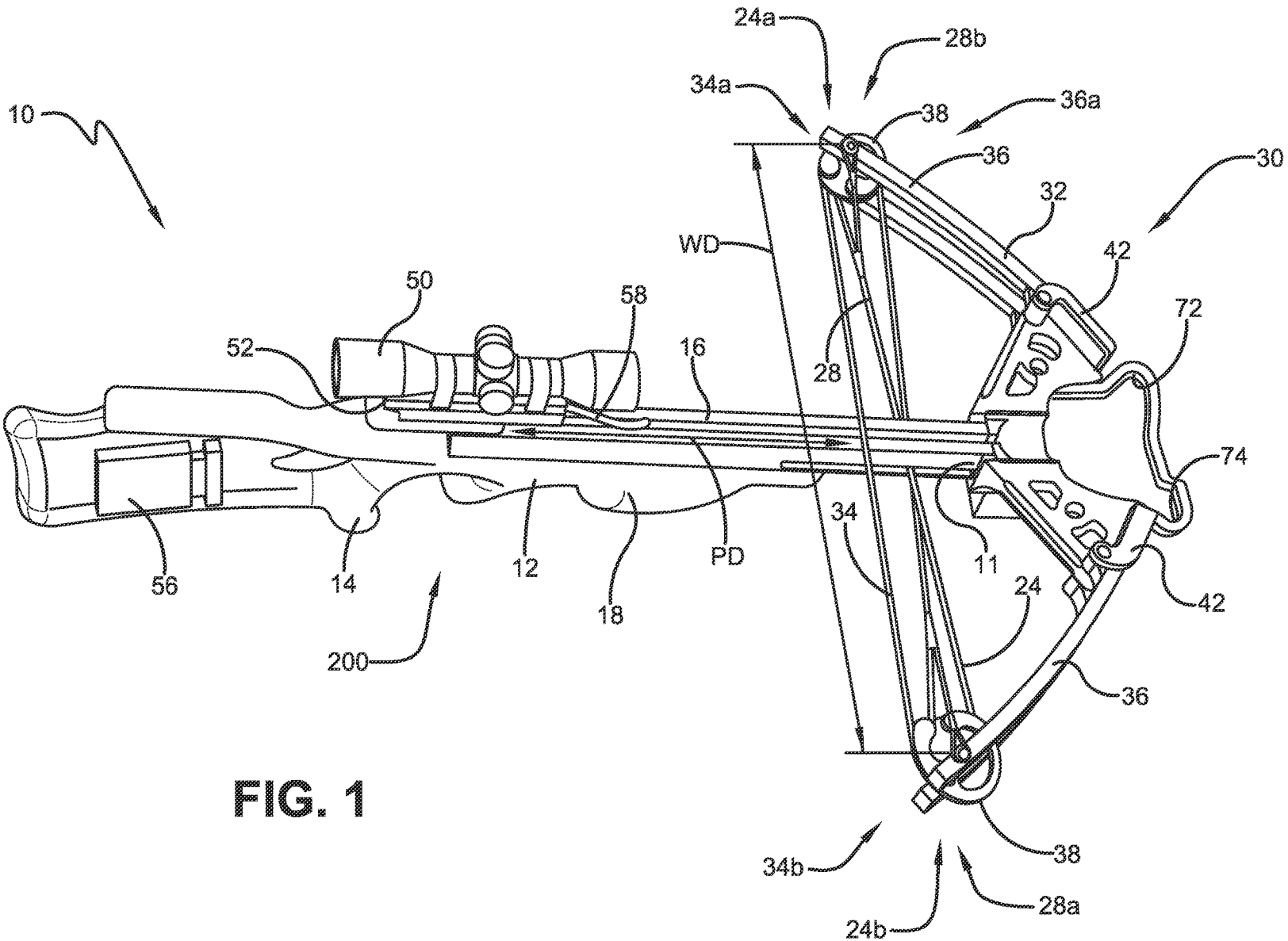
FIG. 1 is a view of a first non-limiting embodiment of a crossbow.

Referring now to the drawings wherein the showings are for purposes of illustrating embodiments of the invention only and not for purposes of limiting the same, and wherein like reference numerals are understood to refer to like components, FIG. 1 shows a crossbow 10 according to some embodiments of the present subject matter. While the crossbow 10 shown uses a compound bow, it should be understood that this invention will work well with any type of crossbow chosen with sound judgment by a person of ordinary skill in the art. The crossbow 10 has a main beam 12 which may include a stock member 14, and a barrel 16. The main beam 12 may be made by assembling the stock member 14 and the barrel 16 together as separate components or, in another embodiment, the main beam 12 may be made as one piece. A handgrip 18 may be mounted to the main beam 12 in any conventional manner chosen with sound judgment by a person of ordinary skill in the art. In some non-limiting embodiments the main beam may be elongated to define a distal end 11 opposite the stock member 14. A trigger mechanism 200 suitable for shooting an arrow may be mounted to the main beam 12 in any suitable manner. It should be noted that the crossbow 10 may include any trigger mechanism 200 chosen with sound judgment by a person of ordinary skill in the art. The crossbow 10 also includes a bow assembly 30 adapted to propel an associated arrow and having a bow 32 and a bowstring 34. The bow 32 may include a set of limbs 36, 36 that receive the bowstring 34 in any conventional manner chosen with sound judgment by a person of ordinary skill in the art. For the embodiment shown, a pair of wheels, pulleys, or cams 38, 38 mounted to the limbs 36, 36 receive the bowstring 34 in a known manner. In some non-limiting embodiments, the set of limbs has a first side 36*a* and a second side 36*b* opposite the first side 36*a* with first side 36*a* being operationally engaged with a first cam 38 and second side 36*b* being operationally engaged with a second cam 38. The bow may also include a riser 40. The riser 40 may include a set of limb pockets 42, 42 adapted to receive the limbs 36, 36, as shown in FIG. 1. The bow may further include a first power cord 24 and a second power cord 28.

With continuing reference to FIG. 1, other crossbow components may be optionally used with a crossbow as provided herein. Without limitation, in some non-limiting embodiments, a crossbow 10 shown may include a scope 50 attached to a scope mount 52 that may be supported on the main beam 12. Other optional components shown include a cocking unit 56, and arrow holder 58. In certain non-limiting embodiments, the riser 40 may have an opening 72 formed therein defining a foot stirrup 74 adapted for holding and balancing the crossbow by foot. A crossbow 10 may have a power stroke distance PD. The distance between the pivot axes of the wheels, pulleys, or cams 38, 38 may be some distance WD.

Figure 2:
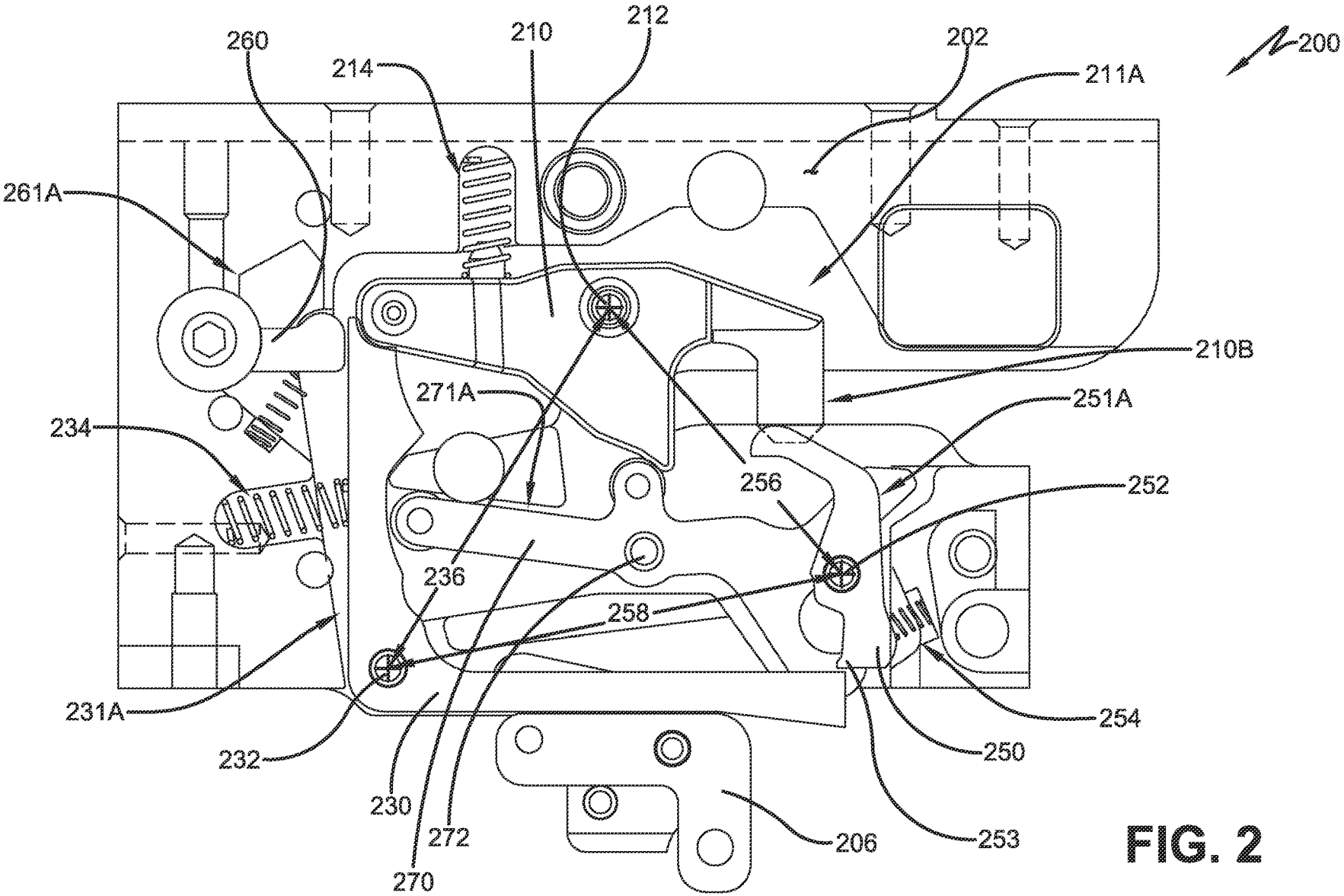
FIG. 2 is a view of a first non-limiting embodiment of a crossbow trigger mechanism in a cocked configuration.
Figure 3:
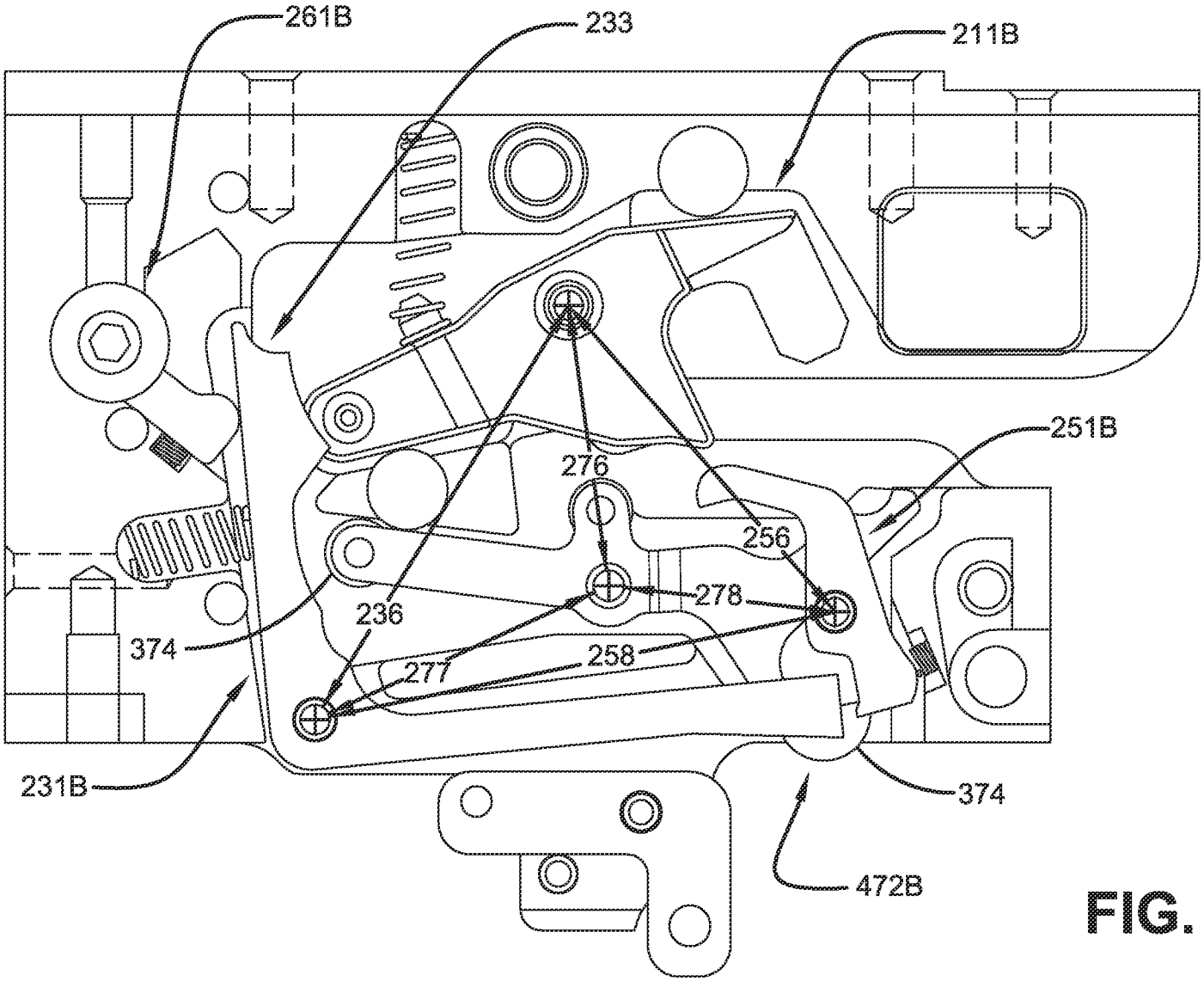
FIG. 3 is a view of the first non-limiting embodiment of a crossbow trigger mechanism in an un-cocked configuration.
Figure 4:
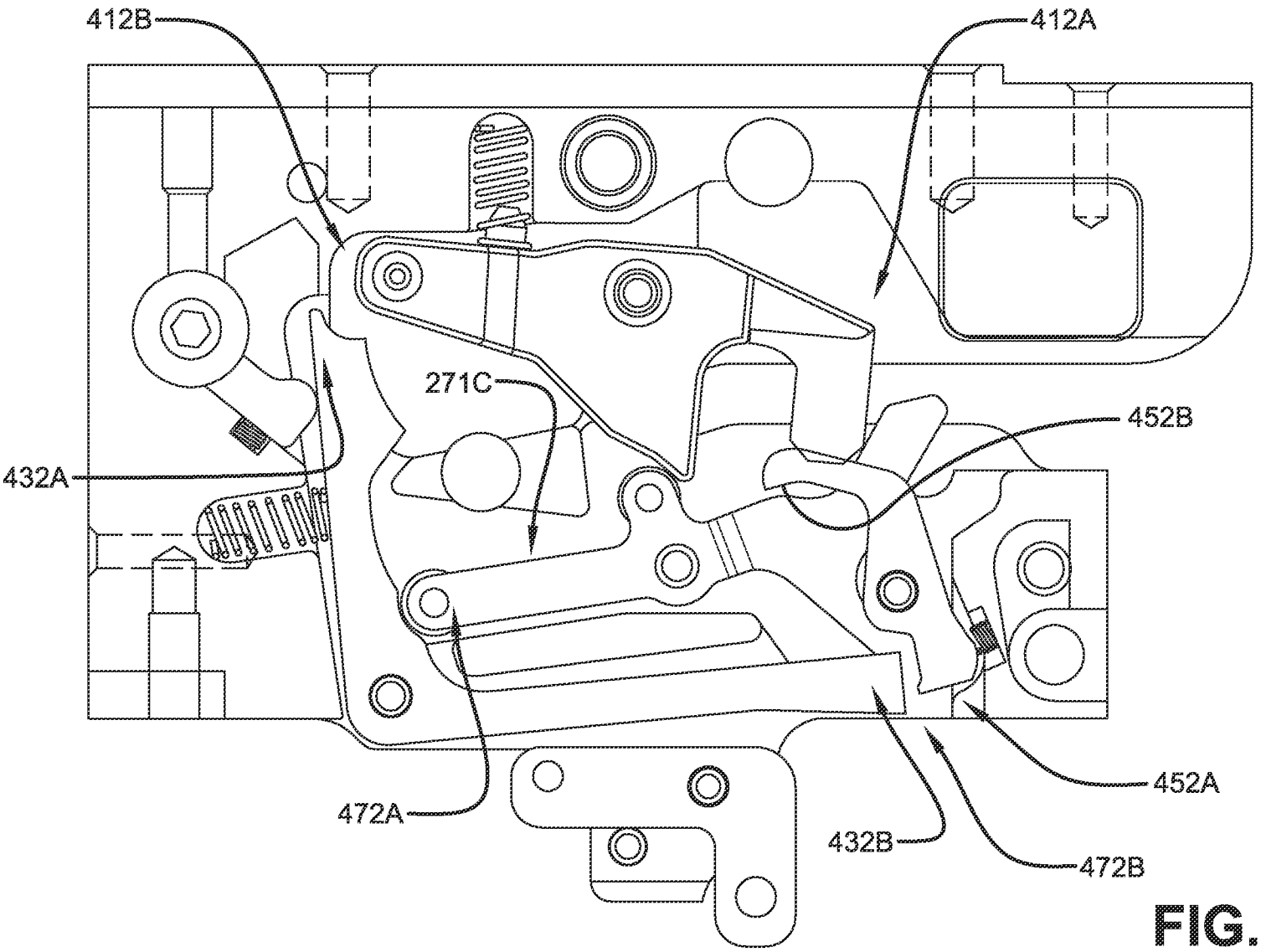
FIG. 4 is a view of the first non-limiting embodiment of a crossbow trigger mechanism in an un-cocked configuration.

With reference now to FIGS. 1-4, trigger mechanism 200 may be adapted to retain a cocked bowstring 34, to release a cocked bowstring 34 during a firing operation, and to release a cocked bowstring 34 during a de-cocking operation. The trigger mechanism 200 may be adapted to prevent dry-firing but also to allow intentional de-cocking without firing an arrow. Here, dry-firing is meant to cover operation in which the bowstring is released in a manner with speed and energy with release rates similar to those of an arrow firing operation, but without the arrow. FIGS. 2-4 show cut-away views of trigger mechanism 200. FIG. 2 shows the trigger mechanism 200 in the cocked configuration, FIG. 3 shows the trigger mechanism 200 in the un-cocked configuration and FIG. 4 shows the trigger mechanism 200 in the de-cock configuration.

With reference now to FIGS. 2-4, the trigger mechanism 200 may have a trigger housing 202. In some non-limiting embodiments, housing 202 may be adapted for operational engagement with an associated crossbow 10 or part of an associated crossbow 10, such as, without limitation main beam 12. In some non-limiting embodiments, housing 202 may be an integral part of an associated crossbow 10 such as, without limitation, the main beam 12. The trigger mechanism 200 may include a first pivot axis 212 engaged with housing 202. The first pivot axis 212 may be adapted to provide a positive location about which an operationally engaged lever may pivot. The first pivot axis 212, or any pivot axis herein, may be defined by a pin, pin and bushing, pin and bearing, or other components chosen with good engineering judgment that permits a lever operationally engaged therewith to pivot. The first pivot axis 212, or any pivot axis herein unless otherwise noted defines a location fixed with respect to the rigid housing 202. The lever operationally engaged with the first pivot axis 212 may be string catch 210. String catch 210 may be adapted to pivot about the first pivot axis 212 between a cocked orientation 211A, as shown in FIG. 2, and an un-cocked orientation 211B, as shown in FIG. 3. In the cocked configuration: the string catch 210, may be adapted and oriented to restrain the associated bowstring 34 of an associated crossbow 10 in a cocked position. In the un-cocked configuration: the string catch 210, may be adapted and oriented to release the associated bowstring 34 of an associated crossbow 10. String catch 210 may be biased by a spring 214 to pivot into the un-cocked orientation unless otherwise moved or restrained. The string catch 210 may be elongated to define a first end of the catch 412A and a second end of the catch 412B opposite the first end of the latch 412A.

With continuing reference to FIGS. 2-4, the trigger mechanism 200 may have a second pivot axis 232 engaged with housing 202. The second pivot axis 232 may be adapted to provide a positive location about which an operationally engaged lever may pivot. Without limitation, the first pivot axis 232 may include a pin, a pin and bushing, pin and bearing, or other components chosen with good engineering judgment that permits a lever operationally engaged therewith to pivot. The lever operationally engaged with the second pivot axis 232 may be firing lever 230. Firing lever 230 may be adapted to pivot about the second pivot axis 232 between a cocked orientation 231A, as shown in FIG. 2, and an un-cocked orientation 231B, as shown in FIG. 3. In the cocked orientation, the firing lever 230, may be adapted and oriented to restrain the string catch 210 such that string catch 210 will not pivot out of the cocked orientation 211A. In the un-cocked configuration: the firing lever 230, may be adapted and oriented to not restrain the string catch 210 such that string catch 210 may pivot out of the cocked orientation 211A into the un-cocked orientation 211B. Firing lever 230 may be biased by a spring 234 to pivot into the cocked orientation 231A unless otherwise moved or restrained. The second pivot axis 232 may be offset from the first pivot axis 212 by a first offset distance 236. Firing lever 230 may be engaged with a manually operable lever 206 or other mechanism adapted for use by a user to move the firing lever 230 from the cocked orientation 231A to the un-cocked orientation 231B when the firing lever 230 is not otherwise restrained by the dry fire latch 250 or the safety 260 as set forth below. The firing lever 230 may be elongated to define a first end of the firing lever 432A and a second end of the firing lever 432B opposite the first end of the firing lever 432A. The firing lever 230 may include a firing lever catch 233 adapted to selectively engage the string catch 210, and to prevent the string catch 210 from operating to move from the cocked orientation of the latch 20 to the un-cocked orientation of the latch 211B when the firing lever 230 is in the cocked orientation of the firing lever 231A.

With continuing reference to FIGS. 2-4, the trigger mechanism 200 may have a third pivot axis 252 engaged with housing 202. The third pivot axis 252 may be adapted to provide a positive location about which an operationally engaged lever may pivot. Without limitation, the third pivot axis 252 may include a pin, a pin and bushing, pin and bearing, or other components chosen with good engineering judgment that permits a lever operationally engaged therewith to pivot. The lever operationally engaged with the third pivot axis 252 may be dry fire latch 250. Dry fire latch 250 may be adapted to pivot about the third pivot axis 252 between a cocked orientation 251A, as shown in FIG. 2, and an un-cocked orientation 251B, as shown in FIG. 3. In the cocked orientation, the dry fire latch 250, may be adapted and oriented to restrain the firing lever 230 such that firing lever 230 will not pivot out of the cocked orientation 231A. In the un-cocked configuration: the dry fire latch 250 may be adapted and oriented to not restrain the firing lever 230 such that firing lever 230 may pivot out of the cocked orientation 231A into the un-cocked orientation 231B. Dry fire latch 250 may be biased by a spring 254 to pivot into the cocked orientation 251A unless otherwise moved or restrained. The third pivot axis 252 may be offset from the first pivot axis 212 by a second offset distance 256. The third pivot axis 252 may be offset from the second pivot axis 232 by a third offset distance 258. In the cocked orientation 251A, the dry fire latch extends into the region 210B of string catch 210 that may be to be occupied by an associated arrow when such an associated arrow is properly engaged with the associated crossbow 10 for firing. As a result, when an associated arrow is properly engaged with the associated crossbow 10 for firing, the arrow pushes the dry fire latch 250 into the un-cocked orientation 251B. The dry fire latch 250 may be elongated to define a first end of the dry fire latch 452A and a second end of the dry fire latch 452B opposite the first end of the dry fire latch 452A. The dry fire latch 250 may have a dry fire latch catch 253 adapted to selectively engage the firing lever 230 to prevent the firing lever 230 from operating to move from the cocked orientation of the firing lever to the un-cocked orientation of the firing lever when the dry fire latch 250 is in the cocked orientation of the dry fire latch 251A.

Still referring to FIGS. 2-4, the trigger mechanism 200 may have a fourth pivot axis 272 engaged with housing 202. The fourth pivot axis 272 may be adapted to provide a positive location about which an operationally engaged lever may pivot. Without limitation, the fourth pivot axis 272 may include a pin, a pin and bushing, pin and bearing, or other components chosen with good engineering judgment that permits a lever operationally engaged therewith to pivot. The lever operationally engaged with the fourth pivot axis 272 may be de-cocking lever 270. De-cocking lever 270 may be adapted to pivot about the fourth pivot axis 272 between a cocked orientation 271A, as shown in FIG. 2, and a de-cock orientation 271C, as shown in FIG. 4. In the cocked configuration 271A: the de-cocking lever 270, is oriented to not restrain the string catch 210 from pivoting between the cocked orientation 211A and the un-cocked orientation 211B. In the cocked configuration 271A: the de-cocking lever 270, is oriented to not restrain the firing lever 230 from pivoting between the cocked orientation 231A and the un-cocked orientation 231B. In the cocked configuration 271A: the de-cocking lever 270, is oriented to not restrain the dry fire latch 250 from pivoting between the cocked orientation 251A and the un-cocked orientation 251B. The fourth pivot axis 272 may be offset from the first pivot axis 212 by a fourth offset distance 276. The fourth pivot axis 272 may be offset from the second pivot axis 232 by a fifth offset distance 277. The fourth pivot axis 272 may be offset from the third pivot axis 252 by a sixth offset distance 278.

With continuing reference to FIGS. 2-4, in the de-cock configuration 271C: the de-cocking lever 270, is oriented to force the firing lever 230 to pivot from the cocked orientation 231A, into the un-cocked orientation 231B. The de-cocking lever 270 may force the firing lever 230 to pivot from the cocked orientation 231A, to the un-cocked orientation 231B by pushing it with one or more lobes 374. The lobes 374 may push upon another lever or latch, 210, 230, 250 to apply a force that induces a change in the orientation of that other lever or latch, 210, 230, 250. In the de-cock configuration 271C: the de-cocking lever 270, is oriented to force the dry fire latch 250 to pivot from the cocked orientation 251A, into the un-cocked orientation 251B. The de-cocking lever 270 may force the dry fire latch 250 to pivot from the cocked orientation 251A, to the un-cocked orientation 251B by pushing it with one or more lobes 374. The de-cocking lever 270 may be elongated to define a first end of the de-cocking lever 472A and a second end of the de-cocking lever 272B opposite the first end of the de-cocking lever 472A.

With reference now to FIGS. 1-4, in some aspects of crossbow trigger mechanism 200, the safety 260 may interlock with one or more other components of the crossbow trigger mechanism 200 to prevent the motion of the one or more components of the crossbow trigger mechanism 200. For example and without limitation, the safety 260 may have a selectable orientation, safe orientation 261A, in which it will block the firing lever 230 from moving from the cocked orientation 231A to the un-cocked orientation 231B. Similarly, the safety 260 may have a selectable orientation, fire orientation 261B, in which it will permit the firing lever 230 to move from the cocked orientation 231A to the un-cocked orientation 231B. The safety 260 may have a selectable orientation in which it will lock the de-cocking lever 270 from moving from the cocked orientation 271A to the de-cock orientation 271C, such that the de-cocking lever 270 is selectively lockable by the safety 260 from being moved to the de-cock orientation of the de-cocking lever 271C. As shown in FIG. 4, moving the de-cocking lever 270 to the de-cock orientation 271C forces the dry fire latch 250 into un-cocked orientation 251B and forces the firing lever 230 into the un-cocked orientation 231B. With the de-cocking lever 270 in the de-cock orientation 271C, the dry fire latch 250 in the un-cocked orientation 251B and the firing lever 230 in the un-cocked orientation 231B, the string catch 210 is not constrained by other components of the crossbow trigger mechanism 200 from moving into the un-cocked orientation 211B and, accordingly, will readily move to release a cocked associated bowstring 34 of an associated crossbow 10. This latter state allows release of the cocked associated bowstring 34 of an associated crossbow 10 in a controlled manner and thereby the safe de-cocking of the associated crossbow 10. The controlled manner by which the cocked associated bowstring 34 of an associated crossbow 10 releases may be chosen with good engineering judgment, but a first non-limiting process for the controlled release of the cocked associated bowstring 34 of an associated crossbow 10 uses a winch assembly.

Figure 5:
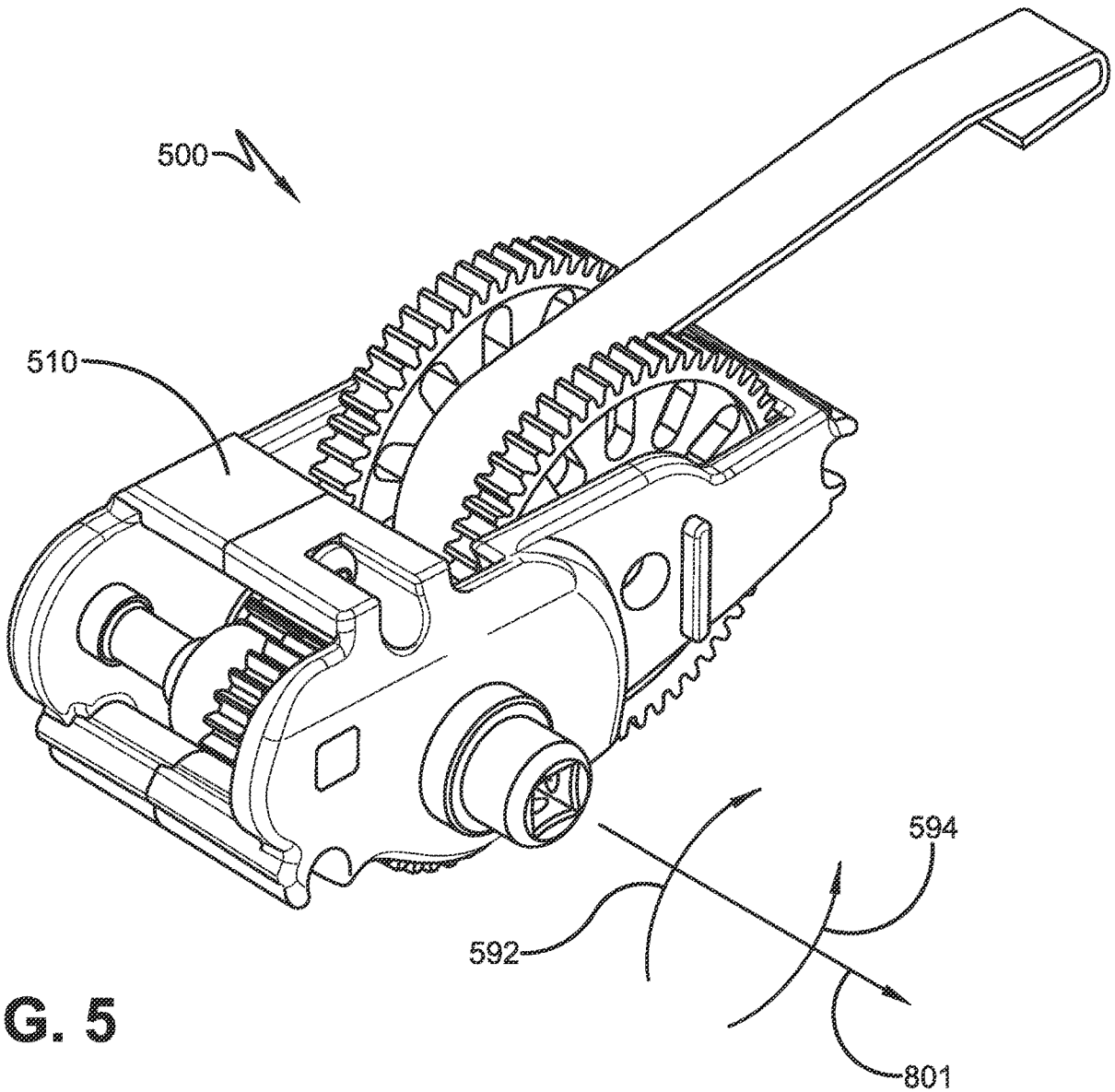
FIG. 5 is a perspective view of a first non-limiting embodiment of a winch assembly.

With reference now to FIGS. 1 and 5, a winch assembly 500 may be used with any crossbow chosen with the sound judgement of a person of skill in the art. A winch assembly may be used to apply a large output force to an associated bowstring of an associated crossbow. Typically, although not always, a winch assembly may be to provide a substantial mechanical advantage such an associated user may apply a large output force with relative ease. Embodiments of winch assembly 500 may, for example, be usable with crossbow 10 described above. In this case, winch assembly 500 may operate as the cocking unit 56. Embodiments of winch assembly 500 may also be used with other crossbows, as described below. In some embodiments, a winch assembly 500 may include a winch housing 510, a spool 620, a tensile member 630, a spool gear 640, a drive gear 650, and a clutch gear assembly 660. These components will be discussed below.

With reference now to FIGS. 5-8D, the winch housing 510 may define a first housing axis 802 and a second housing axis 801. The second housing axis 801 may be parallel to and offset from the first housing axis 802 by a second housing axis offset distance 804. In some non-limiting embodiments the winch housing 510 may be formed by two or more separately formed parts which are mechanically engaged to form the winch housing 510. In the non-limiting embodiments shown, winch housing 510 is formed by a first housing part 612 and a second housing part 614 which are engaged to one another by mechanical fasteners 616 to form the winch housing 510. In some non-limiting embodiments, winch housing 510 may be adapted for operational engagement with an associated crossbow. In some non-limiting embodiments, winch housing 510 may be an integral part of an associated crossbow such as, without limitation, being supported to the main beam.

With reference now to FIGS. 5-10E, the spool 620 may have a spool axis 1002 and a spool surface 1004 around the spool axis. In certain embodiments, the spool 620 may be substantially cylindrical. The spool 620 may be assembled with the winch housing 510 housing in such a way that the spool axis 1002 coincides with the first housing axis 802. The spool surface 1004 may be being selectively rotatable around the spool axis 1002 with respect to the winch housing 510. In certain embodiments, the spool 620 is a solid cylinder that selectively rotatable around the spool axis 1002 and the first housing axis 802 such that rotation of the spool 620 with respect to winch housing 510 causes spool surface 1004 to rotate around the spool axis 1002 with respect to the winch housing 510. As shown, in certain non-limiting embodiments the spool may be integrally formed with a spool gear 640.

Figure 6:
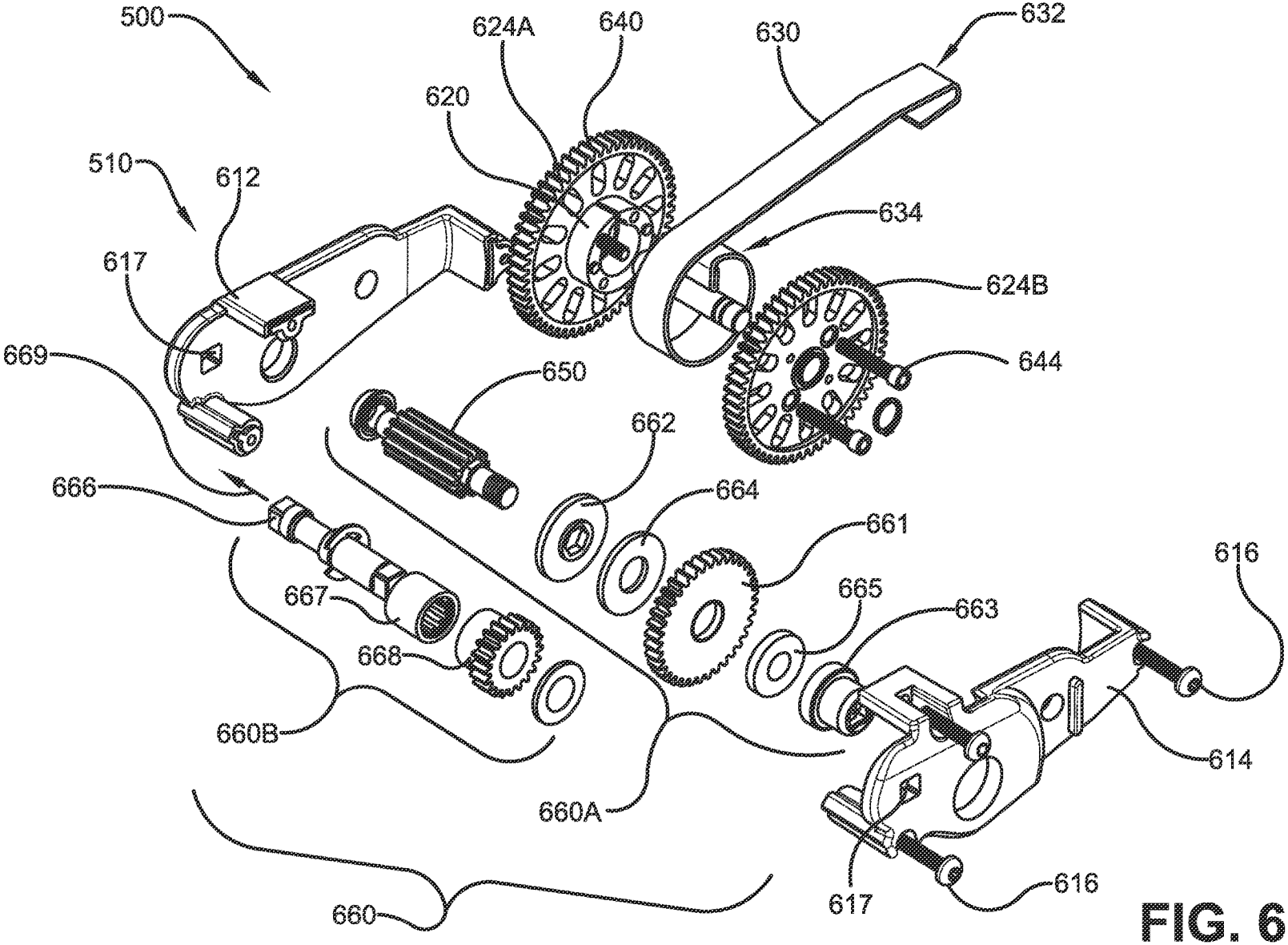
FIG. 6 is an exploded view of the first non-limiting embodiment of a winch assembly.
Figure 7A:
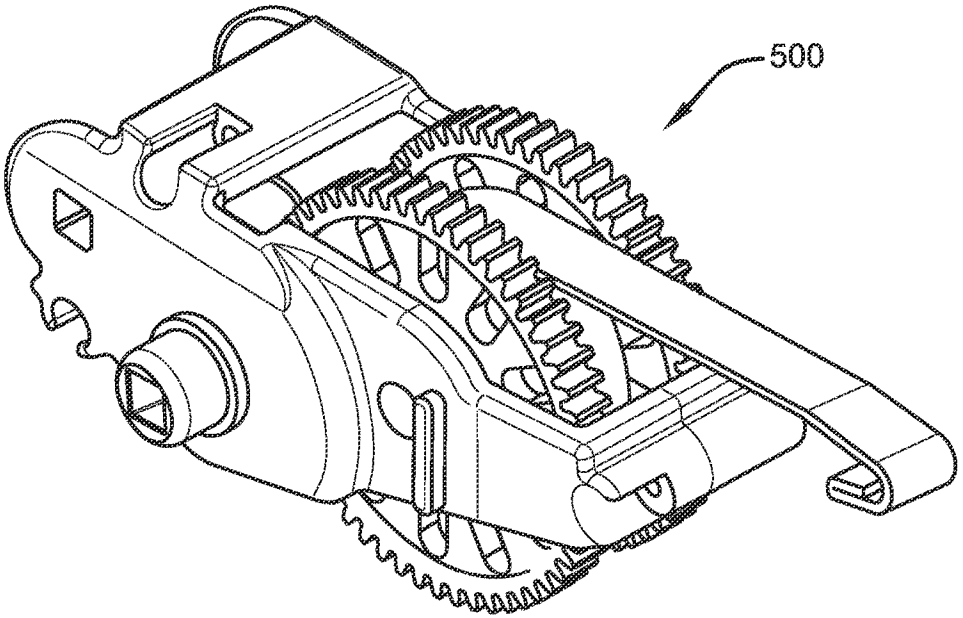
FIG. 7A is a perspective view of the first non-limiting embodiment of a winch assembly.
Figure 7B:
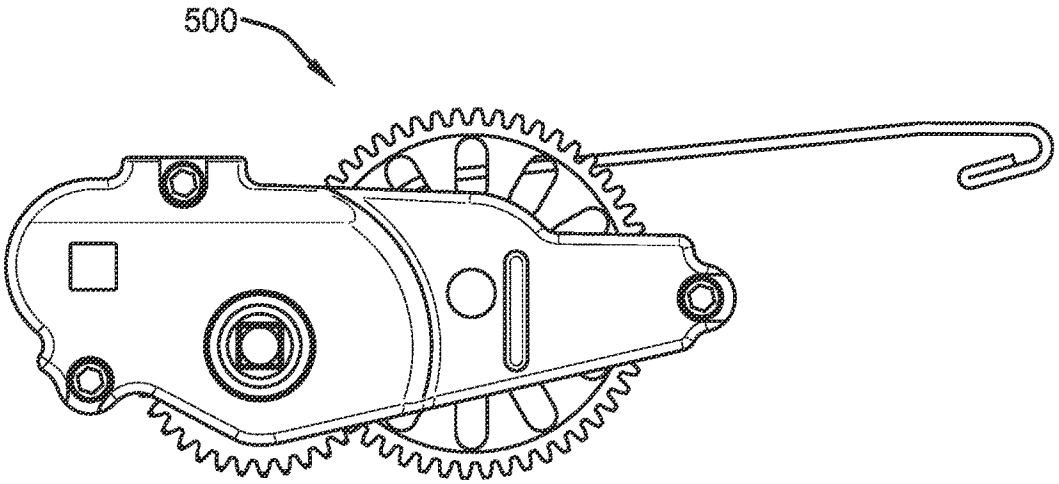
FIG. 7B is a side view of the first non-limiting embodiment of a winch assembly.
Figure 8D:
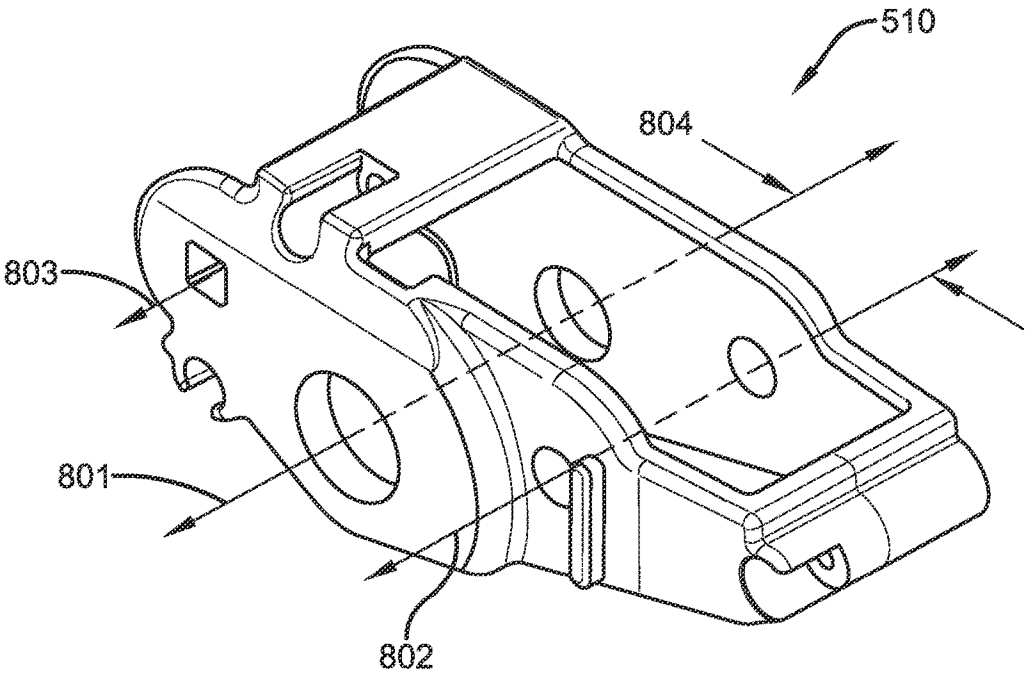
FIG. 8D is a perspective view of the first non-limiting embodiment of a winch housing.
Figure 8C:
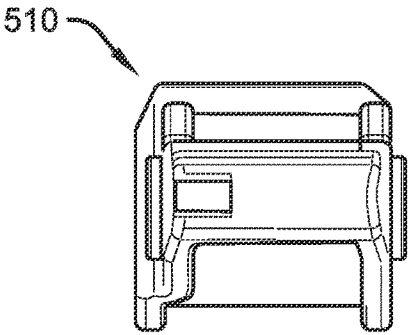
FIG. 8C is a front view of the first non-limiting embodiment of a winch housing.
Figure 8A:
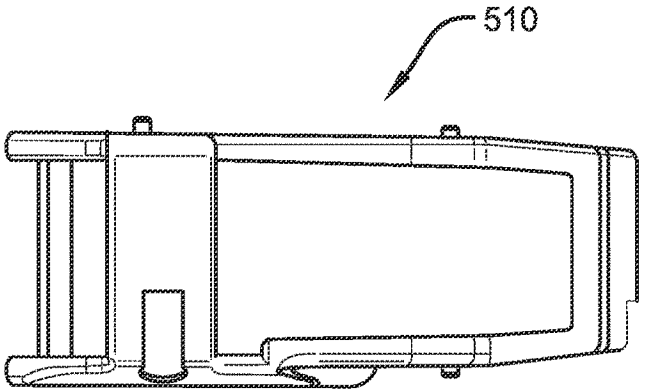
FIG. 8A is a top view of the first non-limiting embodiment of a winch housing.
Figure 8B:
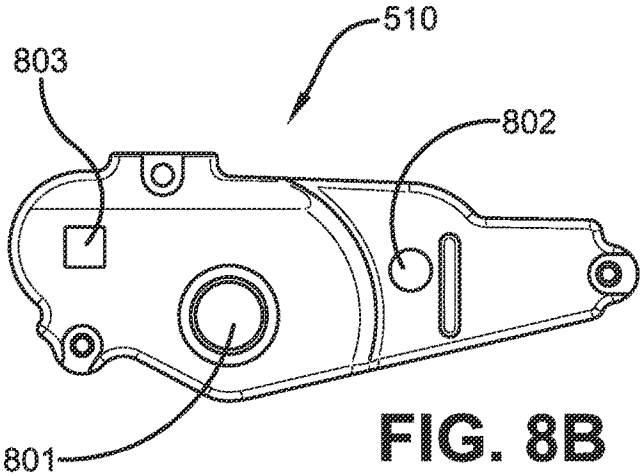
FIG. 8B is a side view of the first non-limiting embodiment of a winch housing.
Figure 9C:
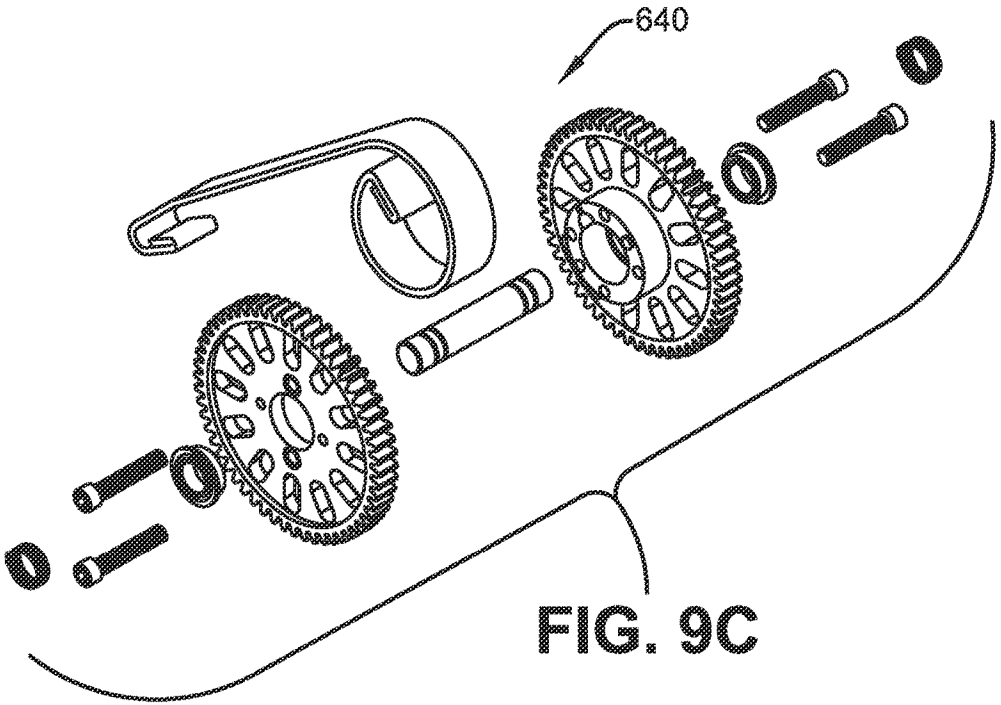
FIG. 9C is an exploded perspective view of a sub-assembly of first non-limiting embodiment of a winch assembly.
Figure 9B:
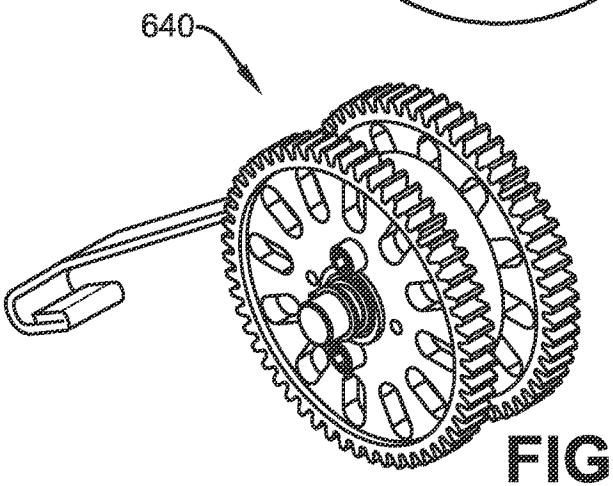
FIG. 9B is a perspective view of a sub-assembly of first non-limiting embodiment of a winch assembly.
Figure 9A:
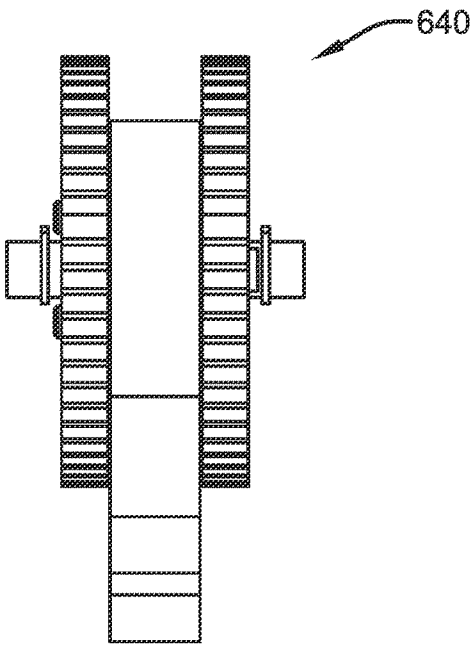
FIG. 9A is a front view of a sub-assembly of first non-limiting embodiment of a winch assembly.
Figure 10C:
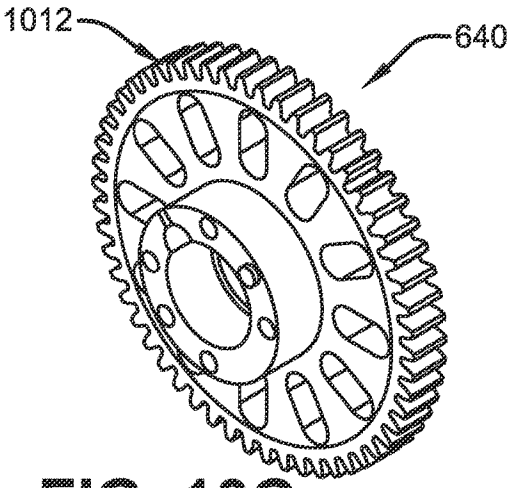
FIG. 10C is a perspective view of a first non-limiting embodiment of a spool gear.
Figure 10E:
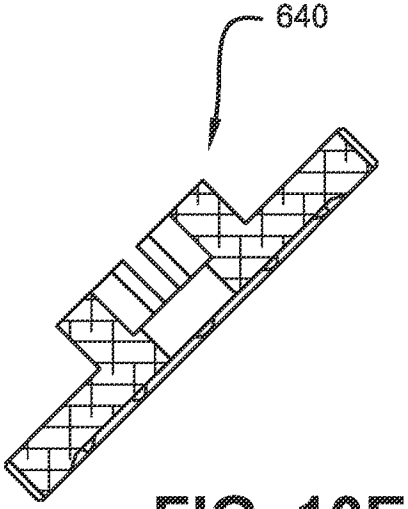
FIG. 10E is sectional view of the first non-limiting embodiment of the spool gear shown in FIG. 10A.
Figure 10B:
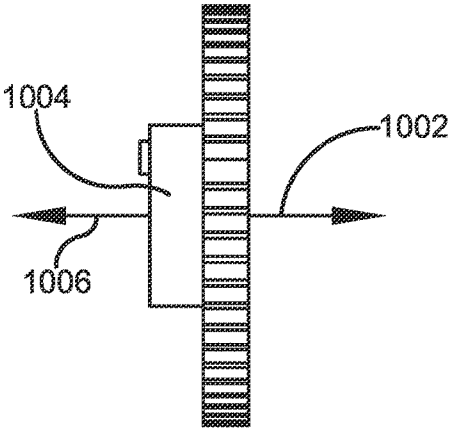
FIG. 10B is a side view of a first non-limiting embodiment of a spool gear.
Figure 10D:
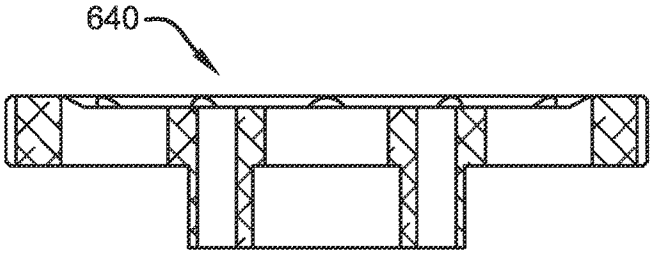
FIG. 10D is a sectional view of the first non-limiting embodiment of the spool gear shown in FIG. 10A.
Figure 10A:
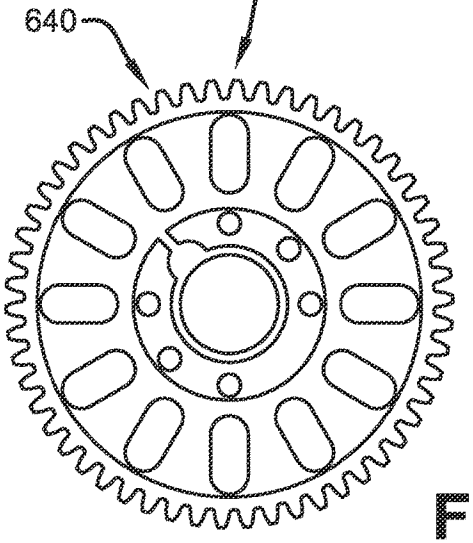
FIG. 10A is a front view of a first non-limiting embodiment of a spool gear.
Figure 11A:
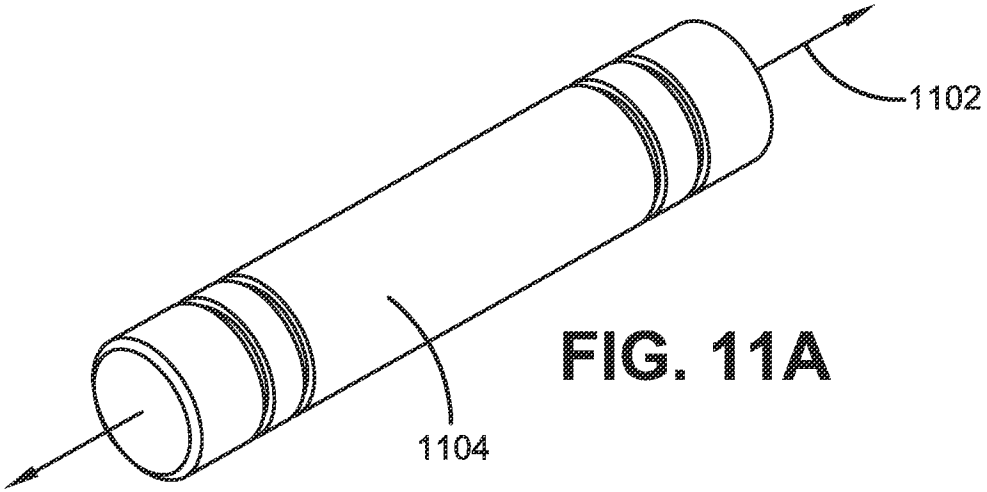
FIG. 11A is a perspective view of a first non-limiting embodiment of a first shaft.
Figure 11B:
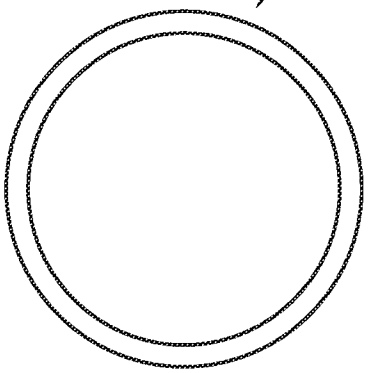
FIG. 11B is a side view of the first non-limiting embodiment of the first shaft.
Figure 11C:
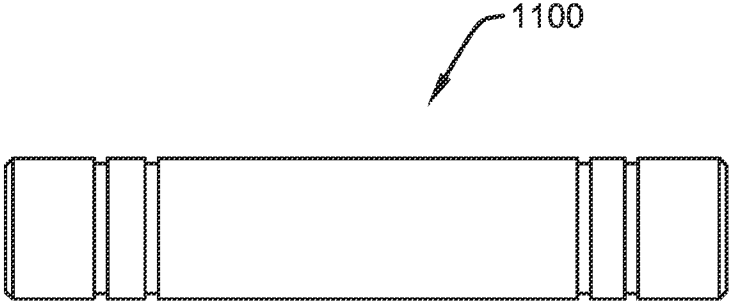
FIG. 11C is a front view of the first non-limiting embodiment of the first shaft.
Figure 12B:
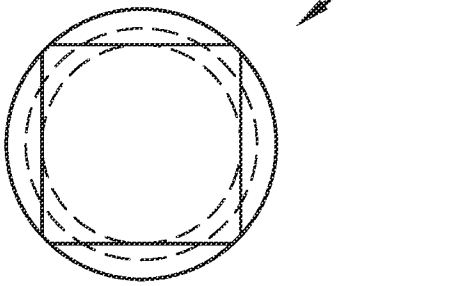
FIG. 12B is a side view of the first non-limiting embodiment of the second shaft.
Figure 12A:
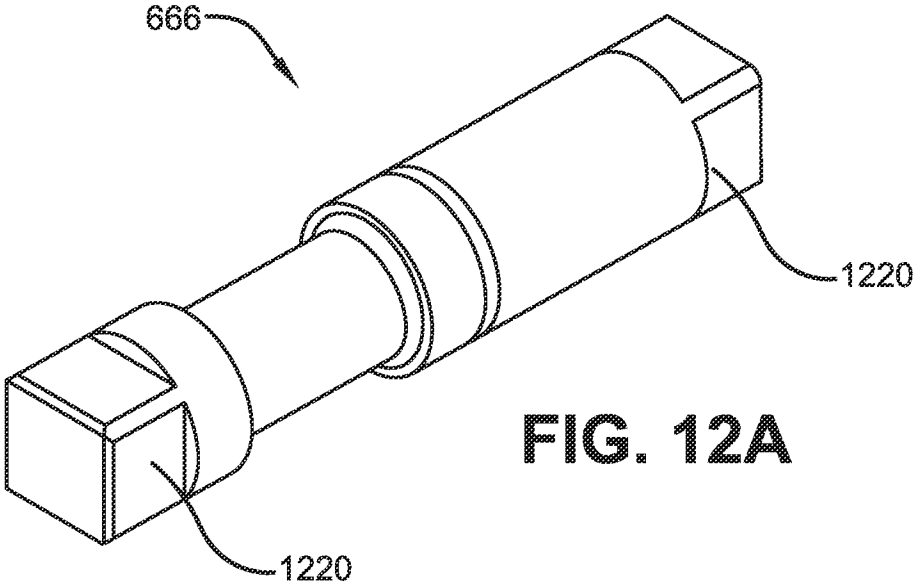
FIG. 12A is a perspective view of a first non-limiting embodiment of a second shaft.
Figure 12C:
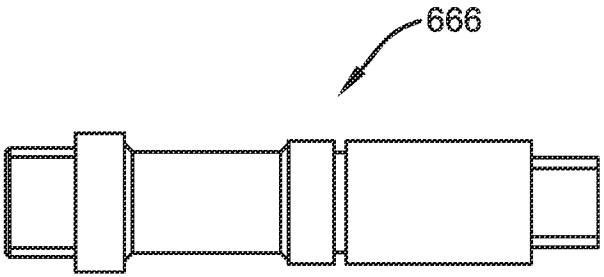
FIG. 12C is a front view of the first non-limiting embodiment of the second shaft.
Figure 13A:
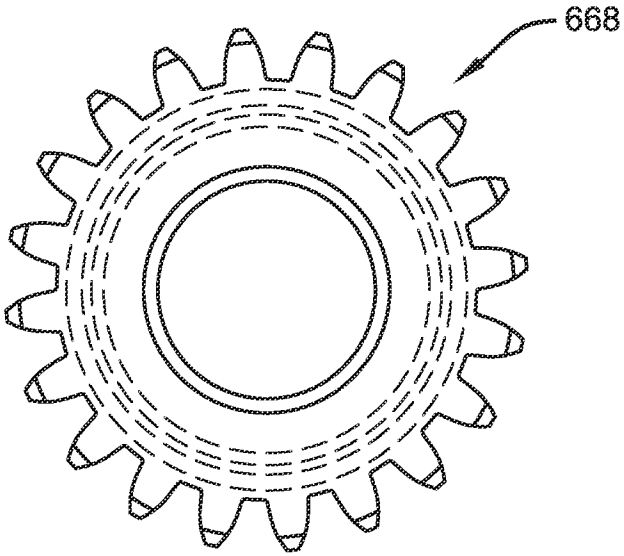
FIG. 13A is a front view of a first non-limiting embodiment of a brake gear.
Figure 13C:
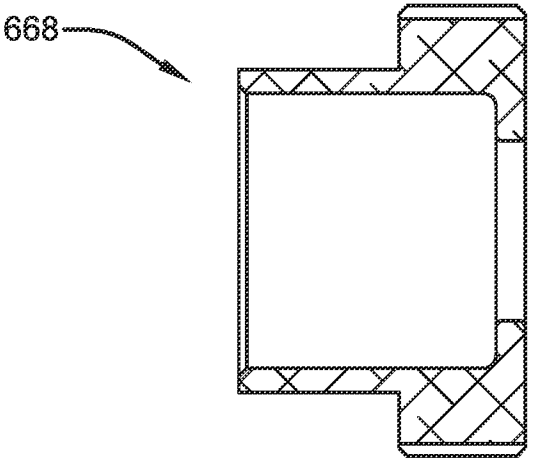
FIG. 13C is sectional view of the first non-limiting embodiment of the brake gear.
Figure 13B:
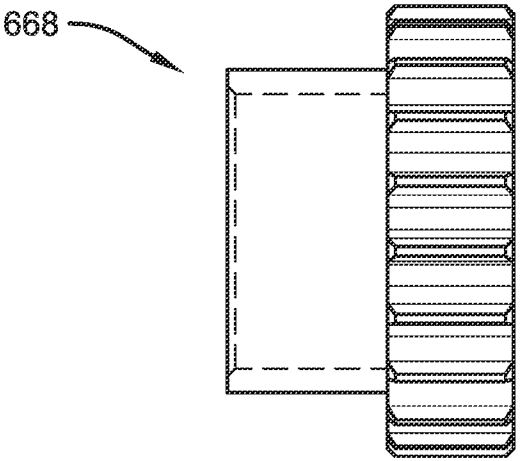
FIG. 13B is a side view of the first non-limiting embodiment of the brake gear.
Figure 14A:
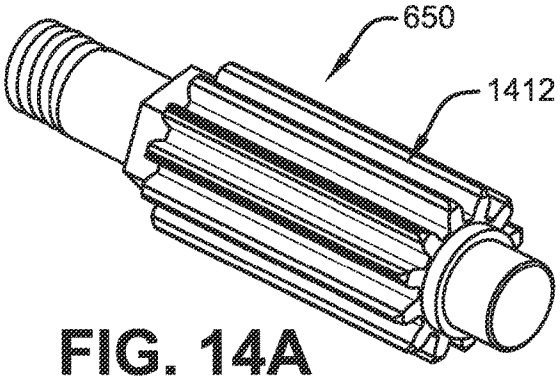
FIG. 14A is a perspective view of a first non-limiting embodiment of a third shaft.
Figure 14C:
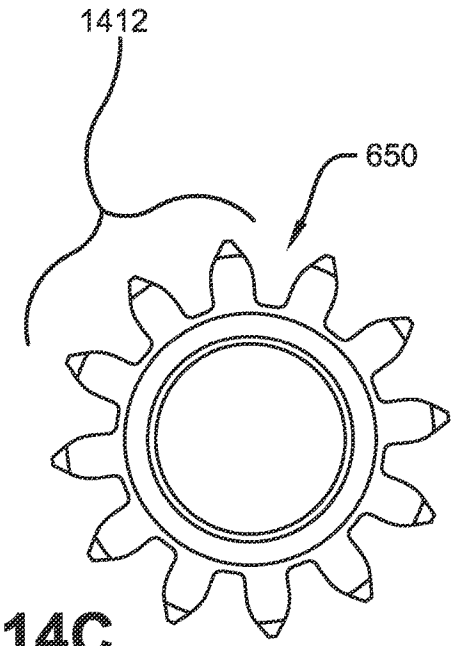
FIG. 14C is a side view of the first non-limiting embodiment of the third shaft.
Figure 14D:
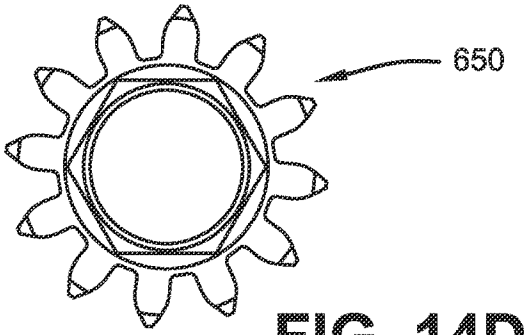
FIG. 14D is a side view of the first non-limiting embodiment of the third shaft.
Figure 14B:
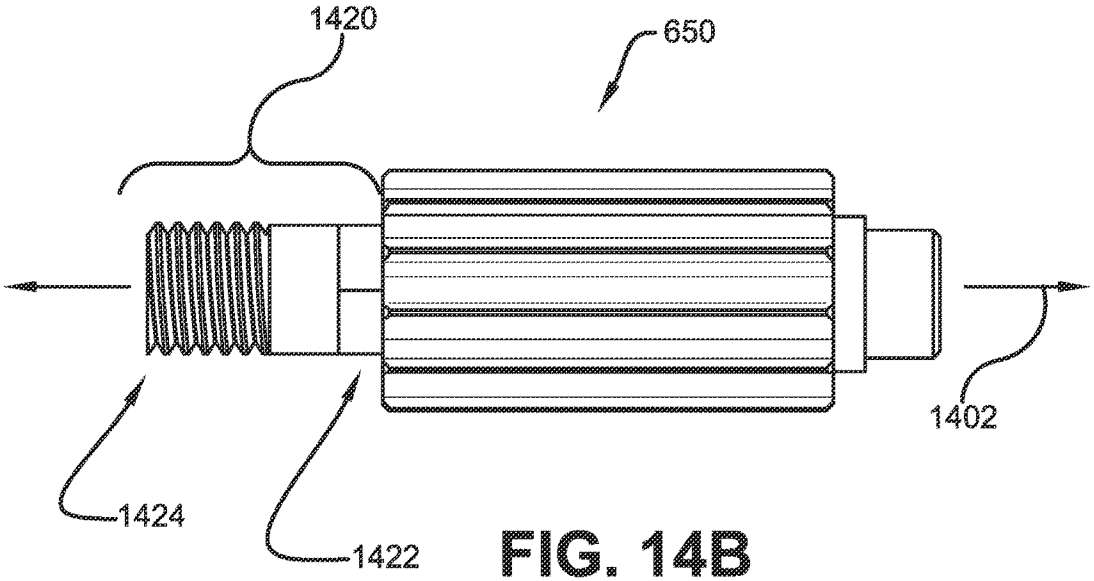
FIG. 14B is a front view of the first non-limiting embodiment of the third shaft.
Figure 15A:
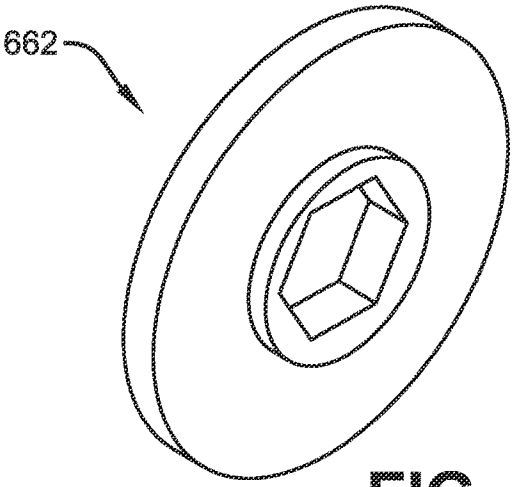
FIG. 15A is a perspective view of a first non-limiting embodiment of a collar.
Figure 15B:
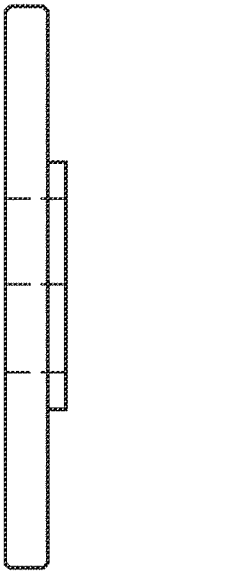
FIG. 15B is a side view of a first non-limiting embodiment of a collar.
Figure 15C:
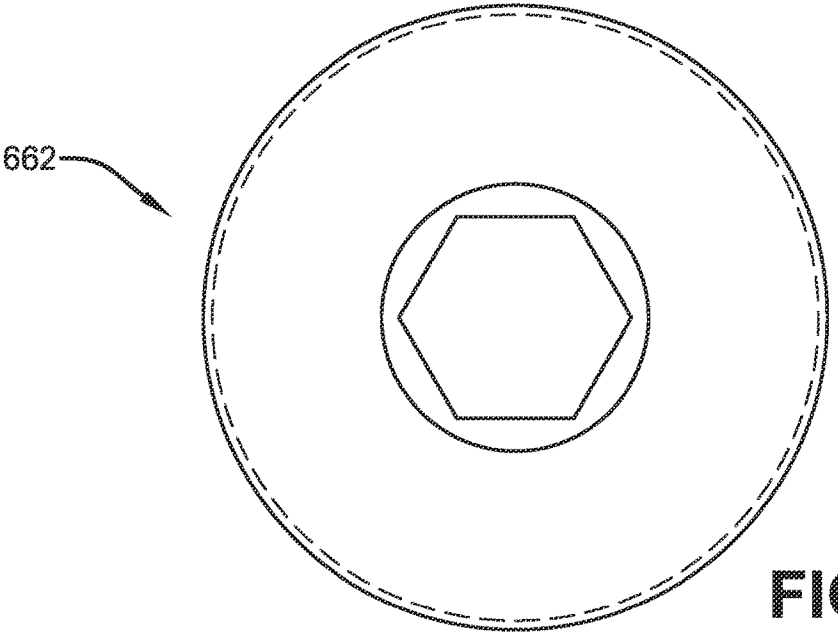
FIG. 15C is a front view of a first non-limiting embodiment of a collar.
Figure 16B:
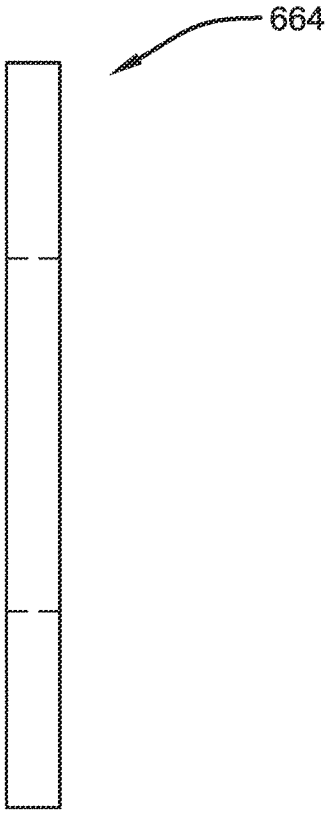
FIG. 16B is a side view of a first non-limiting embodiment of a friction disc.
Figure 16A:
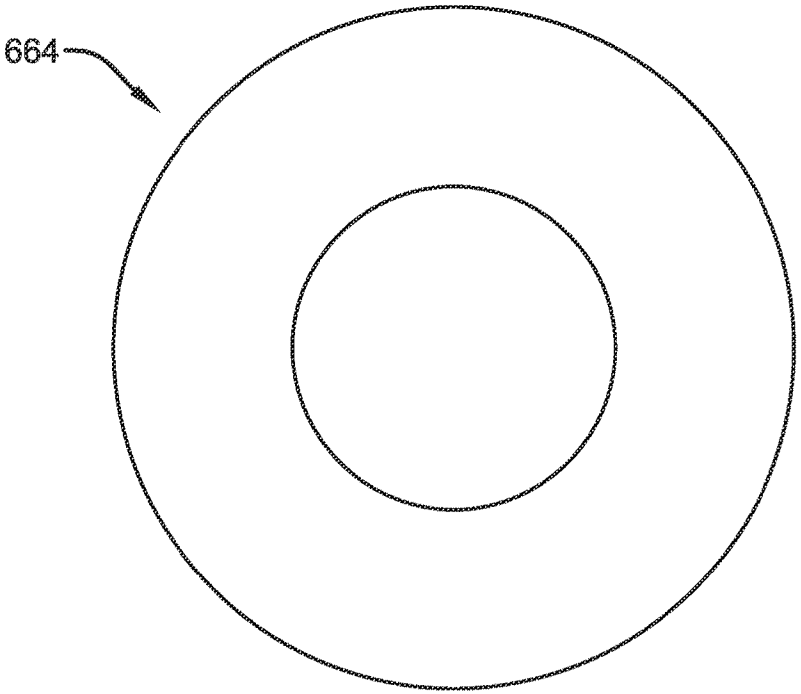
FIG. 16A is a front view of a first non-limiting embodiment of a friction disc.
Figure 17A:
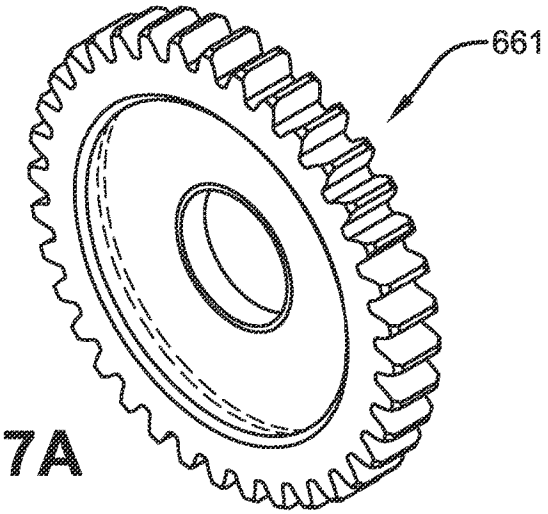
FIG. 17A is a perspective view of a first non-limiting embodiment of a plate gear.
Figure 17C:
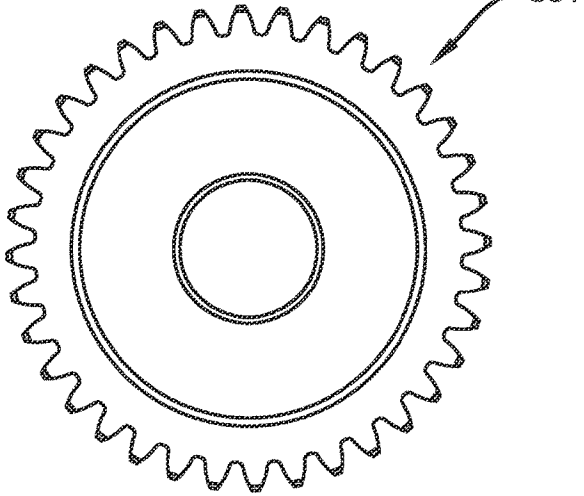
FIG. 17C is a front view of a first non-limiting embodiment of a plate gear.
Figure 17D:
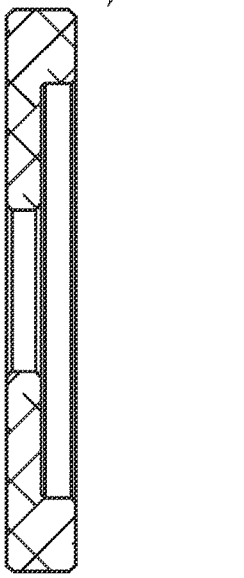
FIG. 17D is a sectional view of a first non-limiting embodiment of a plate gear.
Figure 17B:
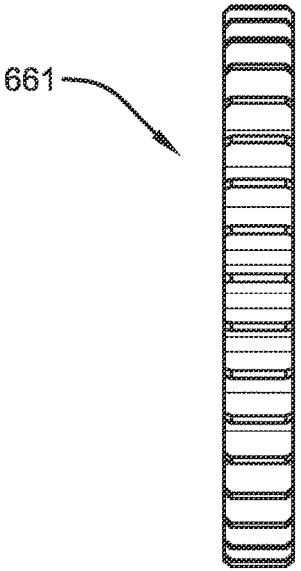
FIG. 17B is a side view of a first non-limiting embodiment of a plate gear.
Figure 18A:
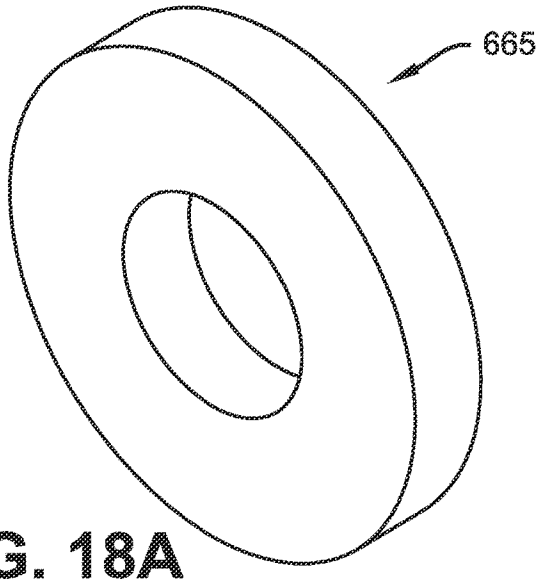
FIG. 18A is a perspective view of a first non-limiting embodiment of a first gear bushing.
Figure 18C:
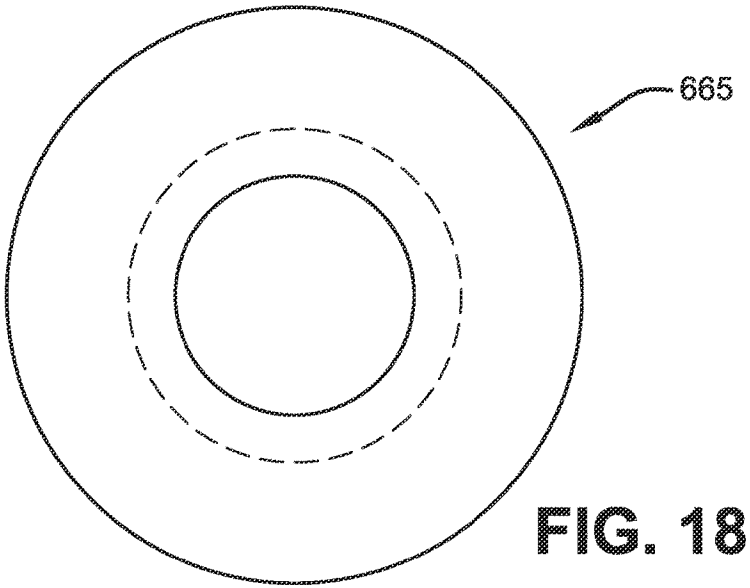
FIG. 18C is a front view of a first non-limiting embodiment of a first gear bushing.
Figure 18B:
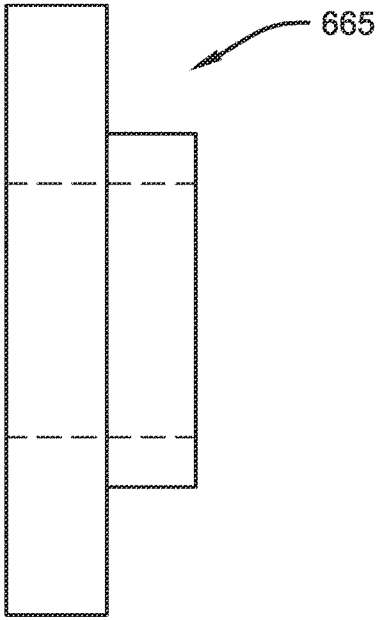
FIG. 18B is a side view of a first non-limiting embodiment of a first gear bushing.
Figure 19A:
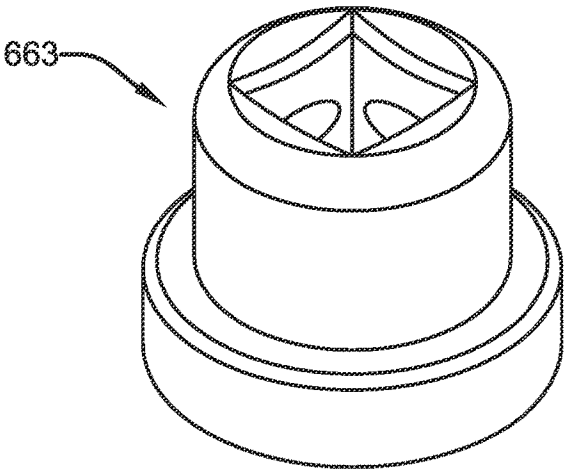
FIG. 19A is a perspective view of a first non-limiting embodiment of a receiver.
Figure 19C:
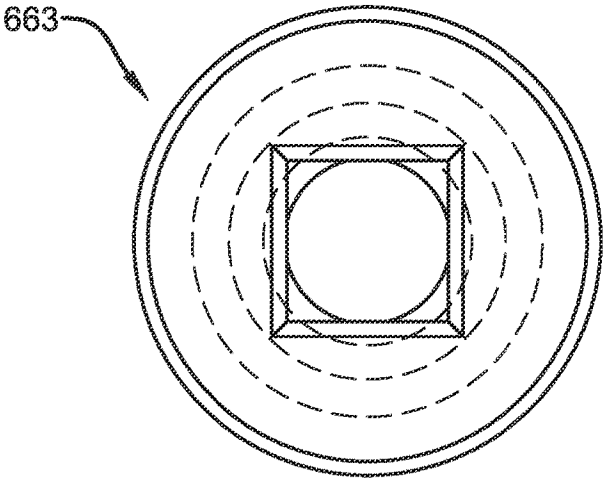
FIG. 19C is a front view of a first non-limiting embodiment of a receiver.
Figure 19B:
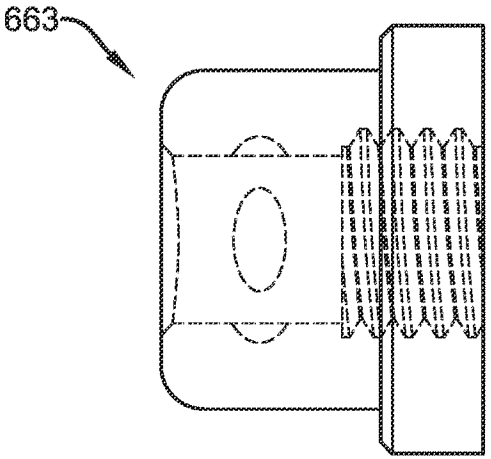
FIG. 19B is a side view of a first non-limiting embodiment of a receiver.
Figure 19D:
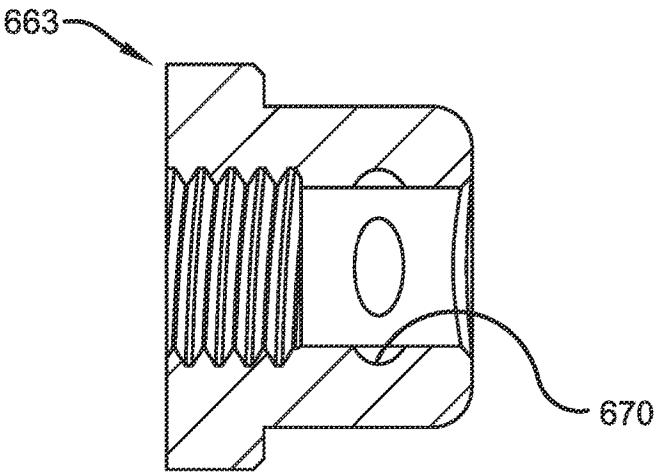
FIG. 19D is a sectional view of a first non-limiting embodiment of a receiver.

With reference now to FIGS. 5-6, the tensile member 630 may be elongated to define a first end of the tensile member 632 and a second end of the tensile member 634 opposite the first end of the tensile member 632. The tensile member 630 may be of such a tensile strength and size that the length of the tensile member 630 is substantially constant under the loads typical to that operation of the winch assembly 500 in cocking or de-cocking a crossbow bowstring. Without limitation, the tensile member 630 may be of such a tensile strength and size that the length of the tensile member 630 changes by less than 1% under the loads typical to that operation of the winch assembly in cocking or de-cocking a crossbow bowstring. The tensile member 630 may be a cable, rope, ribbon, strap, chain or take any other form chosen with sound engineering judgement. The first end of the tensile member 632 may be operationally engaged with the spool 620 such that as the spool 620 is rotated around the spool axis 1002 in one direction the tensile member 630 is wound onto or wrapped around the spool 620 (on the surface 1004). Similarly, the first end of the tensile member 632 may be operationally engaged with the spool 620 such that as the spool 620 is rotated around the spool axis 1002 in the opposite direction the tensile member 630 is unwound from or unwrapped from the spool 620. As the tensile member 630 is wrapped around the spool 620, the first end of the tensile member 632 may be drawn toward the spool 620. As used herein, and unless otherwise noted, to "spool in" is to wrap the tensile member 630 around the spool 620. The tensile member 630 may be unwrapped from around the spool 620 to permit the first end of the tensile member 632 to be drawn away from the spool 620. As used herein, and unless otherwise noted, to "spool out" is to unwrap the tensile member 630 from around the spool 620.

With reference now to FIGS. 5-6 and 8A-11C, spool gear 640 may be a gear adapted to transfer work to and from the spool 620. The spool gear 640 may be operationally engaged with the spool 620 such that the spool gear 640 and the spool 620 rotate in unison. In some embodiments, the spool 620 is fixed to the spool gear 640 so that the spool gear 640 and the spool 620 may transmit work to one another and move in unison such that rotation of the spool gear 640 causes rotation of the spool surface 1004 around the spool axis 1002 with respect to the winch housing 510. In certain non-limiting embodiments, the spool 620 may be fixed to the spool gear 640 by welding, brazing, adhesives, or by being integrally formed therewith. The spool gear 640 may have a spool gear axis 1006. The spool gear axis 1006 is the axis about which the spool gear 640 rotates when in operation. The spool gear 620 may be selectively rotatable around the spool gear axis 1006 with respect to the winch housing 510. The spool gear axis 1006 may be coincident with the spool axis 1002 as shown in the non-limiting embodiment in FIG. 10A-10E. The spool gear axis 1006 may be coincident with the first housing axis 802. The spool gear may include spool gear teeth 1012 adapted for operational engagement with a mating gear, such as, without limitation, drive gear 650. As shown, the spool gear 640 may be a spur gear. In some embodiments, the spool gear 640 may include two gears 642A, 642B that are joined so that they rotate together, such as with mechanical fasteners 644. In this case, the teeth from each gear 642A, 642B may be adapted for operational engagement with drive gear 650. In some non-limiting embodiments, the spool 620 may be positioned between the gears 642A, 642B. The spool gear 640 may be operationally engaged with the winch housing 510 by mounting the spool gear on a shaft 1100. Rotation of the spool gear 640 may cause rotation of the spool 620 around the spool axis 1002 with respect to the winch housing 510. Rotation of the spool 620 around the spool axis 1002 with respect to the winch housing 510 in a spool in direction may cause the first end 632 of the tensile member 630 to be moved selectively toward the spool 620. Rotation of the spool 620 around the spool axis 1002 with respect to the winch housing 510 in a spool out direction may cause the first end 632 of the tensile member 630 to be moved selectively away from the spool 620. Shaft 1100 may define a shaft axis 1102 and a shaft surface 1104.

With reference now to FIGS. 6, 8D, and 14A-14D, drive gear 650 may have a drive gear axis 1402 and drive gear teeth 1412 adapted for operational engagement with the spool gear teeth 1012. The drive gear 650 may be a spur gear. The drive gear axis 1402 may be coincident with the second housing axis 801. The drive gear teeth 1412 may be operationally engaged with the spool gear teeth 1012 such that the drive gear 650 and the spool gear 640 are operationally engaged with one another and may transmit work to one another, such that as one rotates it cause the other operationally engaged gear to rotate. The drive gear 650 may include an axial drive stem 1420. The drive stem 1420 can be considered a drive shaft. The drive stem 1420 is a work input shaft coincident with drive gear axis 1402 and is usable to transmit work to and from the drive gear 650. In some embodiments, the drive stem 1420 may include one or more flats 1422 to aid operable connection to one or more other components, such as and without limitation, collar 662. In some embodiments the drive stem 1420 may include threads 1424 to aid operable connection to one or more other components, such as and without limitation, receiver 663.

The drive stem 1420 and the flats 1422 may be used to operably engage clutch gear assembly 660. A clutch gear assembly may be coaxially engaged with the drive gear.

With reference now to FIGS. 5-6, the clutch gear assembly 660 may be operably engaged with the drive gear 650 to permit free rotation of the drive gear 650 in a first direction of rotation but to permit only damped rotation in a second direction of rotation opposite that of the first direction of rotation. In the non-limiting embodiment shown in FIG. 5 the first direction of rotation 592 is a direction of rotation of the drive gear 650 about axis 801. It should be understood that directly meshing gears operate in opposite directions of rotation, e.g., in the non-limiting embodiment shown in FIG. 5, when drive gear 650 is rotating clockwise (as viewed from the standpoint of a viewer facing the nearest side of the assembly shown in FIG. 5) the directly mating spool gear 640 will rotate in the counterclockwise direction. It should be further understood that when operating to spool in the tensile member, each gear, spool gear 640, drive gear 650, etc., will have a particular direction of operation and, while that direction may differ from one gear to another as to being clockwise or counterclockwise, the direction of each gear during the spool in operation may be called the "spool in direction" for that gear. It should be further understood that when operating to spool out the tensile member, each gear, spool gear 640, drive gear 650, etc., will have a particular direction of operation and, while that direction may differ from one gear to another as to being clockwise or counterclockwise, the direction of each gear during the spool out operation may be called the "spool out direction" for that gear. It should be further understood that the spool in direction will be opposite the spool out direction for any given gear. In certain non-limiting embodiments, the clutch gear assembly 660 may be operably engaged with the drive gear 650 to permit free rotation of the drive gear 650 in a spool in direction 592, but to permit only damped rotation in a spool out direction 594 opposite that of the spool in direction 592.

With reference now to FIGS. 6 and 14-19, the clutch gear assembly 660 may include a first subassembly 660A which has a plate gear 661, which may be a pressure plate gear, sandwiched between a collar 662 and a receiver 663. In some embodiments, in addition to the plate gear 661, the collar 662 and the receiver 663, the subassembly 660A may also sandwich therebetween one or more of a first friction bushing 664 and a second friction bushing 665. In some embodiments, the first subassembly 660A may include drive stem 1420 with collar 662 operationally engaged with the flats 1422 thereof, and receiver 663 operationally engaged with the threads 1424 thereof with the plate gear 661 sandwiched between collar 662 and receiver 663, and, optionally, with the first friction bushing 664 between collar 662 and plate gear 661 and with the second friction bushing 665 between plate gear 661 and receiver 663. Because receiver 663 is threadedly engaged with drive stem 1420, the components between receiver 663 and drive stem 1420 may be compressed together with a compressive load adjustable by changing the amount of threaded engagement between receiver 663 and drive stem 1420. Thus, the receiver 663 can be rotated: in a first receiver direction with respect to the drive shaft to operatively engage the clutch gear assembly 660 to the drive gear 650; and in a second receiver direction with respect to the drive shaft, opposite the first receiver direction, to operatively disengage the clutch gear assembly 660 from the drive gear 650.

With continuing reference to FIGS. 6 and 14-19, it should be understood that the first subassembly 660A provides for engagement between collar 662 and the drive gear 650 which is fixed about drive gear axis 1402 but which permits plate gear 661 to rotate about drive gear axis 1402 in loading situations in which work applied to plate gear 661 is sufficient to overcome the limited and adjustable frictional forces which otherwise would hold plate gear 661 fixed about drive gear axis 1402. These latter frictional forces otherwise holding plate gear 661 fixed about drive gear axis 1402, and which may be overcome as noted above, may provide a damping load which will be further described herebelow. It should be understood that the above described assembly of the plate gear 661, first friction bushing 664, and the collar 662 may be described as or understood as a friction plate clutch.

With reference now to FIGS. 6, 8D, 12-13, 19 and 21, the clutch gear assembly 660 may include a second subassembly 660B which has brake gear 668 which is free to rotate in a first direction but does rotate in a second direction opposite the first direction. In one embodiment, second subassembly 660B includes: a brake gear shaft 666 mounted to the winch housing 510 such that brake shaft axis 669 is coincident with third housing axis 803 and such that the brake gear shaft 666 is not free to rotate with respect to the winch housing 510; a one way bearing 667 operably engaged with brake gear shaft 666; and brake gear 668 engaged with the bearing 667 such that the brake gear shaft 666 is fixed to the one way bearing 667 such that it may only rotate in unison with the one way bearing 667. The one way bearing 667 is free to rotate about the brake gear shaft 666 in the spool in direction, but does rotate about the brake gear shaft 666 in the direction opposite the spool in direction. Because the brake gear 668 is engaged with the bearing 667, it is similarly free to rotate about the brake gear shaft 666 in the spool in direction, but does rotate about the brake gear shaft 666 in the direction opposite the spool in direction. In some embodiments, flats 1220 on the brake shaft 666 may engage with corresponding flats 617 in the winch housing 510 to prevent or impede rotation of the brake shaft 666 with respect to the winch housing 510.

With reference now to FIGS. 5-6, the second subassembly 660B may be assembled in the winch assembly 500 such that brake gear 668 meshes with and operationally engages with plate gear 661. This operational engagement between the brake gear 668 and the plate gear 661 results in plate gear 661 being free to rotate about second housing axis 801 in the spool in direction, but being locked by the engaged brake gear 668 from rotating in the direction opposite the spool in direction. When the winch assembly 500 is operated in the spool in direction: first subassembly 660A and the components thereof rotate in unison; the spool gear 640 is meshed with the drive gear 650; the spool gear 640 and spool 620 rotate in unison with one another to spool in the tensile member 630; the brake gear 668 is meshed with the plate gear 661; and the brake gear 668 rotates freely. When the winch assembly 500 is operated in the spool out direction: the plate gear 661 does not rotate about second housing axis 801 and does not move in unison with respect to collar 662 because it is held from rotating in the direction opposite the spool in direction by the engagement with brake gear 668 as described above; the collar 662 and the drive gear 650 may rotate in unison around second housing axis 801, but because of friction between collar 662 and plate gear 661, the rotation of the collar 662 and the drive gear 650 is damped by the aforementioned friction; the spool gear 640 is meshed with the drive gear 650 and is similarly damped;

the spool gear 640 and spool 620 rotate in unison with one another to spool out the tensile member 630 under damped conditions.

With reference now to FIGS. 1 and 5-6, the result of the damped rotation conditions described above is that the tensile member 630 spools out slowly even when subjected to the kind of loading typical to de-cocking the bowstring of a crossbow. Here, "spools out slowly" should be interpreted to mean slow enough that the speeds, accelerations, and forces involved are low enough that they are not sufficient to harm an associated crossbow. When a cocked bowstring is engaged with tensile member 630 and both are released from the cocked position, the damping action removes energy from the cocked crossbow bowstring which could otherwise harm the crossbow and allowing it to de-cock in a controlled and safe manner. It should be understood from the foregoing that the release under the damping action can also be referred to as operation under or subject to a damping load. Thus, when the rotation of the clutch gear assembly is rotated subject to a damping load, the drive gear is subject to the same damping load, the operationally engaged spool gear rotates subject to a damping load, the operationally engaged spool surface rotates subject to a damping load, and the operationally engaged tensile member moves subject to a damping load. The winch assembly 500 is useful in de-cocking a crossbow in a controlled and safe manner. The trigger mechanism 200 is also useful in de-cocking a crossbow in a controlled and safe manner. A crossbow including both trigger mechanism 200 and winch assembly 500 as well as a method of using both in conjunction with one another is provided hereby.

Figure 20:
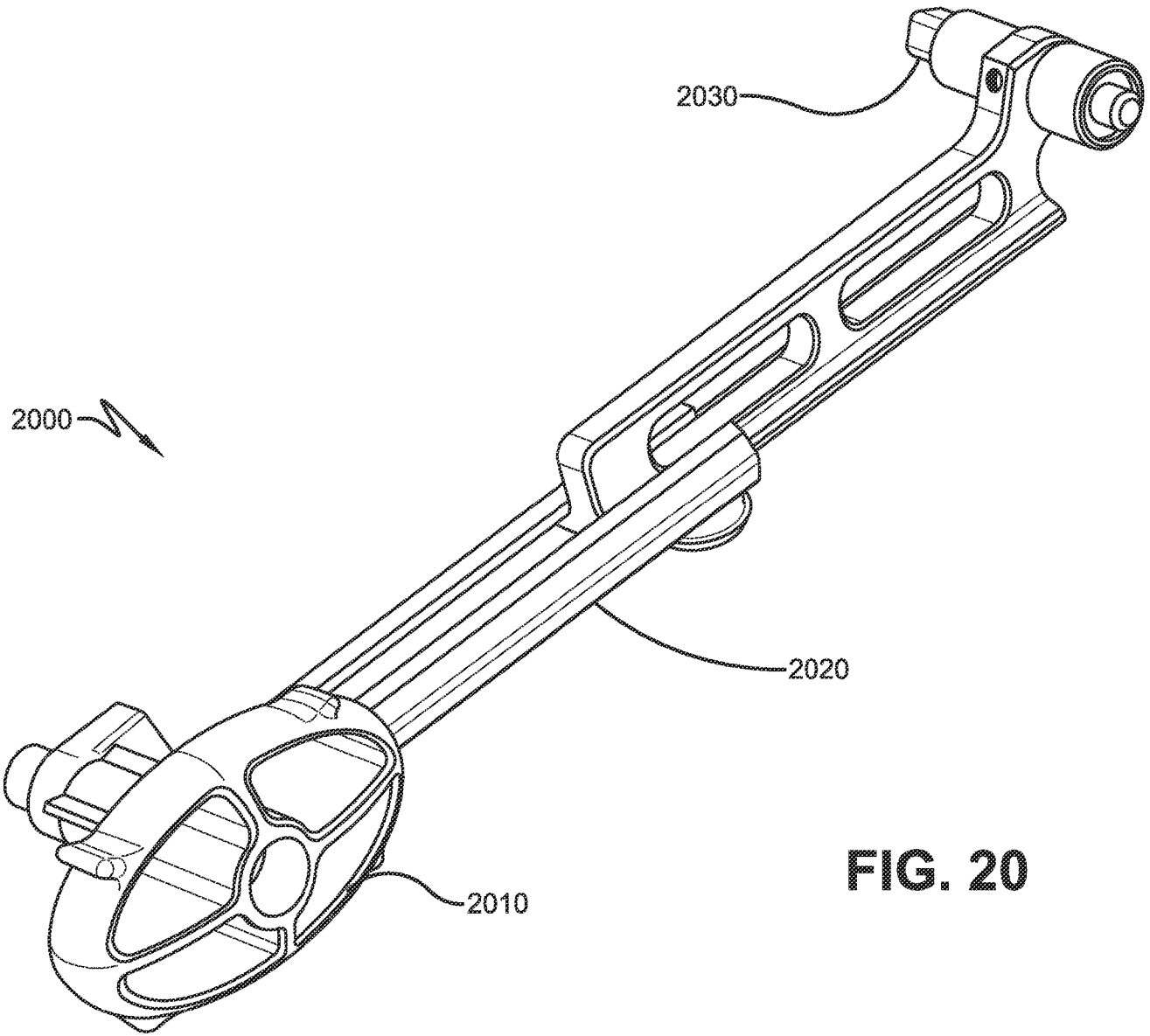
FIG. 20 is a perspective view of a first non-limiting embodiment of a crank handle.
Figure 21B:
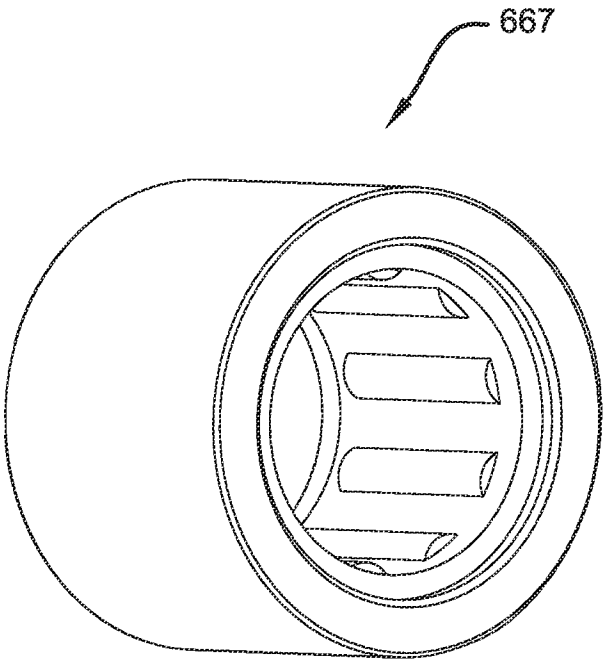
FIG. 21B is a perspective view of the one way bearing of FIG. 21A from the opposite end.
Figure 21A:
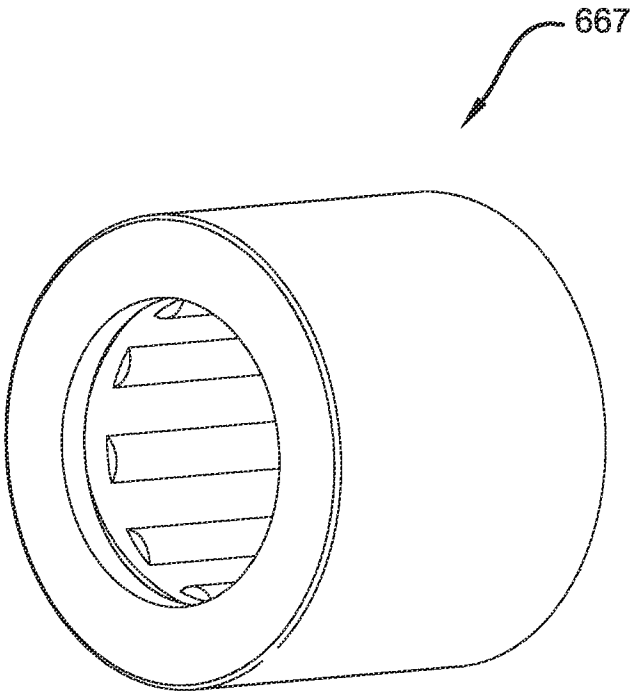
FIG. 21A is a perspective view of a one way bearing.

With reference now to FIGS. 5 and 19-20, in some embodiments a crank handle 2000 may be used to input work to the winch assembly 500. The non-limiting embodiment of a crank handle shown in FIG. 20 has a grip 2010 and a drive connection 2030 engaged with one another by an elongated lever 2020. The drive connection 2030 may be a square drive or other drive connection chosen with good engineering judgment. The drive connection 2030 may include a ball adapted to engage a detent in a part adapted to mate therewith such as, without limitation, detent 670 in the receiver 663, FIG. 19D.

Figure 22:
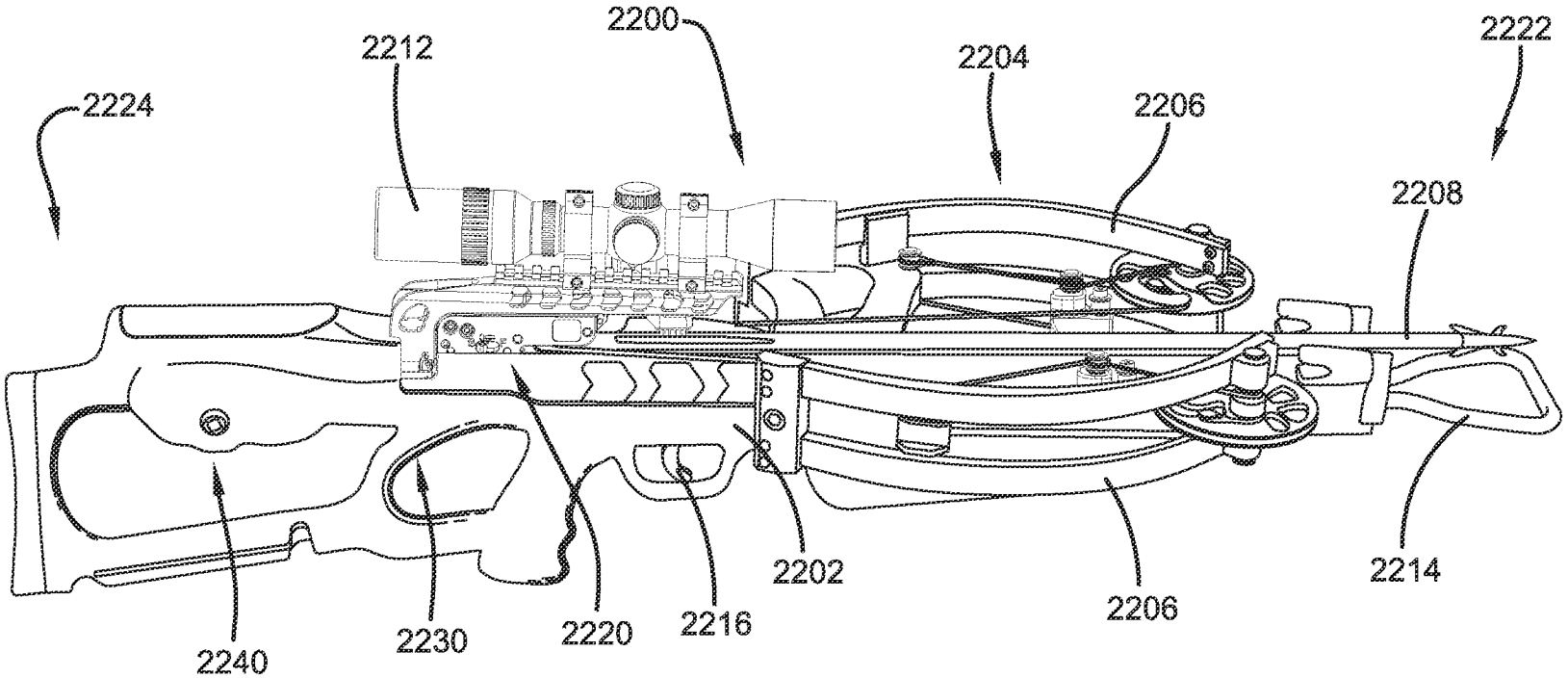
FIG. 22 is a perspective side view of a crossbow according to some embodiments of this disclosure.
Figure 23:
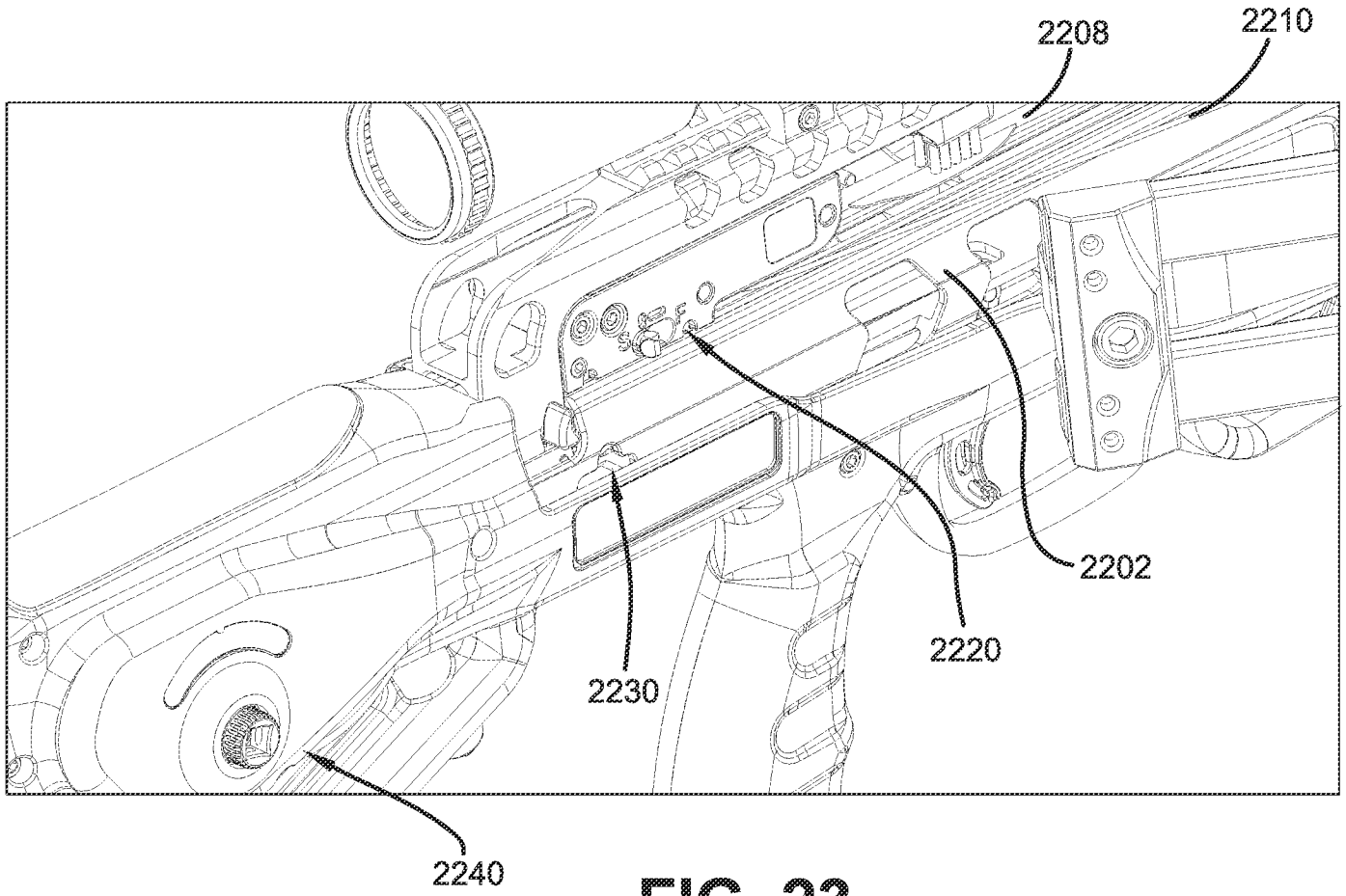
FIG. 23 is a close-up view of a portion of the crossbow shown in FIG. 22.
Figure 24:
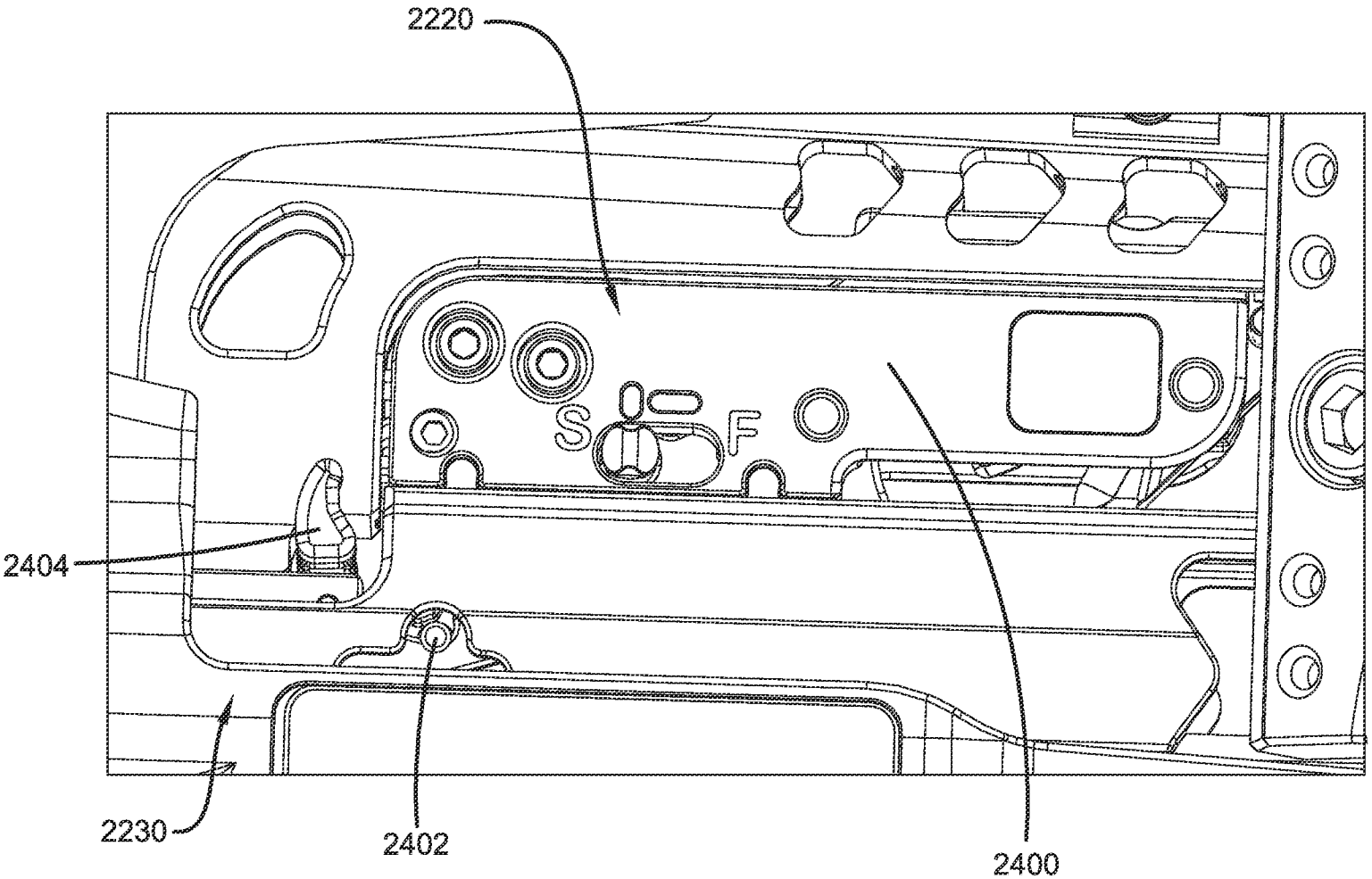
FIG. 24 is a close-up view of a portion of the crossbow shown in FIG. 22.
Figure 25:
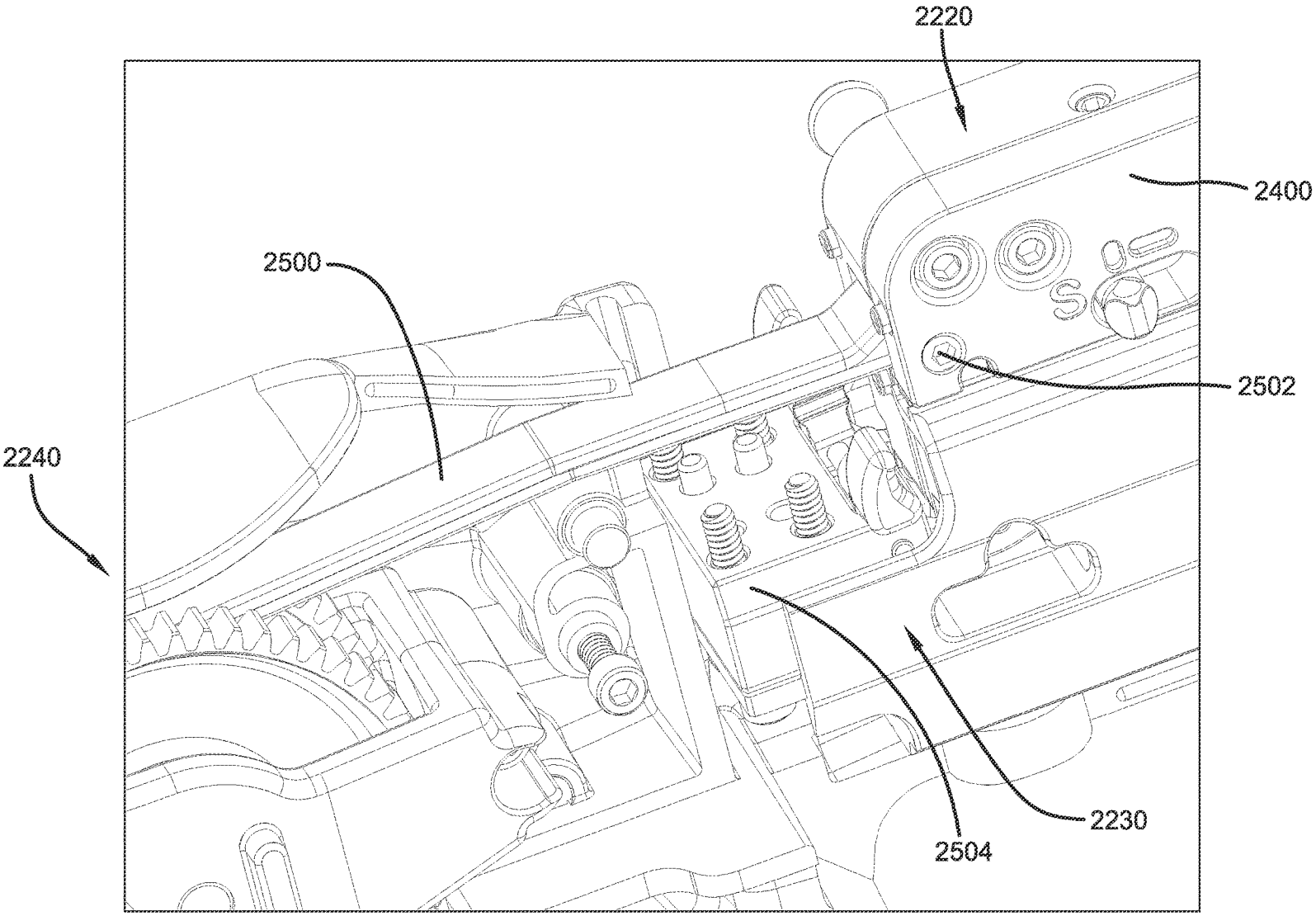
FIG. 25 is a close-up view of a portion of the crossbow shown in FIG. 22 with some parts removed for clarity.

FIGS. 22-23 show a crossbow 2200 according to some embodiments of the present subject matter. While the crossbow 2200 shown uses a reverse draw compound bow, it should be understood that this invention will work well with any type of crossbow chosen with sound judgment by a person of ordinary skill in the art. Because crossbow 2200 is similar to previously described crossbow 10, the differences between them will be the primary focus of this description. The crossbow 2200 may have a longitudinally extending main beam 2202 with a distal end 2222 and a proximal end 2224. The crossbow 2200 may have a bow mechanism 2204 supported to the main beam 2202 and including a pair of outwardly extending bow limbs 2206, 2206 extending transversely from opposite lateral sides of the main beam 2202 and a bowstring 2210 operatively engaged to the outwardly extending bow limbs 2206, 2206 and movable between: an un-cocked position; and a cocked position. FIGS. 22-23 show the bowstring 2210 in a cocked position with an arrow 2208 positioned on the main beam 2202. Other crossbow components may be optionally used such as a scope 2212 and a foot stirrup 2214.

With continuing reference to FIGS. 22-23, the crossbow 2200 may include a trigger mechanism 2220, a trigger latch mechanism 2230 and a winch assembly 2240. These three mechanisms, in some embodiments, combine to operate as a cocking mechanism. In some embodiments, these three mechanisms combine to operate as a de-cocking mechanism. In yet other embodiments, they combine to operate as both a cocking mechanism and a de-cocking mechanism. These mechanisms will be discussed in more detail below.

With reference now to FIGS. 22-29, the trigger mechanism 2220 may be operable to hold the bowstring 2210 in the cocked position and to release the bowstring 2210 to fire the crossbow 2200. The trigger mechanism 2220 may include a trigger housing 2400 that is selectively movable along the main beam 2200 to transport the bowstring 2210. As discussed further below, this movement may be proximally in some embodiments and distally in some embodiments. This movement may be enhanced with the use of at least one rail 2700 upon which the trigger mechanism 2220 slides along the main beam 2202 as it transports the bowstring 2210. For the embodiments shown, there is one rail 2700 on one lateral side of the trigger mechanism 2200 and another rail 2700 on the opposite lateral side. This movement along the main beam 2200 may also be enhanced with one or more rollers 2602 supported to the trigger housing 2400 and rotatable with respect to the trigger housing 2400. For the embodiments shown, two rollers 2602 are used and positioned on opposite lateral sides of the trigger housing 2400. The rollers 2602 engage corresponding surfaces on the main beam 2200 and provide reduced friction between the trigger mechanism 2220 and the main beam 2200.

Figure 26:
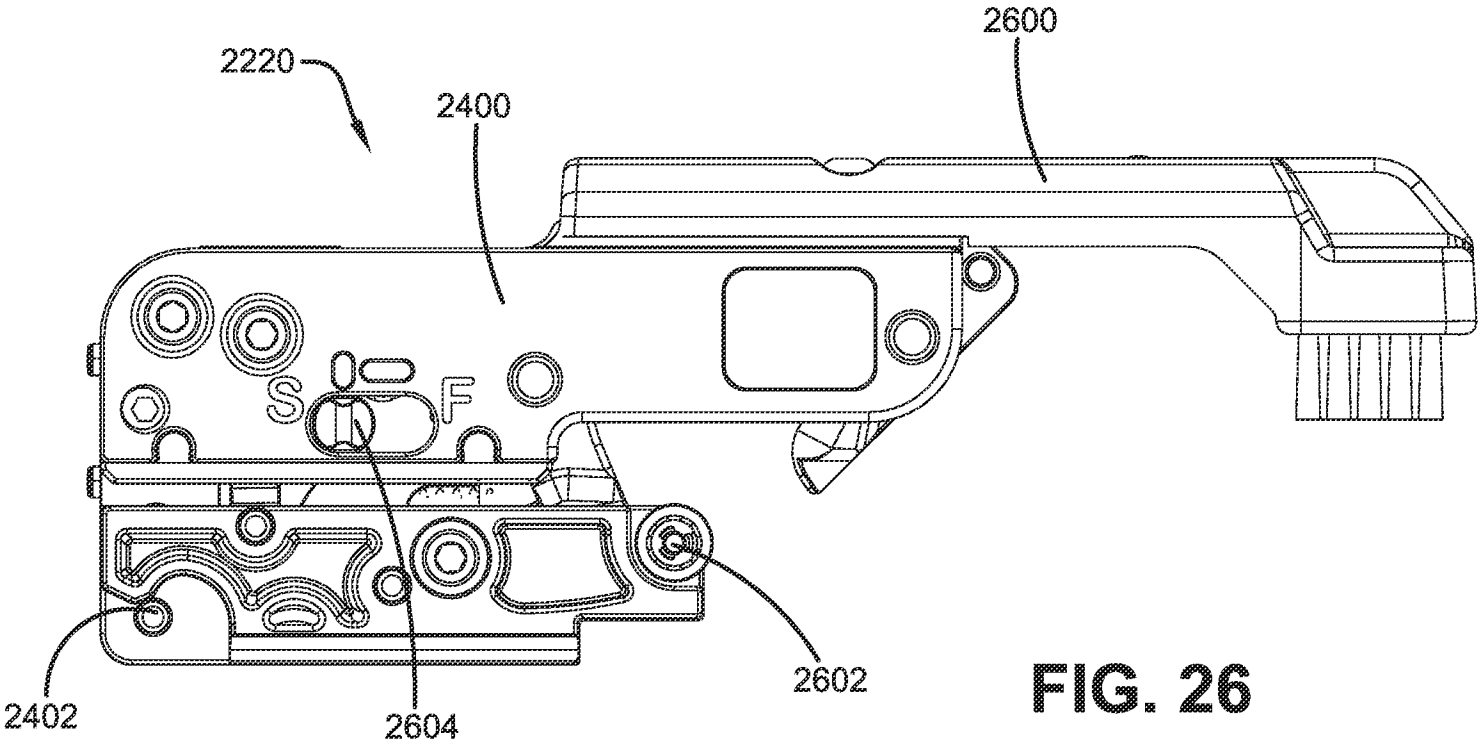
FIG. 26 is a side view of a trigger mechanism according to some embodiments of this disclosure.
Figure 27:
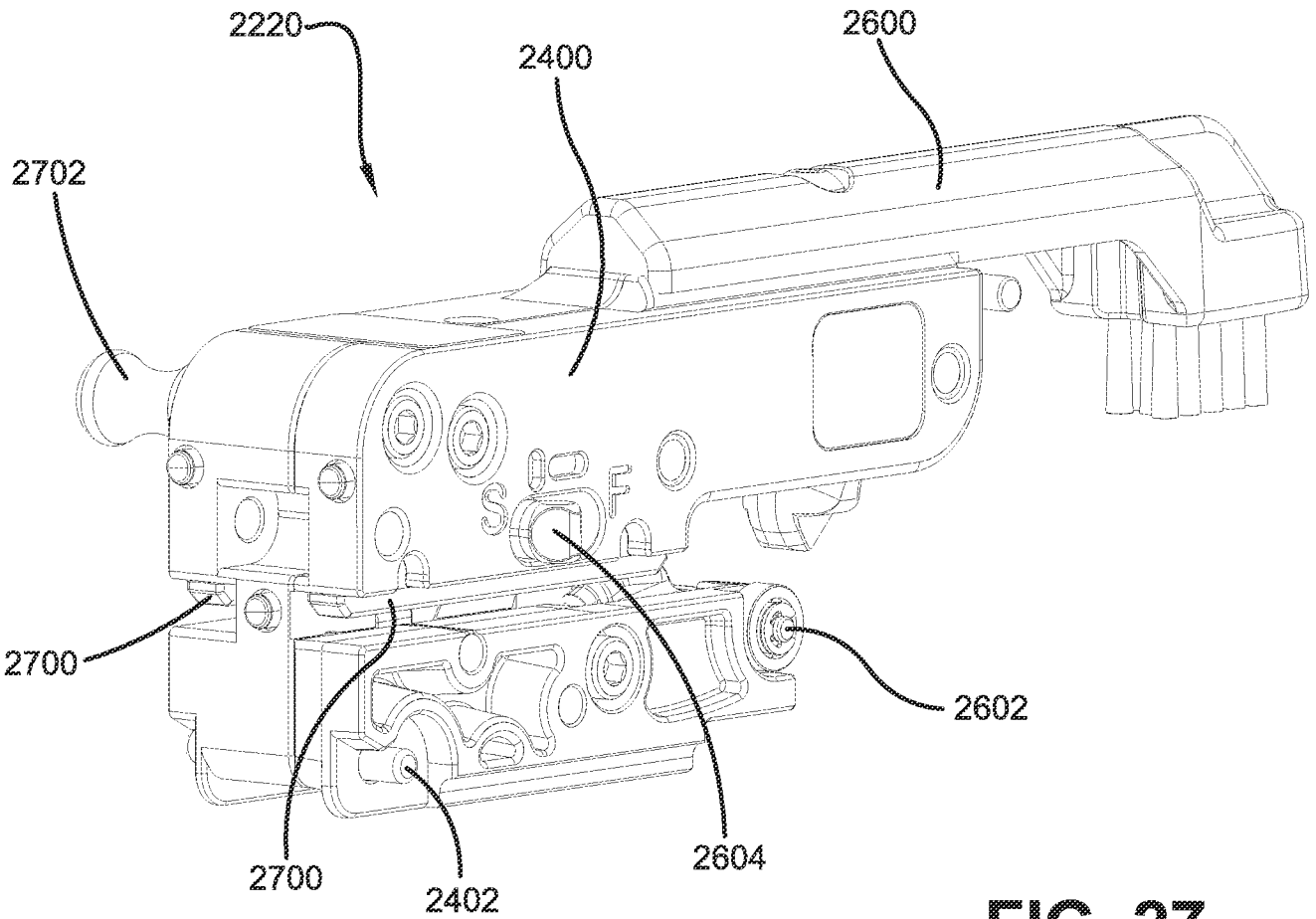
FIG. 27 is a back right side perspective view of the trigger mechanism shown in FIG. 26.
Figure 28:
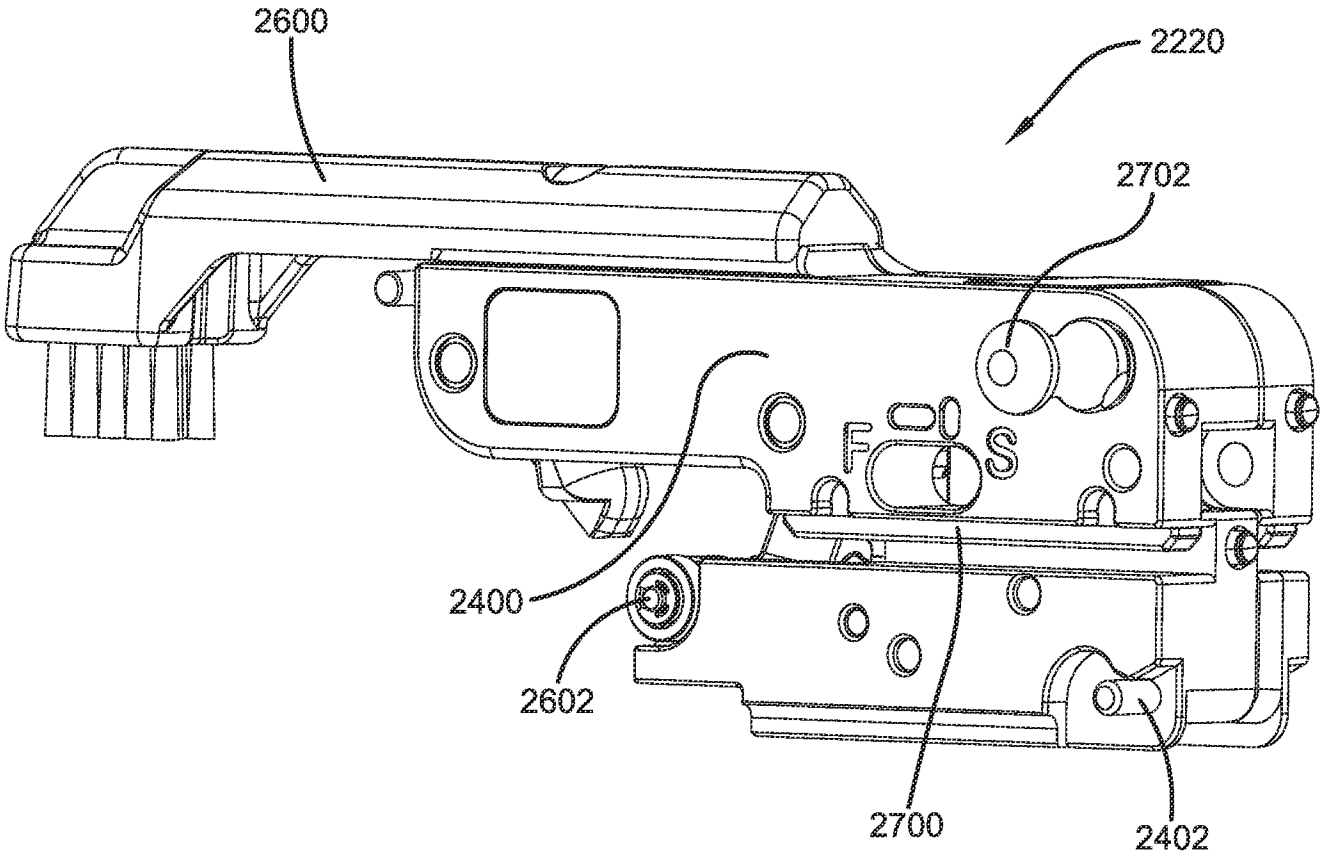
FIG. 28 is a back left side perspective view of the trigger mechanism shown in FIG. 26.

With reference now to FIGS. 25-28, a tensile member 2500, discussed further below, may be engaged with the trigger housing 2400. For the embodiments shown, this engagement is the attachment of the tensile member 2500 to the trigger housing 2400. In one specific embodiment, the tensile member 2500 may be attached to a laterally extending cylindrical pin 2502 that is supported to the trigger housing 2400. A trigger surface 2402, supported to the trigger housing 2400, may be selectively engaged by the trigger latch mechanism 2230 as discussed further below. The trigger surface 2402 may be of any design chosen with sound engineering judgement. For the embodiments shown, the trigger surface 2402 may be a cylindrical pin that extends from both lateral sides of the trigger housing 2400, as shown in FIGS. 27-28. The trigger surface 2402 may be a convex shape, as shown. An arrow retention brush 2600 may be supported to the trigger housing 2400 and used to retain an arrow (such as arrow 2208 shown in FIG. 23) in a known manner. Knob 2702 may be supported to the trigger housing 2400 and used for purposes discussed below.

Figure 29:
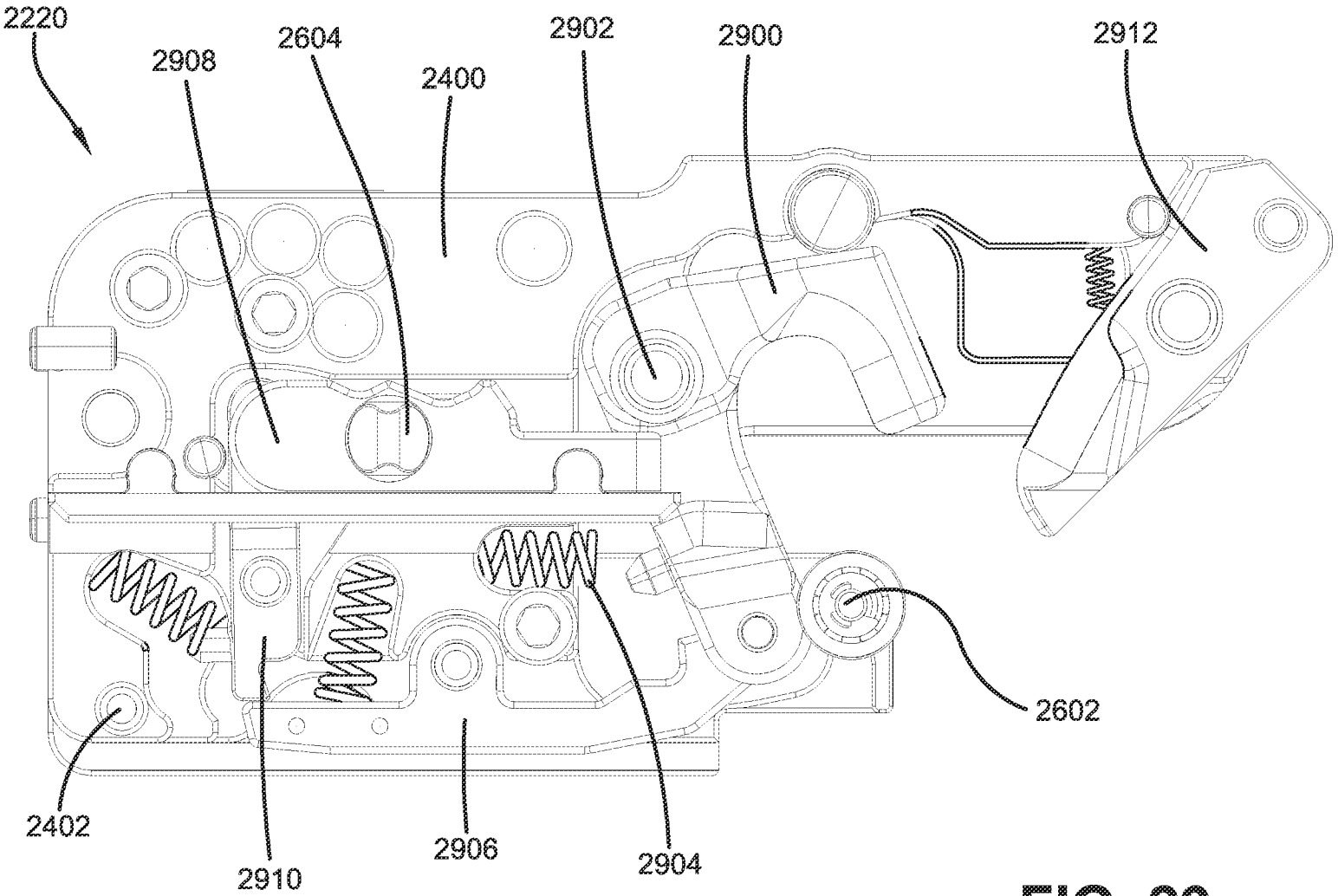
FIG. 29 is a side view of the trigger mechanism shown in FIG. 26 with some parts removed for clarity.
Figure 30:
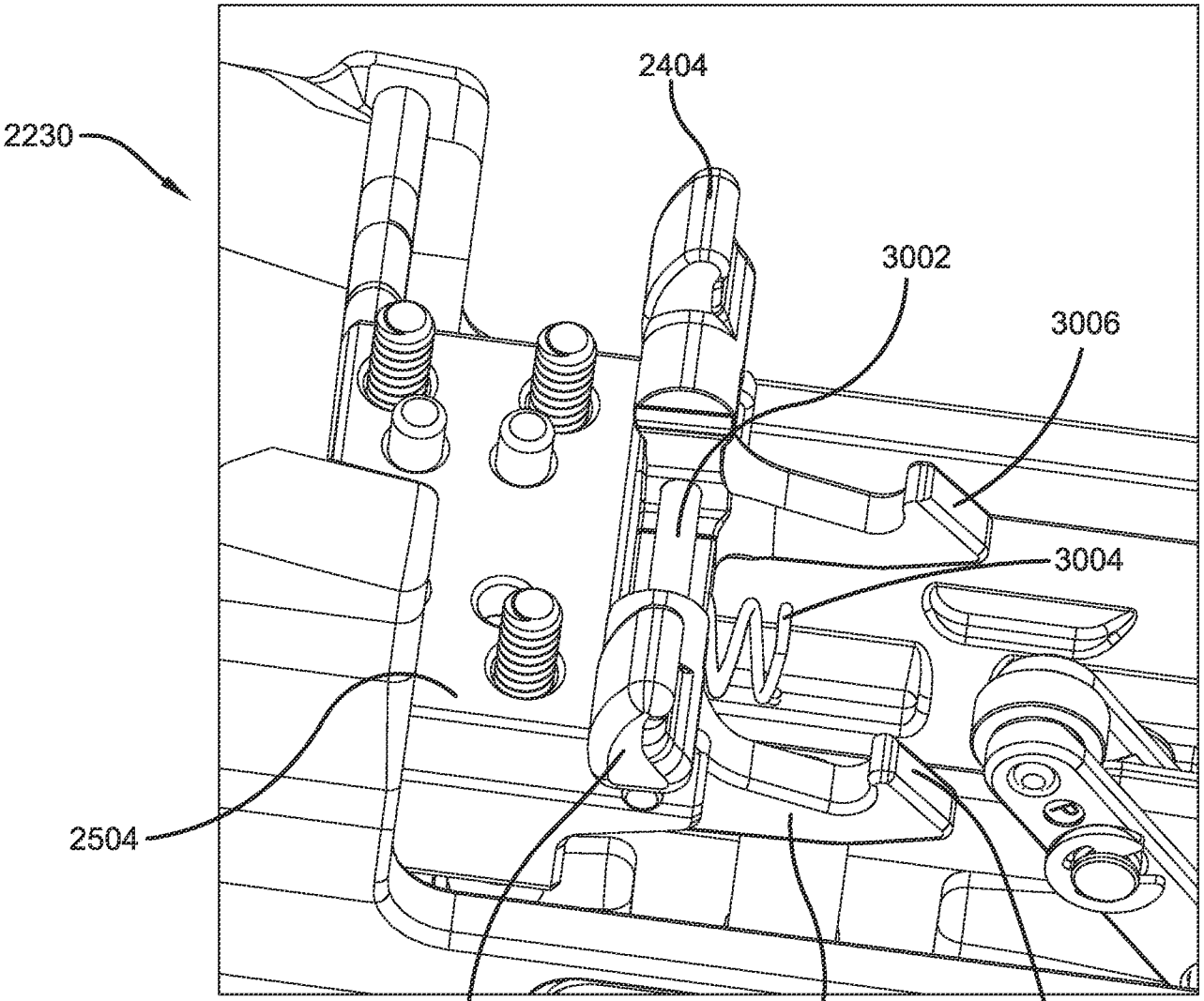
FIG. 30 is a top perspective view of a trigger latch mechanism according to some embodiments of this disclosure.
Figure 31:
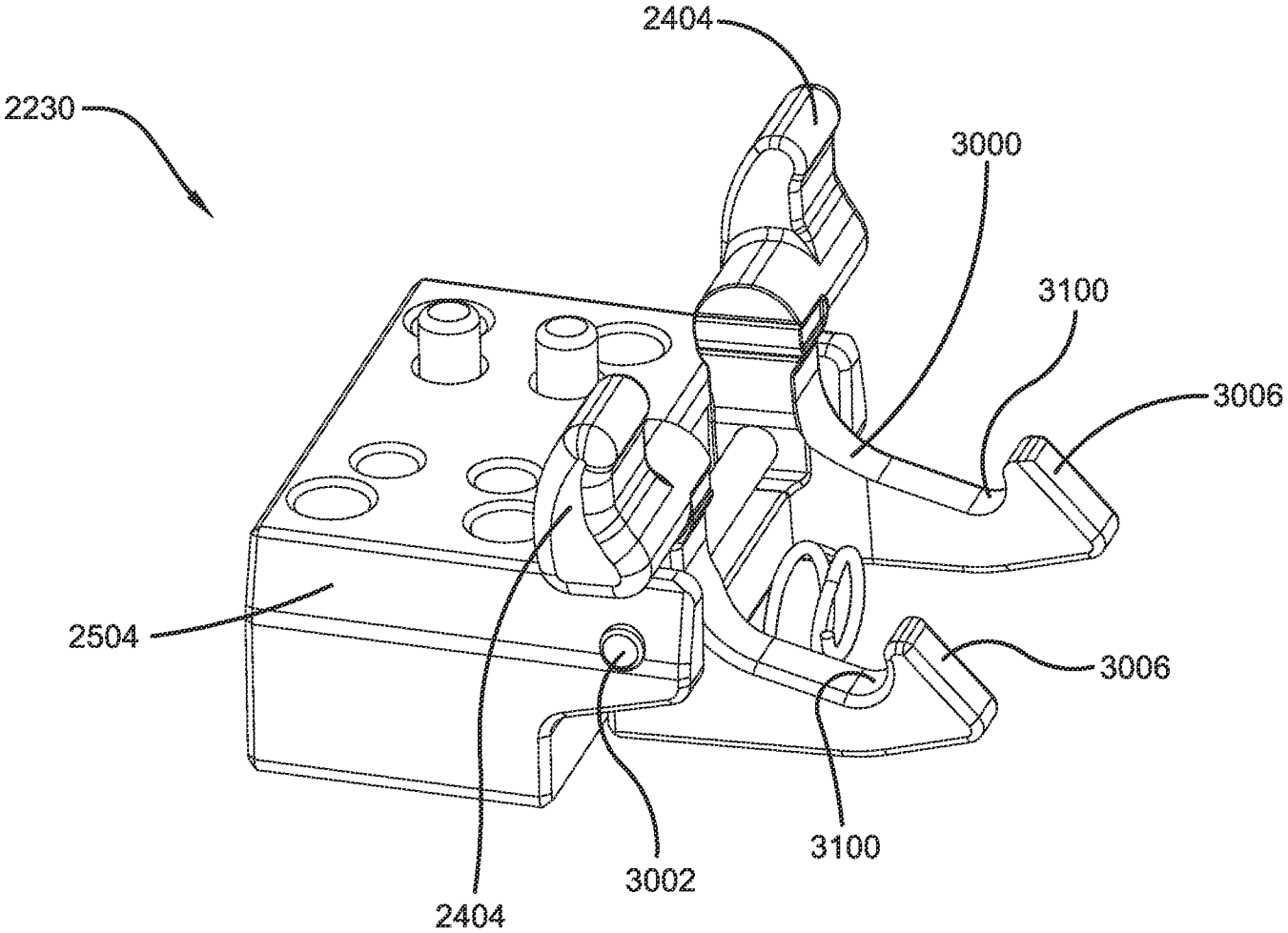
FIG. 31 is a top perspective view of the trigger latch mechanism shown in FIG. 30 separated from the crossbow main beam.
Figure 32:
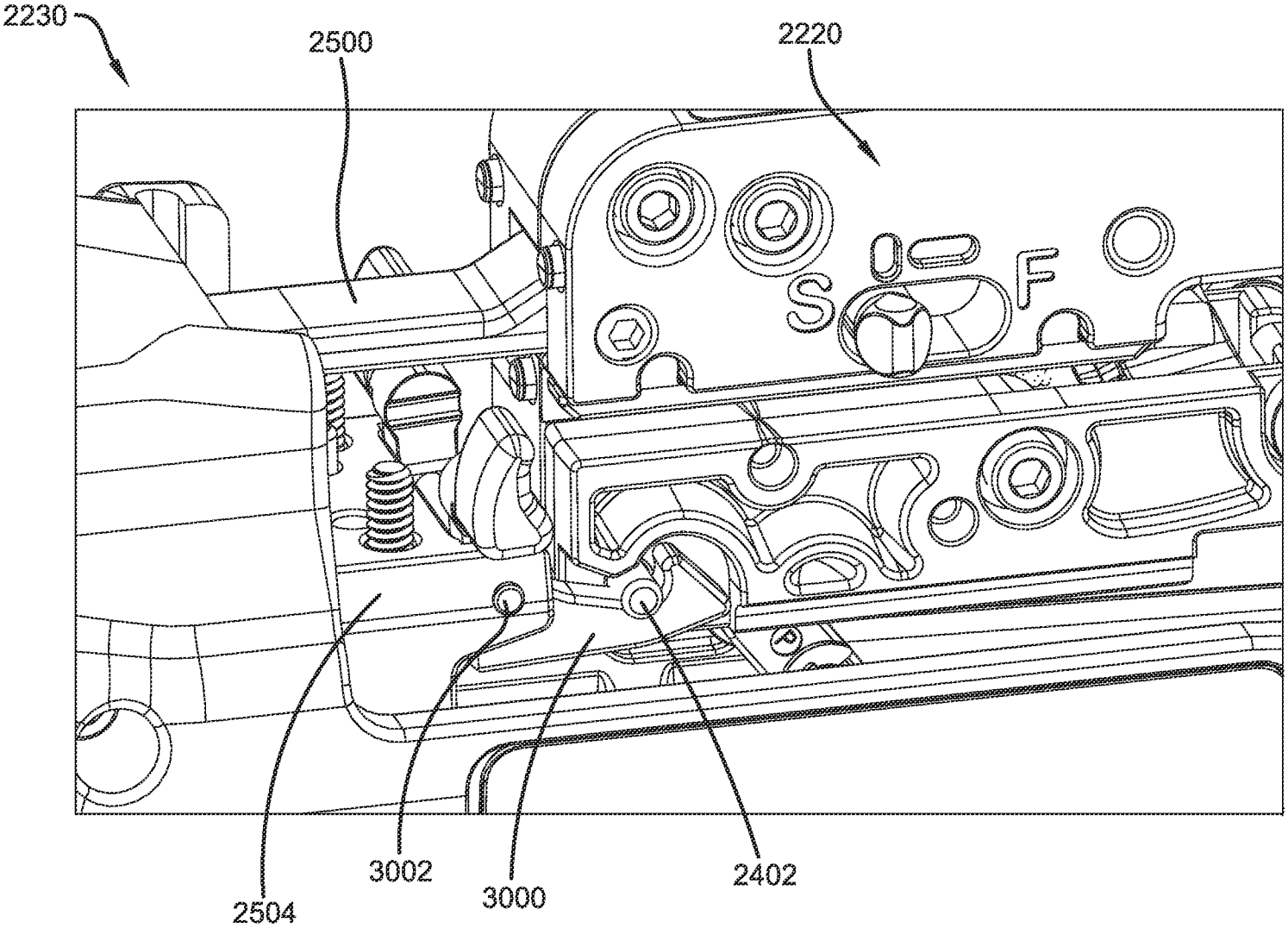
FIG. 32 is a side perspective view of the trigger latch mechanism shown in FIG. 30.
Figure 33:
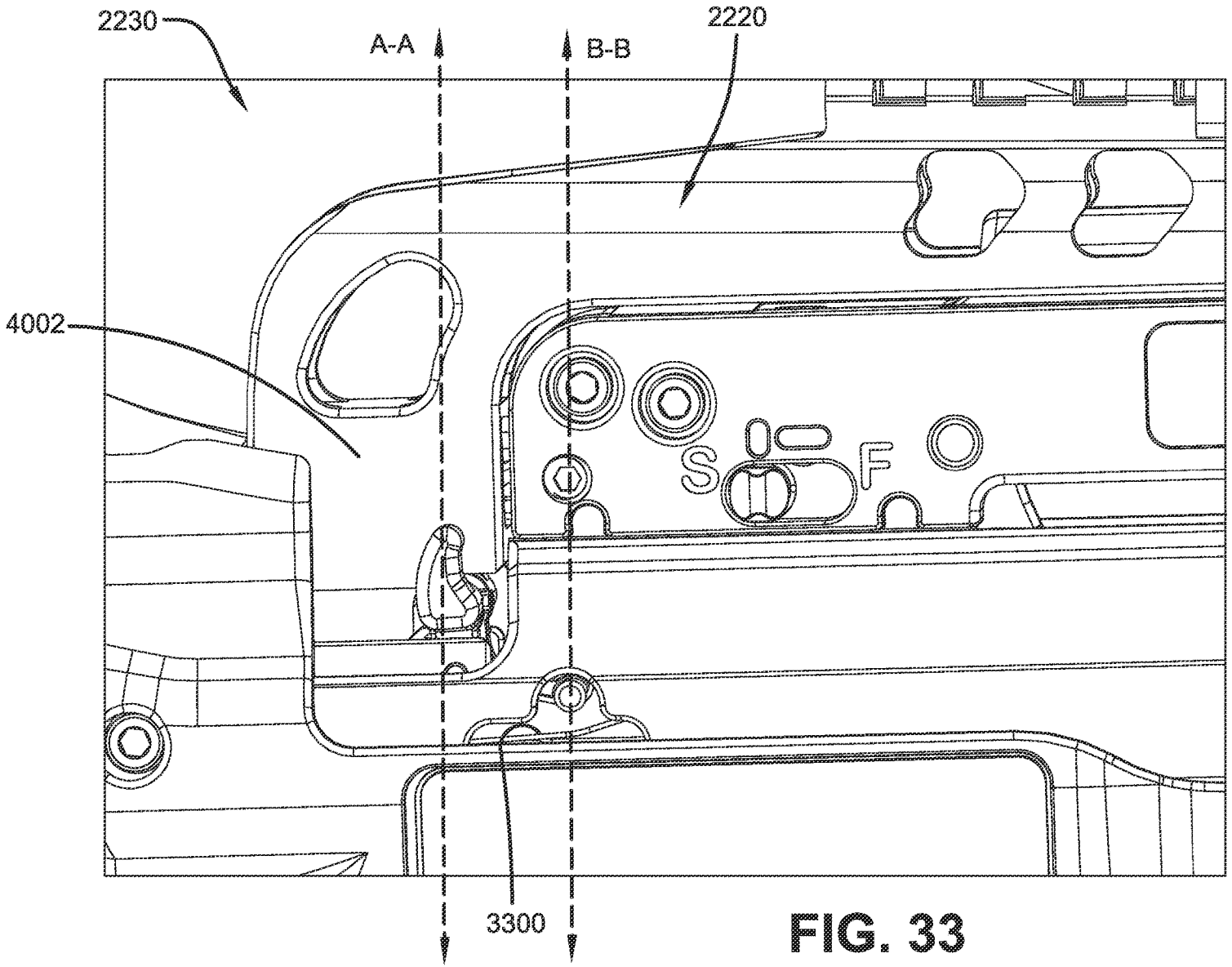
FIG. 33 is a close-up view of a portion of the crossbow shown in FIG. 22.
Figure 34:
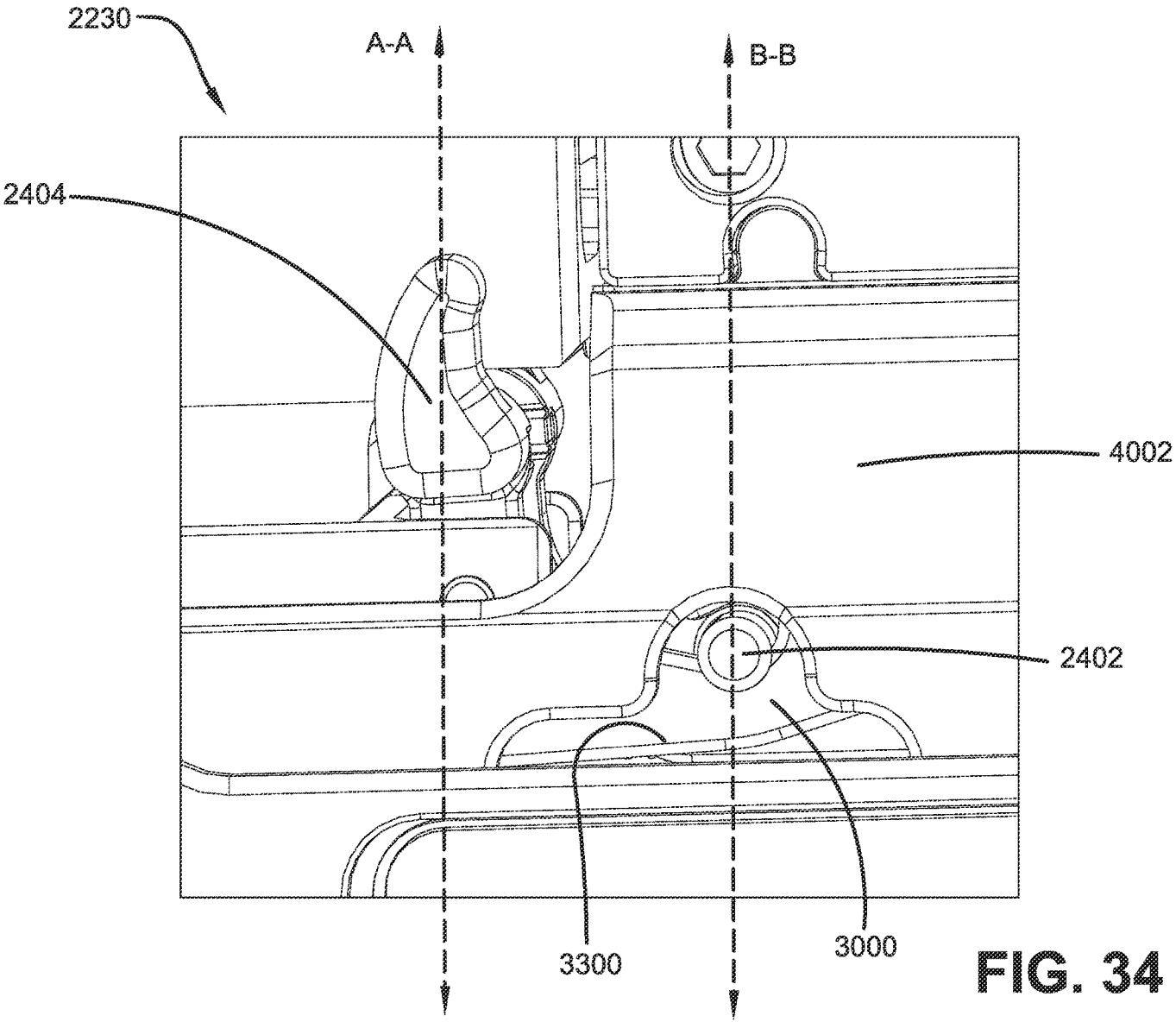
FIG. 34 is a close-up view of a portion of the crossbow shown in FIG. 33.
Figure 35:
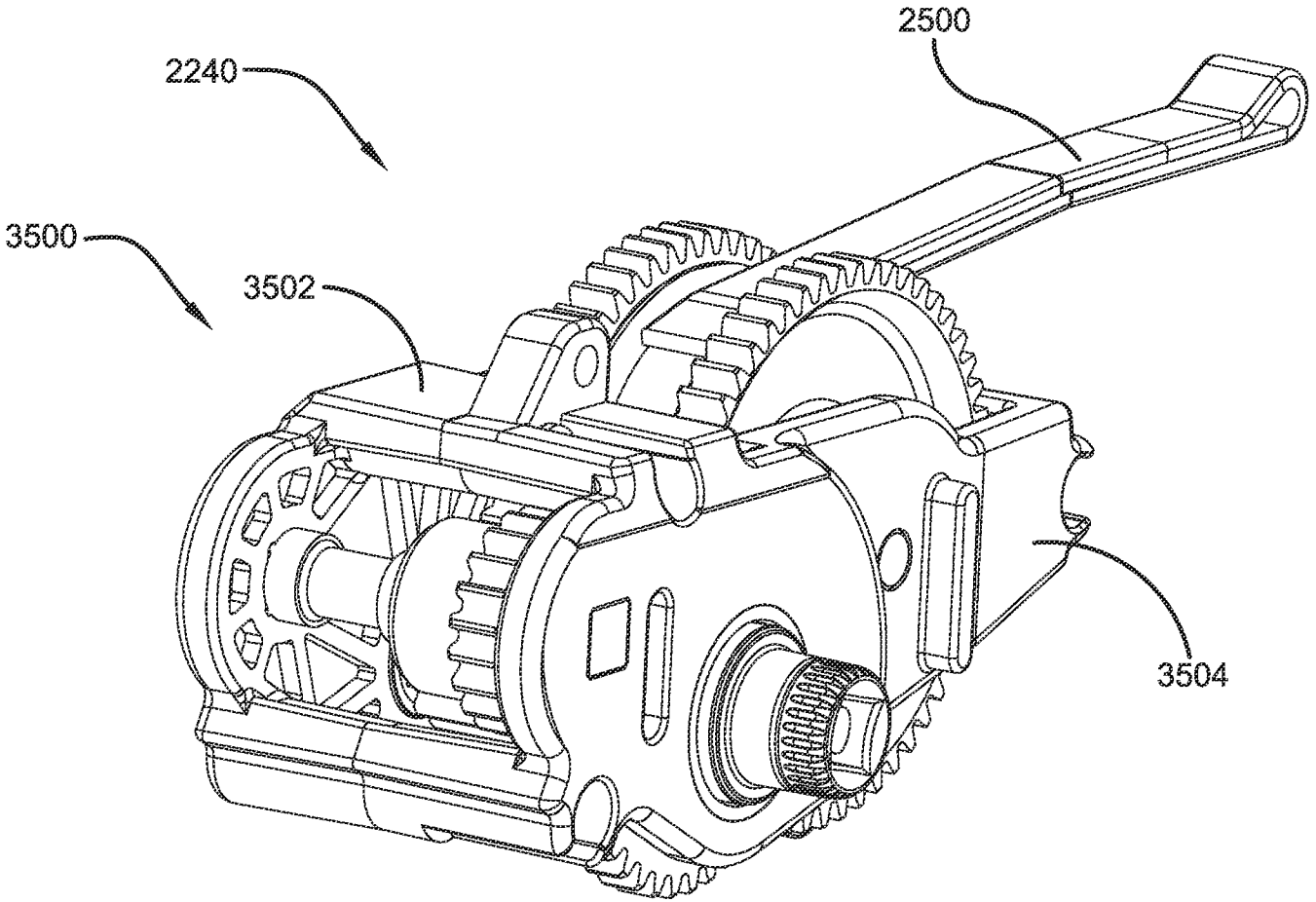
FIG. 35 is a perspective view of a winch assembly according to some embodiments of this disclosure.
Figure 36:
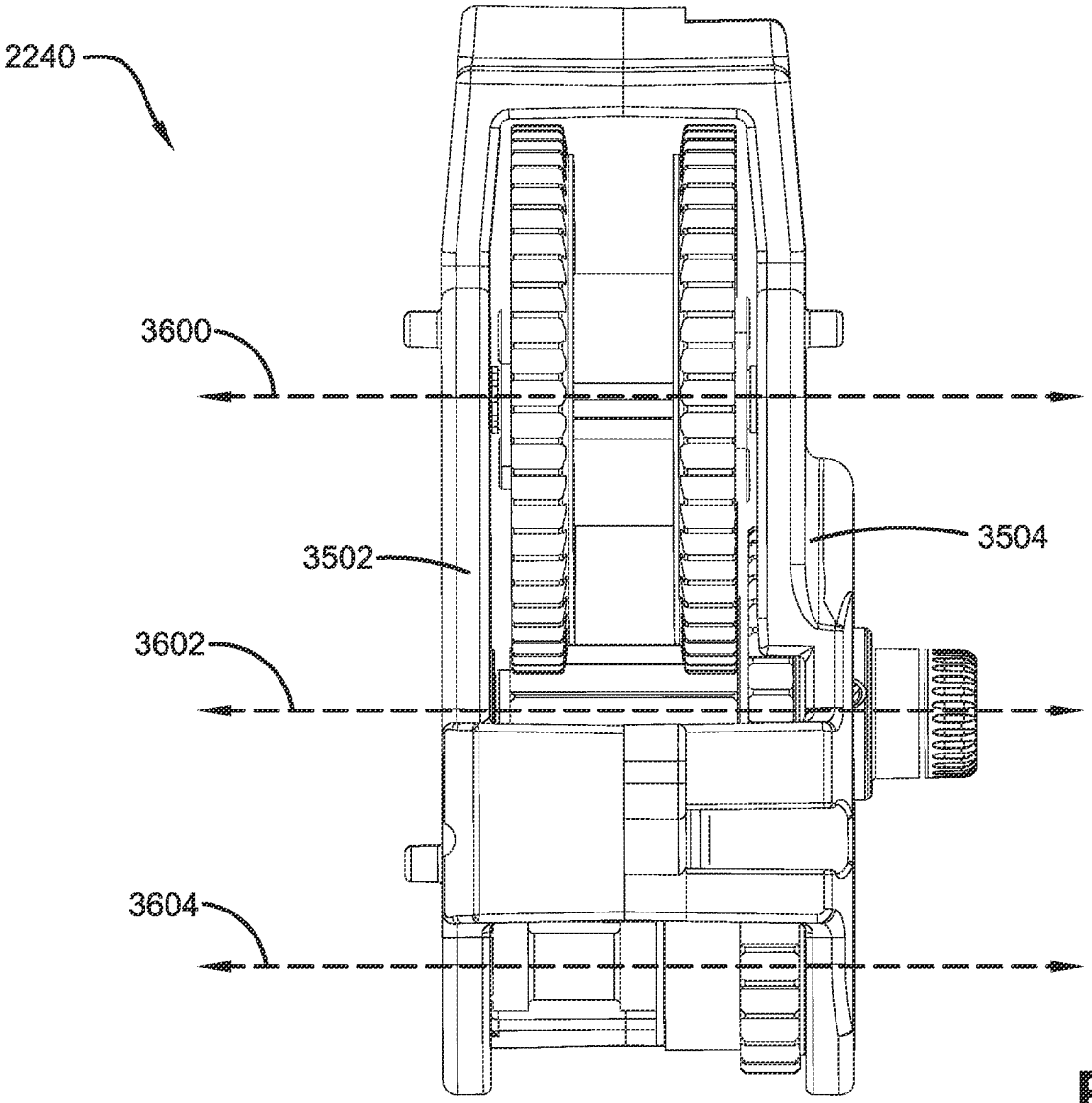
FIG. 36 is a top view of the winch assembly shown in FIG. 35.
Figure 37:
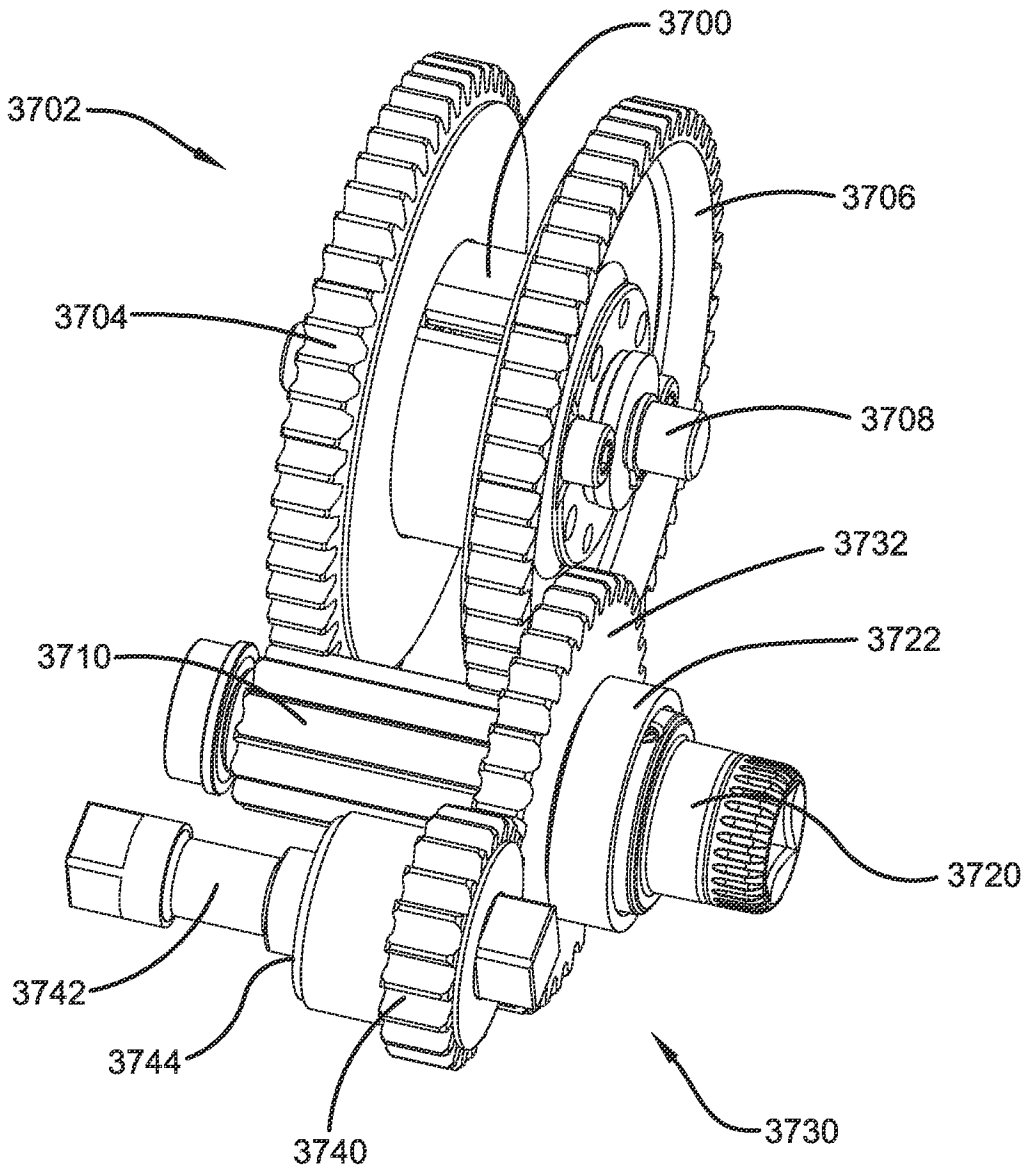
FIG. 37 is a top perspective view of the winch assembly shown in FIG. 35 with the winch housing removed for clarity.
Figure 38:
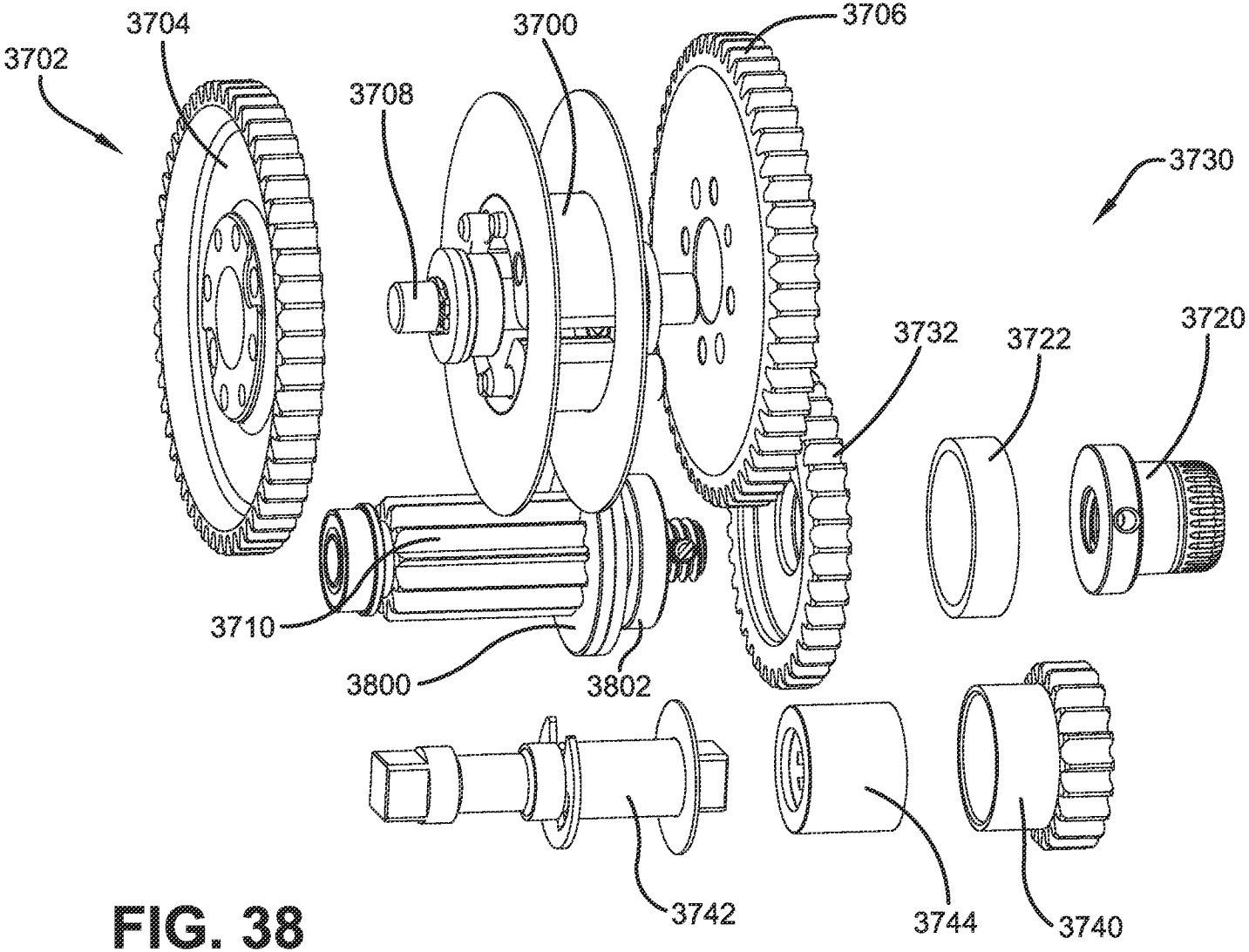
FIG. 38 is an exploded left side perspective view of the winch assembly shown in FIG. 37.
Figure 39:
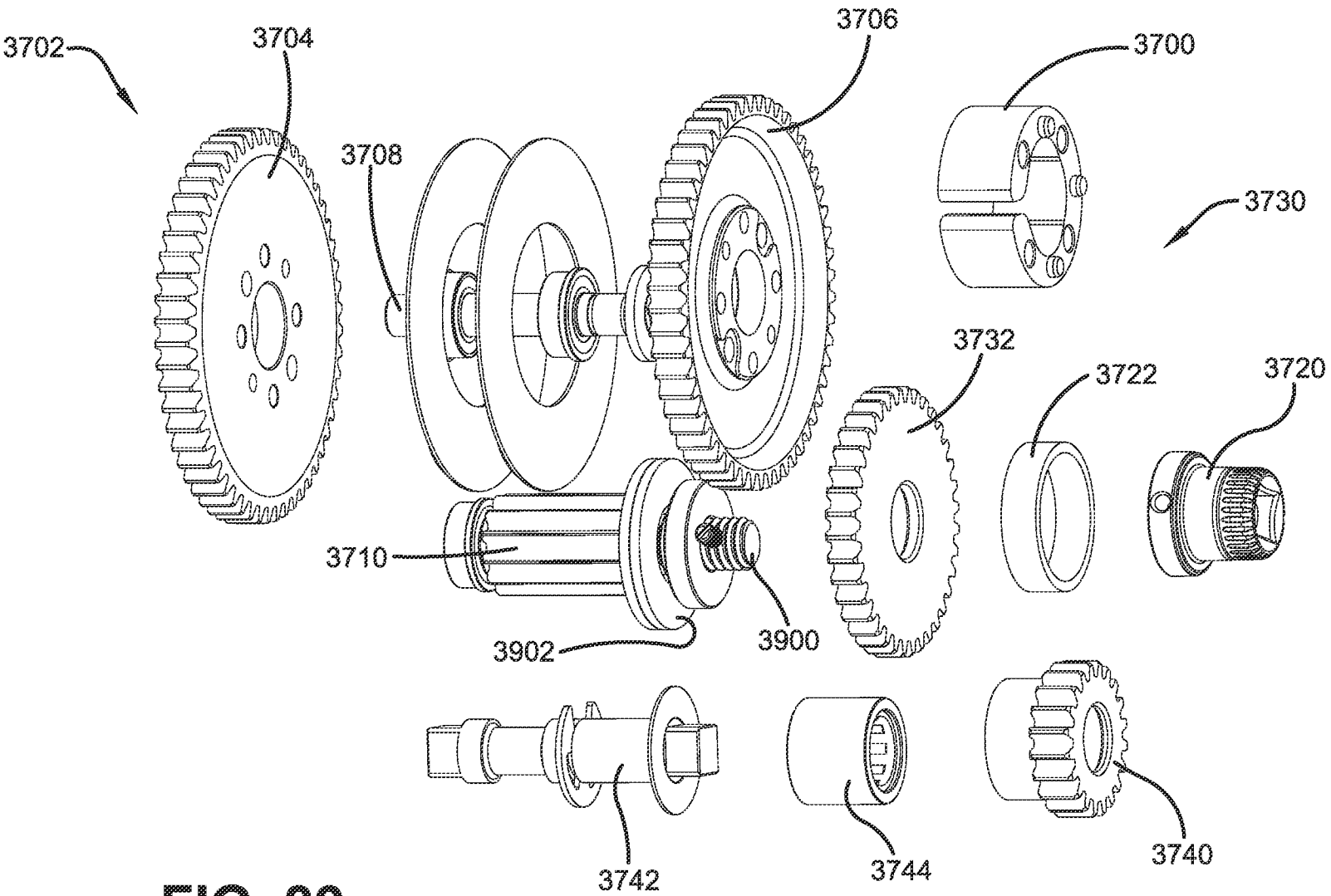
FIG. 39 is an exploded right side perspective view of the winch assembly shown in FIG. 37.
Figure 40:
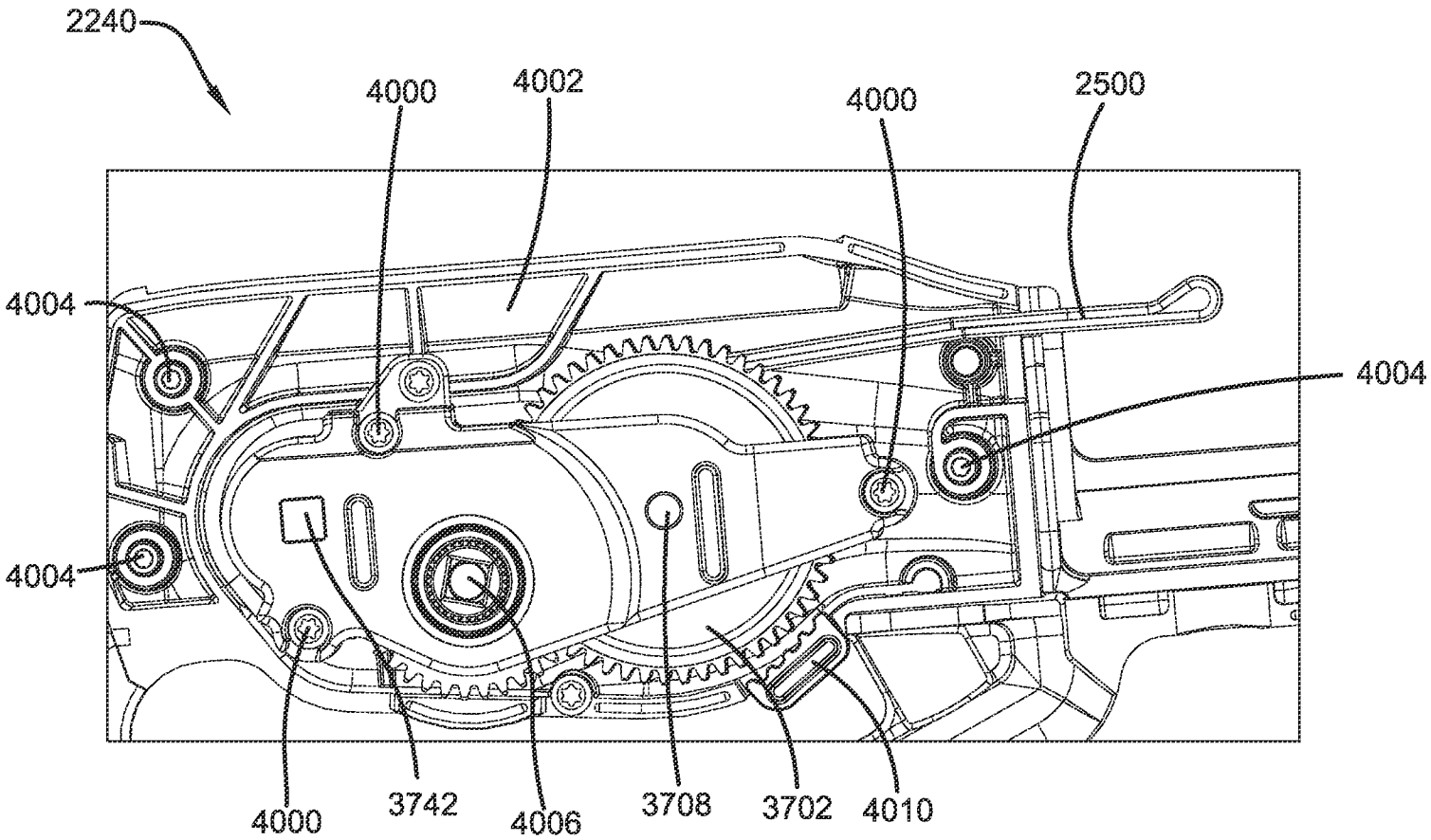
FIG. 40 is a close-up view of a portion of the crossbow shown in FIG. 33 with some parts removed for clarity.
Figure 41:
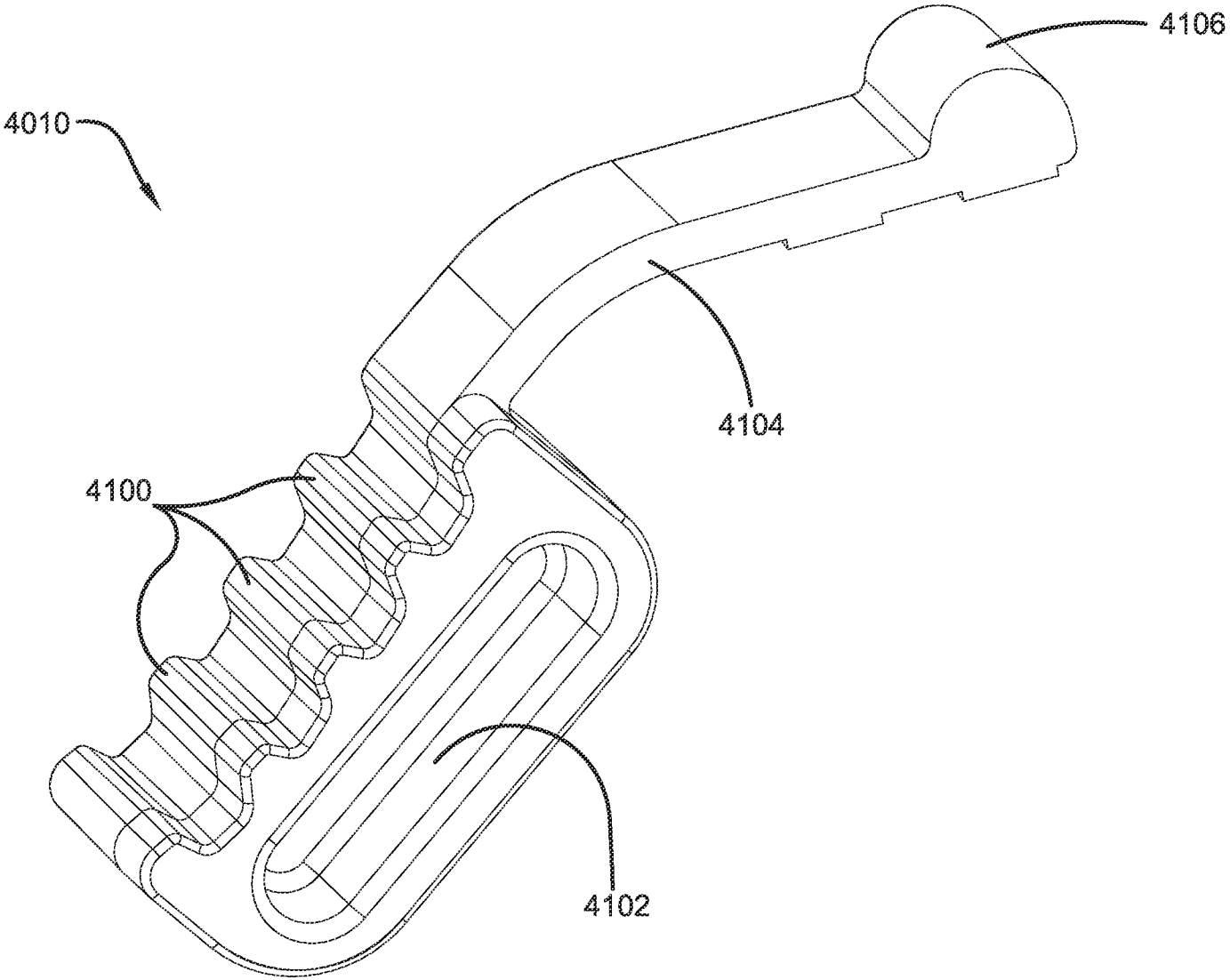
FIG. 41 is a perspective top view of a gear stop implement according to some embodiments of this disclosure.
Figure 42A:
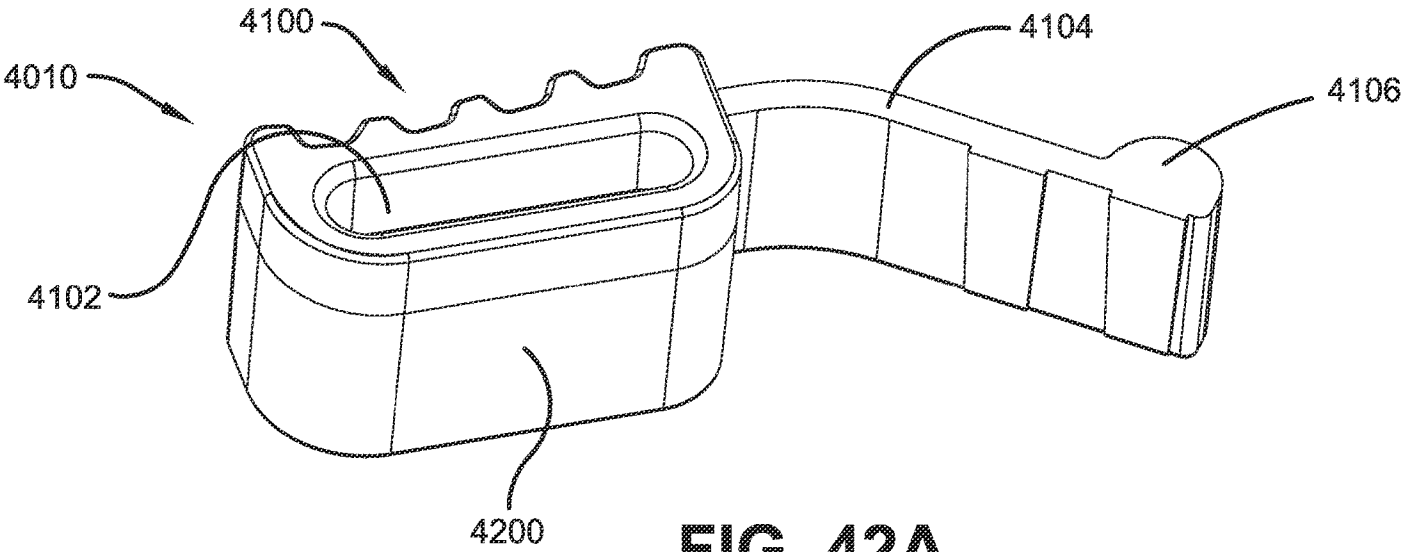
FIG. 42A is a perspective bottom view of the gear stop implement shown in FIG. 41.
Figure 42B:
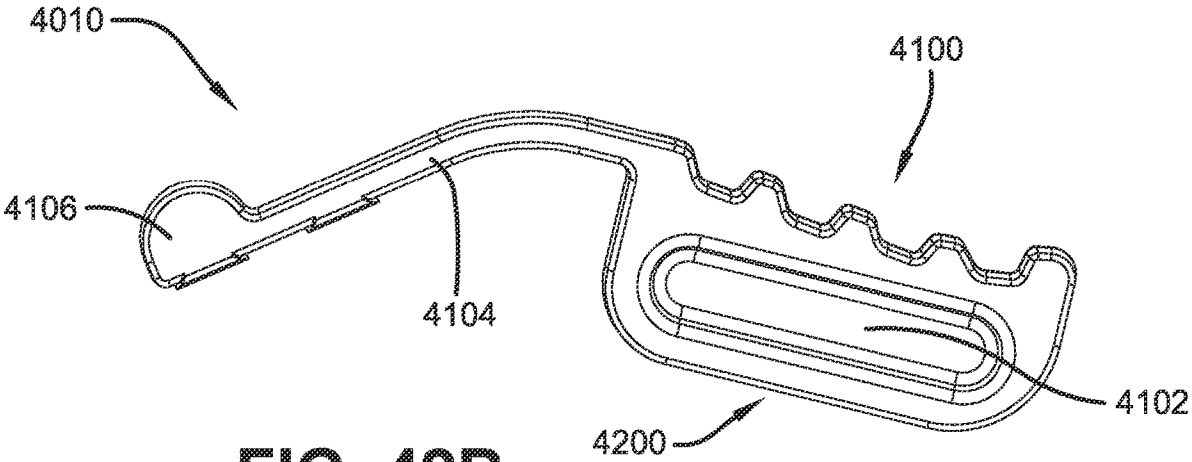
FIG. 42B is a side view of the gear stop implement shown in FIG. 41.
Figure 43:
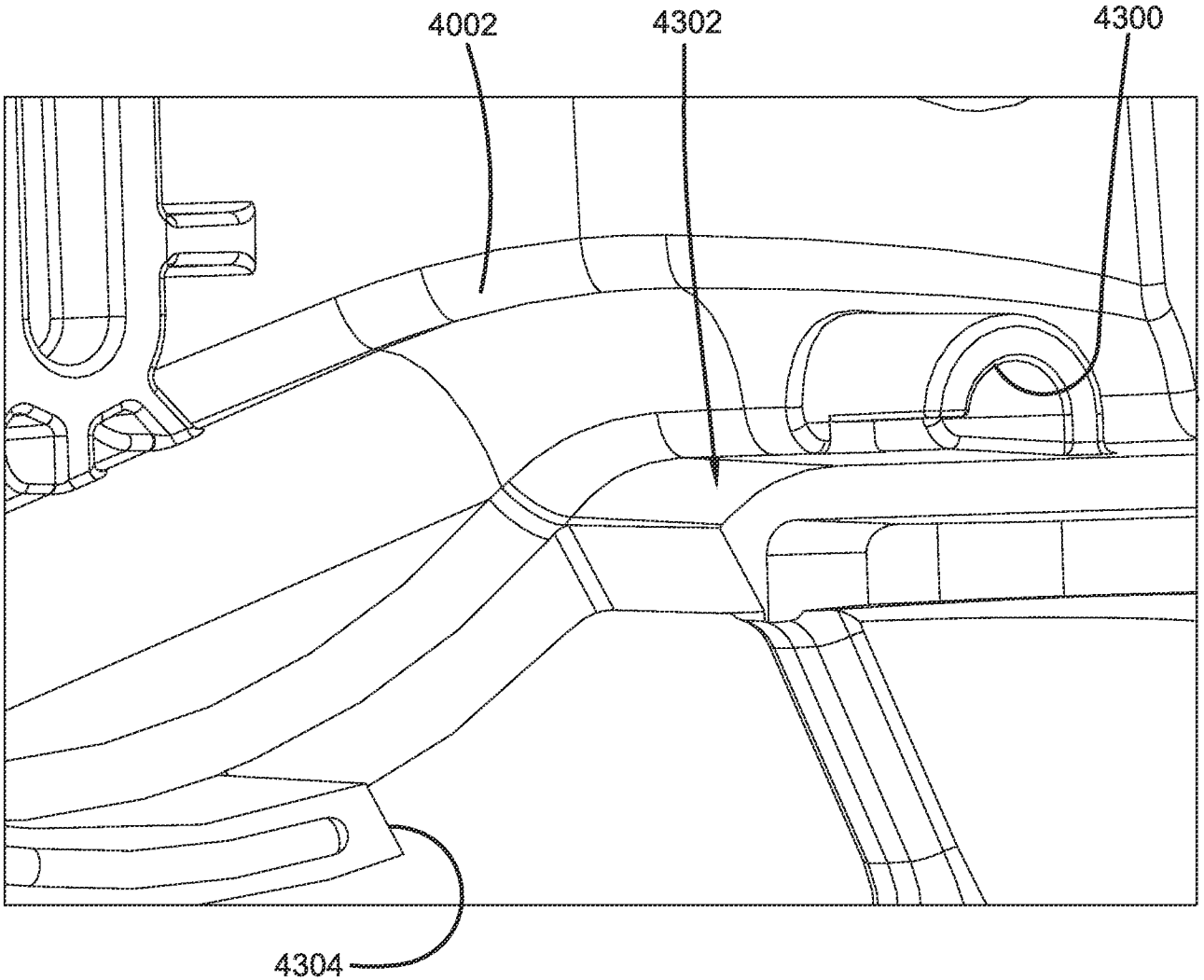
FIG. 43 is a close-up perspective view of a portion of the crossbow casing.
Figure 44:
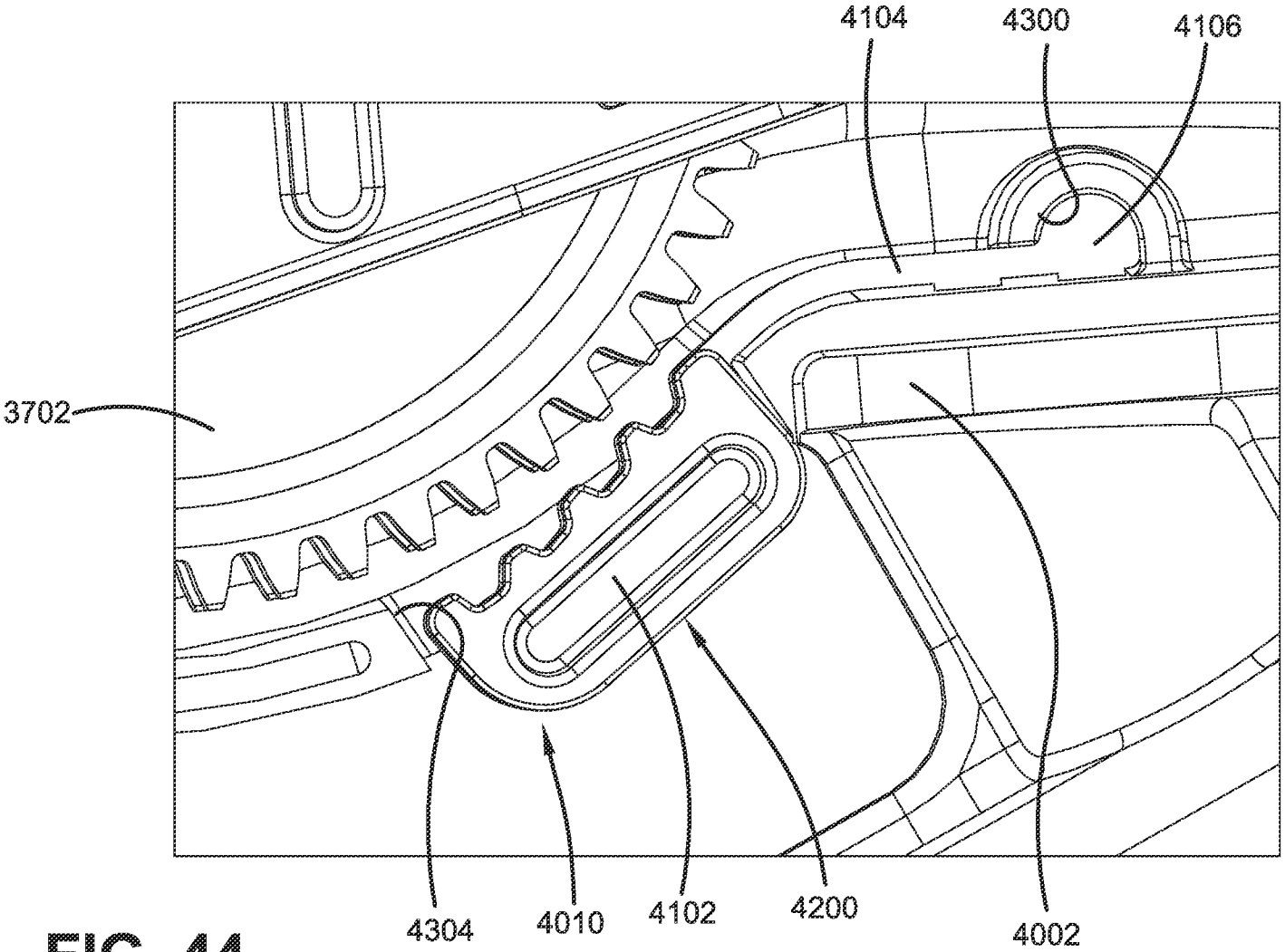
FIG. 44 is a close-up view of a portion of the crossbow shown in FIG. 40.

With reference now to FIGS. 22, 26 and 29, the trigger mechanism 2220 may include a string catch 2900 supported to the trigger housing 2400 and selectively movable between a first string catch position that does not hold the bowstring and a second string catch position that holds the bowstring. The string catch 2900 is best seen in FIG. 29. Though not visible, the string catch 2900 is in the second string catch position holding bowstring 2210 in FIGS. 22-23. In FIGS. 24-29 the string catch 2900 is in the first string catch position. For the embodiments shown, the string catch 2900 moves between the first and second string catch positions by pivoting around cylindrical pin 2902 that is supported to the trigger housing 2400. String catch 2900 may be biased by a spring 2904 into the first string catch position. Trigger lever 2906 can be selectively operated in a known manner (such as with trigger 2216) to move the string catch 2900 into the first string catch position to fire the crossbow. Safety slide 2908 and safety arm 2910 may be used to selectively position the trigger mechanism 2220 into a safe mode, where the crossbow cannot be fired, and a fire mode, where the crossbow can be fired. Safety slide 2908 may include a manually accessible button 2604 by which the operator can selectively move the trigger mechanism 2220 between the safe and fire modes. Dryfire lever 2912 may be used to prevent the trigger mechanism 2220 from firing if an arrow is not in the required position.

With reference now to FIGS. 22-25 and 30-32, the trigger latch mechanism 2230 may include a trigger latch housing 2504 supported to the main beam 2202. The trigger latch mechanism 2230 may include a trigger latch 3000 supported to the trigger latch housing 2504 and selectively movable between: a first trigger latch position that does not engage the trigger surface 2402 of the trigger mechanism 2220; and a second trigger latch position that engages the trigger surface 2402 to hold the trigger mechanism 2220 to the main beam 2202 at a longitudinal position. For the embodiments shown, the trigger latch 3000 moves between the first and second trigger latch positions by pivoting around cylindrical pin 3002 that is supported to the trigger latch housing 2504. The trigger latch 3000 may be biased by a spring 3004 into the second trigger latch position. The trigger latch 3000 may have at least one manually engageable surface 2404 (two shown), at least one concave surface 3100 (two shown) and at least one contact surface 3006 (two shown). The operation of the trigger latch mechanism 2230 will be described below.

With reference now to FIGS. 22-23, 35-36 and 40, because the winch assembly 2240 is similar to previously described winch assembly 500, the differences between them will be the primary focus of this description. In some embodiments, both winch assemblies 500 and 2240 are pawl-less. This means that they do not include a pawl. Pawls, as is well known to those of skill in the art, create an undesirable sound when they are operated. The winch assemblies in some embodiments of this invention, do not create the undesirable pawl sound as no pawl is used. In some embodiments, the winch assembly 2240 may include a winch housing 3500 formed by a first housing part 3502 and a second housing part 3504 which are engaged to one another by mechanical fasteners 4000. The winch assembly 2240 may be supported to the crossbow 2200 in any manner chosen with sound engineering judgement. For the embodiments shown, the winch assembly 2240 is positioned within a crossbow casing 4002. The casing 4002 may have parts engaged to one another by mechanical fasteners 4004. The winch housing 3500 may define a first housing axis 3600; a second housing axis 3602 offset from the first housing axis 3600; and a third housing axis 3604 offset from the first housing axis 3600 and offset from the second housing axis 3602.

With reference now to FIGS. 22-23, 25 and 35-40, the winch assembly 2240 may include a spool 3700 supported to a spool gear 3702 such as between first and second gears 3704, 3706 that define spool gear 3702. As noted above, the tensile member 2500 may have a first end operationally engaged with the trigger mechanism 2220. In one embodiment, the tensile member 2500 may be attached to laterally extending cylindrical pin 2502 that is supported to the trigger housing 2400. The tensile member 2500 may have a second end operatively engaged with the spool 3700 such that as the spool 3700 is rotated in one direction the tensile member 2500 is wound onto or wrapped around the spool 3700. Similarly, as the spool 3700 is rotated in the opposite direction the tensile member 2500 is unwound from or unwrapped from the spool 3700. As the tensile member 2500 is wrapped around the spool 3700, the first end of the tensile member 2500, and thus the trigger mechanism 2220, may be drawn toward the spool 3700. As used herein, and unless otherwise noted, to "spool in" is to wrap the tensile member 2500 around the spool 3700. The tensile member 2500 may be unwrapped from around the spool 3700 to permit the first end of the tensile member 2500, and thus the trigger mechanism 2220, to be drawn away from the spool 3700. As used herein, and unless otherwise noted, to "spool out" is to unwrap the tensile member 2500 from around the spool 3700. The spool 3700 and spool gear 3702 may be rotatable about the first housing axis 3600 with respect to the winch housing 3500. The spool gear 3702 may be operationally engaged with the winch housing 3500 by mounting the spool gear 3702 on a shaft 3708. The spool gear 3702 may include spool gear teeth adapted for operational engagement with a mating gear, such as, without limitation, drive gear 3710.

With reference now to FIGS. 14B, 22-23 and 36-40, drive gear 3710 may have drive gear teeth adapted for operational engagement with the spool gear teeth. The drive gear 3710 may be a spur gear and may be selectively rotatable about the second housing axis 3602 with respect to the winch housing 3500. The drive gear 3710 may include an axial drive stem 4006 that is similar to previously described drive stem 1420. The drive stem can be considered a drive shaft. In some embodiments, the drive stem 4006 may include threads 3900 to aid operable connection to one or more other components, such as and without limitation, receiver 3720. The receiver 3720 may be supported to the winch housing 3500 with friction sleeve 3722. The drive gear 3710 may be selectively rotatable about the second housing axis 3602 with respect to the winch housing 3500.

With reference now to FIGS. 22-23 and 35-40, the winch assembly 2240 may include a clutch gear assembly 3730 that may be operatively engaged with the drive gear 3710 to permit free rotation of the drive gear 3710 in a first direction of rotation but to permit only damped rotation in a second direction of rotation opposite that of the first direction of rotation. In certain non-limiting embodiments, the clutch gear assembly 3730 may be operatively engaged with the drive gear 3710 to permit free rotation of the drive gear 3710 in the spool in direction, but to permit only damped rotation in the spool out direction opposite that of the spool in direction. The clutch gear assembly 3730 may include a plate gear 3732, which may be a pressure plate gear, sandwiched between a collar 3800 and the receiver 3720. The plate gear 3732 may be selectively rotatable about the second housing axis 3602 with respect to the winch housing 3500. In some embodiments, the clutch gear assembly 3730 may also sandwich therebetween one or more of a first friction disc 3902 and a bushing 3802. Because the receiver 3720 is threadedly engaged with threads 3900 on the drive stem, the components between the receiver 3720 and drive stem may be compressed together with a compressive load adjustable by changing the amount of threaded engagement between the receiver 3720 and drive stem. A manually rotatable crank handle, including but not limited to the previously explained crank handle 2000 shown in FIG. 20, may be used to rotate the receiver 3720 similar to how receiver 663 described previously.

With reference now to FIGS. 35-39, the clutch gear assembly 3730 may include a brake gear 3740 selectively rotatable about a brake gear shaft 3742 and a one way bearing 3744 received on the shaft 3742. Flats on the brake shaft 3742 may engage with corresponding flats in the winch housing 3500 to prevent or impede rotation of the brake shaft 3742 with respect to the winch housing 3500. The brake gear 3740 may be operatively engaged with the one way bearing 3744. As a result, both the one way bearing 3744 and the brake gear 3740 are free to rotate in a first direction, the spool in direction, but do not rotate in a second direction opposite the first direction, the spool out direction. The one way bearing 3744 and the brake gear 3740 are selectively rotatable about the third housing axis 3604. Brake gear teeth may engage plate gear teeth with the result being that the plate gear 3732 is free to rotate in the spool in direction but is locked by the engaged brake gear 3740 from rotating in the spool out direction.

With reference now to FIGS. 35-41, the winch assembly 2240 may include a gear stop implement 4010 that can be selectively operated to prevent the spool gear 3702 from rotating. When the spool gear 3702 is prevented from rotating, so is the spool 3700 and the drive gear 3710. The gear stop implement 4010 may have gear stop implement teeth 4100 that are selectively engageable with the spool gear 3702 teeth. The gear stop implement 4010 can have any design chosen with sound engineering judgment. In some embodiments, the gear stop implement 4010 has a main body 4102 and an extension 4104. The gear stop implement teeth 4100 may be positioned on the upper side of the main body 4102, as shown. The extension 4104 may be relatively thin and flexible. By "flexible" it is meant that with the distal end of the extension 4104 held in place, the main body 4102 can be moved relative to the distal extension end.

With reference now to FIGS. 40-44, the gear stop implement 4010 may be supported to the crossbow via crossbow casing 4002. In some embodiments, the extension 4104 has a surface 4106 that is one of a convex or a concave shape that engages a matching surface 4300 on the casing that is the other of the convex or concave shape. For the embodiments shown, the extension surface 4106 has a convex shape and the casing surface 4300 has a matching concave surface that receives the extension surface 4106 and holds the gear stop implement 4010 to the casing 4002. The extension surface 4106 may be positioned at the distal end of the extension 4104, as shown. The lower surface of the extension 4104 may rest on a surface 4302 of the casing 4002. Surface 4302 may be curved downward, as shown, toward a casing opening 4304. The main body 4102 may extend out of the casing 4002 through opening 4304.

With continuing reference to FIGS. 40-44, because the main body 4102 extends out of the casing 4002, the gear stop implement 4010 can be easily accessed by a user. In one embodiment, gear stop surface 4200 serves as selectively manually pressable surface for the user. In this way, the gear stop implement 4010 can be adjusted from a first gear stop implement position where the gear stop implement teeth 4100 are disengaged from the spool gear 3702 teeth; and a second gear stop implement position where the gear stop implement teeth 4100 are engaged to the spool gear 3702 teeth. The gear stop implement 4010 is shown in the first gear stop implement position in FIGS. 40 and 44. In some embodiments, the gear stop implement 4010 is biased by a biasing force into the first gear stop implement position. This biasing force may be, in some embodiments, simply the gravitational force pulling the main body 4102 downward through opening 4304, resulting in the gear stop element teeth 4100 being separated from the spool gear 3702 teeth. In other embodiments, a different biasing force can be used; such as a separate spring or by making the extension 4104 to have a biasing force due to its material.

With reference now to FIGS. 22-44, non-limiting embodiments for cocking crossbow 2200 will be described. When the bowstring 2210 is in the un-cocked position (bowstring 34 is shown in the un-cocked position in FIG. 1), the trigger mechanism 2220 may be moved along the main beam 2202 distally to the bowstring 2210. The rail(s) 2700 and/or roller(s) 2602 may be used during this motion. If the trigger mechanism 2220 begins with the trigger latch 3000 in the second trigger latch position that engages the trigger surface 2402 to hold the trigger mechanism 2220 to the main beam 2202, the user only needs to press the trigger latch 3000, such as pressing manually engageable surface 2404 distally, to move the trigger latch 3000 into the first trigger latch position to release the trigger surface 2402 and thus release the trigger mechanism 2220. This motion of the trigger latch 3000 overcomes the biasing force of the spring 3004. Then, the string catch 2900 may be moved from the first string catch position that does not hold the bowstring 2210 to the second string catch position that holds the bowstring 2210. This may be accomplished by the user moving the trigger mechanism 2220 distally, such as by pressing on knob 2702. This causes the bowstring 2210 to contact the string catch 2900 and move the string catch 2900 into the second string catch position.

With the bowstring 2210 in the un-cocked position and the string catch 2900 in the second string catch position holding the bowstring 2210, the winch assembly 2240 can be operated: to receive a first rotational input to rotate the drive gear 3710 in the spool in direction; to rotate the spool gear 3702; to rotate the spool 3700; to wrap the tensile member 2500 around the spool 3700; to move the trigger mechanism 2220 proximally along the main beam 2202 to the trigger latch mechanism 2230; to move the bowstring 220 from the un-cocked position to the cocked position. In some embodiments, the first rotational input may be multiple revolutions of the drive gear 3710. In some embodiments, the first rotational input is provided by the user using a manually rotatable crank handle 200 engaged to the receiver 3720.

As the trigger mechanism 2220 is moved to the trigger latch mechanism 2230, the trigger latch 3000 is moved from the first trigger latch position into the second trigger latch position to hold the trigger mechanism 2220 to the main beam 2202. In some embodiments, this is accomplished when the trigger surface 2402 of the trigger mechanism 2220 contacts the contact surface 3006 of the trigger latch 3000. This causes the trigger latch 3000 to pivot about (or with) pin 3002 from the second trigger latch position into the first trigger latch position. The trigger surface 2402 is then received in the concave surface of the trigger latch 3000 and the trigger latch 3000 returns to the second trigger latch position holding the trigger mechanism 2220 to the main beam 2202 at a specific longitudinal position—where the trigger latch mechanism 2230 is positioned. With reference to FIGS. 22-34, in some embodiments, the user can easily see if the trigger latch 3000 is in the second trigger latch position holding the trigger mechanism 2220. The casing 4002 may have a first outer surface longitudinally and transversely positioned in line, see line A-A, with the manually engageable surface 2404 of the latch 3000; and a second outer surface longitudinally and transversely positioned in line, see line B-B with the concave surface 3100 of the latch 3000. The manually engageable surface 2404 is positioned transversely outside the first outer surface; the concave surface 3100 is positioned transversely inside the second outer surface; and the second outer surface has an opening 3300 permitting a user to see the concave surface 3100 and if it is engaged to the convex surface 2402 of the trigger mechanism 2220. In some embodiments, there is an opening 3300 on each lateral side of the crossbow revealing if the concave surface 3100 is engaged to the convex surface 2402 of the trigger mechanism 2220.

When the trigger latch 3000 is in the second trigger latch position holding the trigger mechanism 2220 to the main beam 2202 and the string catch 2900 is in the second string catch position holding the bowstring 2210, the winch assembly 2240 can be operated: to receive a second rotational input to rotate the drive gear 3710 in the spool out direction; to rotate the spool gear 3702; to rotate the spool 3700; to relieve tension from the tensile member 2500. In some embodiments, the second rotational input may be at least 360 degrees of rotation of the drive gear 3710. In some embodiments, the second rotational input is provided by the user using a manually rotatable crank handle 200 engaged to the receiver 3720.

When the tension has been relieved from the tensile member 2500, the trigger latch 3000 remains in the second trigger latch position holding the trigger mechanism 2220 to the main beam 2202 and the string catch 2900 remains in the second string catch position holding the bowstring 2210: the trigger mechanism 2220 may be operated to move the string catch 2900 into the first string latch position to release the bowstring 2210 to fire the crossbow 2200. This may be accomplished, in some embodiments, by pressing trigger 2216. Note: firing the crossbow 2200 may not be possible in some circumstances. As one example, if an arrow is not properly placed on the main beam 2202, the dryfire lever 2912 may prevent firing. As another example, if the safety slide 2908 is not placed into the fire mode, the safety arm 2910 may prevent firing.

When the clutch gear assembly 3730 is operatively engaged to the drive gear 3710, the drive gear 3710 and plate gear 3732 may rotate together with the drive shaft. When the clutch gear assembly 3730 is operatively disengaged from the drive gear 3710: the drive gear 3710 rotates with the drive shaft; and the plate gear 3732 does not rotate with the drive shaft. When the clutch gear assembly 3730 is operatively engaged to the drive gear 3710 and the bowstring 2210 is positioned between the cocked position and the un-cocked position, defined as an intermediate bowstring position: removal of rotational input to the winch assembly 2240, such as releasing the crank handle 2000, results in the bowstring 2210 remaining in the intermediate bowstring position. This occurs because when the bowstring 2210 is positioned anywhere between the cocked position and the un-cocked position, the bowstring 2210 applies a distal force onto the trigger mechanism 2220. This distal force is in the spool out direction so as long as the clutch gear assembly 3730 is operatively engaged with the drive gear 3710, the brake gear 3740 will prevent the plate gear 3732 and thus the drive gear 3710, spool gear 3702 and spool 3700 from rotating. As a result, the trigger mechanism 2220 and bowstring 2210 remain in the same longitudinal position.

When the trigger latch 3000 is in the second trigger latch position holding the trigger mechanism 2220 to the main beam 2202, the string catch 2900 is in the second string catch position holding the bowstring 2210 and after the second rotational input has been applied, it may be desirable to disengage the clutch gear assembly 3730 from the drive gear 3710. This may desirable, for example, to enable the trigger mechanism 2220 to be easily released by the trigger latch mechanism 2230 after firing the crossbow. To disengage the clutch gear assembly 3730 from the drive gear 3710, the winch assembly 2240 can be operated: to engage the gear stop implement teeth 4100 with the spool gear 3702 teeth; then, simultaneously, to receive a third rotational input to rotate the drive gear 3710 in the spool out direction; to rotate the receiver 3720 with respect to the drive shaft. In some embodiments, the gear stop implement teeth 4100 can be engaged to the spool gear 3702 teeth by manually pressing and holding the surface 4200 of the gear stop implement 4010, overcoming the biasing force that biases the gear stop implement 4010 into the first gear stop implement position where the gear stop implement teeth 4100 are disengaged from the spool gear 3702 teeth. In some embodiments, the third rotational input may be at least 360 degrees of rotation of the drive gear 3710. In some embodiments, the third rotational input is provided by the user using a manually rotatable crank handle 200 engaged to the receiver 3720.

With reference still to FIGS. 22-44, non-limiting embodiments for de-cocking crossbow 2200 will be described. When the bowstring 2210 is in the cocked position, the trigger latch 3000 is in the second trigger latch position holding the trigger mechanism 2220 to the main beam 2202 at the longitudinal position, the string catch 2900 is in the second string catch position holding the bowstring 2210, and tension has been relieved from the tensile member 2500, the trigger latch mechanism 2230 can be operated: to receive a trigger latch force on the trigger latch 3000 to relieve tension from the trigger latch mechanism 2230. Then, as the trigger latch force continues to be applied to the trigger latch 3000; the winch assembly 2240 can be operated: to receive a first rotational input to rotate the drive gear 3710 in the spool in direction; to rotate the spool gear 3702; to rotate the spool 3700; to apply tension to the tensile member 2500; to move the trigger latch 3000 into the first trigger latch position that does not engage the trigger surface 2402 of the trigger mechanism 2220. In some embodiments, the first rotational input may be at least 360 degrees of rotation of the drive gear 3710. In some embodiments, the first rotational input is provided by the user using a manually rotatable crank handle 200 engaged to the receiver 3720.

When the bowstring 2210 is in the cocked position, the trigger latch 3000 is in the first trigger latch position that does not engage the trigger surface 2402 and the string catch 2900 is in the second string catch position holding the bowstring 2210, the winch assembly 2240 can be operated: to receive a second rotational input to rotate the drive gear 3710 in the spool out direction; to rotate the spool gear 3702; to rotate the spool 3700; to unwrap the tensile member 2500 from the spool 3700; to move the trigger mechanism 2220 away from the trigger latch mechanism 2230; to move the bowstring 2210 from the cocked position to the un-cocked position. In some embodiments, the second rotational input may be multiple revolutions of the drive gear 3710. In some embodiments, the second rotational input is provided by the user using a manually rotatable crank handle 200 engaged to the receiver 3720.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof. When the word "associated" is used in the claims, the intention is that the object so labeled is not positively claimed but rather describes an object with which the claimed object may be used.

We claim:

1. A crossbow comprising:

a longitudinally extending main beam;

a bow mechanism including:

1) a pair of outwardly extending bow limbs extending transversely from opposite lateral sides of the main beam; and 2) a bowstring operatively engaged to the outwardly extending bow limbs and movable between:
(a) an un-cocked position; and
(b) a cocked position;

a de-cocking mechanism including:
1) a trigger mechanism;
2) a trigger latch mechanism; and
3) a winch assembly;

the trigger mechanism including:
1) a trigger housing;
2) a trigger surface supported to the trigger housing; and
3) a string catch supported to the trigger housing and selectively movable between:
(a) a first string catch position that does not hold the bowstring; and
(b) a second string catch position that holds the bowstring;

the trigger latch mechanism including a trigger latch supported to the main beam and selectively movable between:
(a) a first trigger latch position that does not engage the trigger surface; and
(b) a second trigger latch position that engages the trigger surface to hold the trigger mechanism to the main beam at a longitudinal position; and the winch assembly including:
1) a winch housing supported to the main beam;
2) a spool that is selectively rotatable with respect to the winch housing;
3) a tensile member having:
(a) a first end operatively engaged with the spool; and
(b) a second end operatively engaged with the trigger housing;
4) a spool gear:
(a) operatively engaged with the spool; and
(b) selectively rotatable with respect to the winch housing;
5) a drive gear:
(a) operatively engaged with the spool gear; and
(b) selectively rotatable with respect to the winch housing; and
6) a clutch gear assembly that:
(a) is selectively operatively engageable to the drive gear;
(b) when operatively engaged to the drive gear, is adapted to enable the drive gear to rotate:
(i) freely in a spool in direction; and
(ii) subject to a damping load in a spool out direction; and
(c) when operatively disengaged from the drive gear, is adapted to enable the drive gear to rotate freely in both the spool in direction and the spool out direction;

wherein:
1) when the bowstring is in the cocked position, the trigger latch is in the second trigger latch position holding the trigger mechanism to the main beam at the longitudinal position, the string catch is in the second string catch position holding the bowstring, and tension has been relieved from the tensile member, the trigger latch mechanism is selectively operable: to receive a trigger latch force on the trigger latch to relieve tension from the trigger latch mechanism;
2) when the bowstring is in the cocked position, the trigger latch is in the second trigger latch position holding the trigger mechanism to the main beam at the longitudinal position, the string catch is in the second string catch position holding the bowstring, tension has been relieved from the trigger latch mechanism and the trigger latch force continues to be applied to the trigger latch; the winch assembly is selectively operable:
(a) to receive a first rotational input to rotate the drive gear in the spool in direction; to
(b) rotate the spool gear; to
(c) rotate the spool; to
(d) apply tension to the tensile member; to
(e) move the trigger latch into the first trigger latch position that does not engage the trigger surface; and
3) when the bowstring is in the cocked position, the trigger latch is in the first trigger latch position that does not engage the trigger surface and the string catch is in the second string catch position holding the bowstring, the winch assembly is selectively operable:
(a) to receive a second rotational input to rotate the drive gear in the spool out direction; to
(b) rotate the spool gear; to
(c) rotate the spool; to
(d) unwrap the tensile member from the spool; to
(e) move the trigger mechanism away from the trigger latch mechanism; to
(f) move the bowstring from the cocked position to the un-cocked position.

2. The crossbow of claim 1 wherein:
the drive gear rotates with a drive shaft;
the winch assembly includes a pressure plate gear;
when the clutch gear assembly is operatively engaged to the drive gear, the drive gear and pressure plate gear rotate together with the drive shaft; and
when the clutch gear assembly is operatively disengaged from the drive gear:
1) the drive gear rotates with the drive shaft; and
2) the pressure plate gear does not rotate with the drive shaft.

3. The crossbow of claim 2 wherein:
The pressure plate gear has plate gear teeth;
the winch assembly includes:
1) a one way bearing selectively rotatable in only one direction with respect to the winch housing; and
2) a brake gear:
(a) operatively engaged with the pressure plate gear teeth;
(b) operatively engaged with the one way bearing; and
(c) selectively rotatable in the only one direction with respect to the winch housing;
when the clutch gear assembly is operatively engaged to the drive gear and the bowstring is positioned between the cocked position and the un-cocked position, defined as an intermediate bowstring position: removal of rotational input to the winch assembly results in the bowstring remaining in the intermediate bowstring position.

4. The crossbow of claim 2 wherein:
the drive shaft has threads;
the clutch gear assembly includes a receiver having threads that engage the drive shaft threads;
the receiver is adapted when rotated sufficiently:

1) in a first receiver direction with respect to the drive shaft, to operatively engage the clutch gear assembly to the drive gear; and
2) in a second receiver direction with respect to the drive shaft, opposite the first receiver direction, to operatively disengage the clutch gear assembly from the drive gear.

5. The crossbow of claim 4 wherein:

the winch assembly includes a manually rotatable crank handle that:
1) is selectively engageable to the receiver; and
2) selectively provides the first rotational input and the second rotational input.

6. The crossbow of claim 1 wherein:

when the bowstring is in the cocked position, the trigger latch is in the second trigger latch position holding the trigger mechanism to the main beam at the longitudinal position, the string catch is in the second string catch position holding the bowstring, tension has been relieved from the trigger latch mechanism and the trigger latch force continues to be applied to the trigger latch;

the winch assembly is selectively operable:
1) to receive the first rotational input of at least 360 degrees to rotate the drive gear in the spool in direction; to
2) rotate the spool gear; to
3) rotate the spool; to
4) apply tension to the tensile member; to
5) move the trigger latch into the first trigger latch position that does not engage the trigger surface.

7. The crossbow of claim 1 wherein:

the trigger surface includes a convex surface;

the trigger latch includes:
1) a manually engageable surface that is selectively manually pressable to receive the trigger latch force on the trigger latch to relieve tension from the trigger latch mechanism; and
2) a concave surface that engages the convex surface when the trigger latch is in the second trigger latch position;

the crossbow has a casing with:
1) a first outer surface longitudinally and transversely positioned in line with the manually engageable surface; and
2) a second outer surface longitudinally and transversely positioned in line with the concave surface;

the manually engageable surface is positioned transversely outside the first outer surface;

the concave surface is positioned transversely inside the second outer surface; and the second outer surface has an opening permitting a user to see the concave surface and if it is engaged to the convex surface.

8. The crossbow of claim 1 wherein:

the winch assembly is pawl-less.

9. The crossbow of claim 1 wherein:

the spool gear has spool gear teeth;

the drive gear has drive gear teeth;

the spool gear teeth engage the drive gear teeth so that rotation of the drive gear causes the spool gear to rotate;

a gear stop implement has gear stop implement teeth that are selectively engageable with the spool gear teeth;

when the gear stop implement teeth are engaged with the spool gear teeth:
1) the spool gear, spool, drive gear and drive shaft are all prevented from rotating with respect to the winch housing and with respect to the main beam;
2) the receiver is rotatable with respect to the drive shaft; and when the gear stop implement teeth are disengaged from the spool gear teeth:
1) the spool gear, spool, drive gear and drive shaft are all rotatable with respect to the winch housing and with respect to the main beam; and
2) the receiver is rotatable with respect to the drive shaft.

10. The crossbow of claim 9 wherein:

the gear stop implement is biased by a biasing force into a first gear stop implement position where the gear stop implement teeth are disengaged from the spool gear teeth; and the gear stop implement has a surface that is selectively manually pressable to move the gear stop implement into a second gear stop implement position where the biasing force is overcome and the gear stop implement teeth are engaged to the spool gear teeth.

11. A crossbow method comprising the steps of:

A) providing a crossbow including:
1) a longitudinally extending main beam;
2) a bow mechanism including:
(a) a pair of outwardly extending bow limbs extending transversely from opposite lateral sides of the main beam; and
(b) a bowstring operatively engaged to the outwardly extending bow limbs and movable between:
(i) an un-cocked position; and
(ii) a cocked position;

B) providing a de-cocking mechanism including:
1) a trigger mechanism;
2) a trigger latch mechanism; and
3) a winch assembly;

C) providing the trigger mechanism with:
1) a trigger housing;
2) a trigger surface supported to the trigger housing; and
3) a string catch supported to the trigger housing and selectively movable between:
(a) a first string catch position that does not hold the bowstring; and
(b) a second string catch position that holds the bowstring;

D) providing the trigger latch mechanism with a trigger latch supported to the main beam and selectively movable between:
1) a first trigger latch position that does not engage the trigger surface; and
2) a second trigger latch position that engages the trigger surface to hold the trigger mechanism to the main beam at a longitudinal position;

E) providing the winch assembly with:
1) a winch housing supported to the main beam;
2) a spool that is selectively rotatable with respect to the winch housing;
3) a tensile member having:
(a) a first end operatively engaged with the spool; and
(b) a second end operatively engaged with the trigger housing;
4) a spool gear:
(a) operatively engaged with the spool; and (b) selectively rotatable with respect to the winch housing;

5) a drive gear:

(a) operatively engaged with the spool gear; and (b) selectively rotatable with respect to the winch housing; and 6) a clutch gear assembly that:

(a) is selectively operatively engageable to the drive gear;

(b) when operatively engaged to the drive gear, is adapted to enable the drive gear to rotate:

(i) freely in a spool in direction; and (ii) subject to a damping load in a spool out direction; and (c) when operatively disengaged from the drive gear, is adapted to enable the drive gear to rotate freely in both the spool in direction and the spool out direction;

F) providing the trigger latch mechanism, when the bowstring is in the cocked position, the trigger latch is in the second trigger latch position holding the trigger mechanism to the main beam at the longitudinal position, the string catch is in the second string catch position holding the bowstring, and tension has been relieved from the tensile member, to be selectively operable: to receive a trigger latch force on the trigger latch to relieve tension from the trigger latch mechanism;

G) providing the winch assembly, when the bowstring is in the cocked position, the trigger latch is in the second trigger latch position holding the trigger mechanism to the main beam at the longitudinal position, the string catch is in the second string catch position holding the bowstring, tension has been relieved from the trigger latch mechanism and the trigger latch force continues to be applied to the trigger latch, to be selectively operable:

1) to receive a first rotational input to rotate the drive gear in the spool in direction; to 2) rotate the spool gear; to 3) rotate the spool; to 4) apply tension to the tensile member; to 5) move the trigger latch into the first trigger latch position that does not engage the trigger surface; and H) providing the winch assembly, when the bowstring is in the cocked position, the trigger latch is in the first trigger latch position that does not engage the trigger surface and the string catch is in the second string catch position holding the bowstring, to be is selectively operable:

1) to receive a second rotational input to rotate the drive gear in the spool out direction; to 2) rotate the spool gear; to 3) rotate the spool; to 4) unwrap the tensile member from the spool; to 5) move the trigger mechanism away from the trigger latch mechanism; to 6) move the bowstring from the cocked position to the un-cocked position.

12. The crossbow method of claim 11 wherein:

step E includes the steps of:

1) providing the drive gear to rotate with a drive shaft; and 2) providing a plate gear;

the method further includes the steps of:

1) providing, when the clutch gear assembly is operatively engaged to the drive gear, the drive gear and the plate gear to be rotatable together with the drive shaft; and 2) providing, when the clutch gear assembly is operatively disengaged from the drive gear:

(a) the drive gear to be rotatable with the drive shaft; and (b) the plate gear to not be rotatable with the drive shaft.

13. The crossbow method of claim 11 wherein:

step E includes the steps of:

1) providing the plate gear:

(a) to be a pressure plate gear;

(b) with plate gear teeth;

2) providing a one way bearing selectively rotatable in only one direction with respect to the winch housing; and 3) providing a brake gear:

(a) operatively engaged with the plate gear teeth;

(b) operatively engaged with the one way bearing; and (c) selectively rotatable in the only one direction with respect to the winch housing;

the method further includes the step of: when the clutch gear assembly is operatively engaged to the drive gear and the bowstring is positioned between the cocked position and the un-cocked position, defined as an intermediate bowstring position: providing that removal of rotational input to the winch assembly results in the bowstring remaining in the intermediate bowstring position.

14. The crossbow method of claim 12 wherein:

step E includes the steps of:

1) providing the drive shaft with threads;

2) providing the clutch gear assembly with a receiver having threads that engage the drive shaft threads;

the method further includes the step of: providing the receiver to be operable:

1) to be rotatable in a first receiver direction with respect to the drive shaft, to operatively engage the clutch gear assembly to the drive gear; and 2) to be rotatable in a second receiver direction with respect to the drive shaft, opposite the first receiver direction, to operatively disengage the clutch gear assembly from the drive gear.

15. The crossbow method of claim 11 wherein:

step G1 includes the step of: providing the winch assembly to receive the first rotational input of at least 360 degrees to rotate the drive gear in the spool in direction.

16. The crossbow method of claim 11 wherein:

step C includes the step of providing the trigger surface with a convex surface;

step D includes the step of providing the trigger latch with 1) a manually engageable surface that is selectively manually pressable to receive the trigger latch force on the trigger latch to relieve tension from the trigger latch mechanism; and 2) a concave surface that engages the convex surface when the trigger latch is in the second trigger latch position; and step A includes the step of: providing the crossbow with:

1) a casing having a first outer surface longitudinally and transversely positioned in line with the manually engageable surface; and 2) a second outer surface on the casing longitudinally and transversely positioned in line with the concave surface;

the method further including the steps of:

1) providing the manually engageable surface to be positioned transversely outside the first outer surface;
2) providing the concave surface to be positioned transversely inside the second outer surface; and
3) providing the second outer surface with an opening permitting a user to see the concave surface and if it is engaged to the convex surface.

17. A crossbow comprising:

a longitudinally extending main beam;

a bow mechanism including:

1) a pair of outwardly extending bow limbs extending transversely from opposite lateral sides of the main beam; and
2) a bowstring operatively engaged to the outwardly extending bow limbs and movable between:
   (a) an un-cocked position; and
   (b) a cocked position;

a de-cocking mechanism including:

1) a trigger mechanism;
2) a trigger latch mechanism; and
3) a pawl-less winch assembly;

the trigger mechanism including:

1) a trigger housing;
2) a trigger surface supported to the trigger housing; and
3) a string catch supported to the trigger housing and selectively movable between:
   (a) a first string catch position that does not hold the bowstring; and
   (b) a second string catch position that holds the bowstring;

the trigger latch mechanism including a trigger latch supported to the main beam and selectively movable between:

(a) a first trigger latch position that does not engage the trigger surface; and
(b) a second trigger latch position that engages the trigger surface to hold the trigger mechanism to the main beam at a longitudinal position; and the pawl-less winch assembly including:

1) a winch housing supported to the main beam;
2) a spool that is selectively rotatable with respect to the winch housing;
3) a tensile member having:
   (a) a first end operatively engaged with the spool; and
   (b) a second end operatively engaged with the trigger housing;
4) a spool gear:
   (a) operatively engaged with the spool; and
   (b) selectively rotatable with respect to the winch housing;
5) a drive gear:
   (a) operatively engaged with the spool gear; and
   (b) selectively rotatable with a drive shaft having threads with respect to the winch housing; and
6) a clutch gear assembly that:
   (a) includes a pressure plate gear;
   (b) includes a receiver having threads that engage the drive shaft threads;
   (b) is selectively operatively engageable to the drive gear;
   (c) when operatively engaged to the drive gear, is adapted to enable the drive gear to rotate:
      (i) freely in a spool in direction; and
      (ii) subject to a damping load in a spool out direction; and
   (d) when operatively disengaged from the drive gear, is adapted to enable the drive gear to rotate freely in both the spool in direction and the spool out direction;

wherein:

1) when the bowstring is in the cocked position, the trigger latch is in the second trigger latch position holding the trigger mechanism to the main beam at the longitudinal position, the string catch is in the second string catch position holding the bowstring, and tension has been relieved from the tensile member, the trigger latch mechanism is selectively operable: to receive a trigger latch force on the trigger latch to relieve tension from the trigger latch mechanism;
2) when the bowstring is in the cocked position, the trigger latch is in the second trigger latch position holding the trigger mechanism to the main beam at the longitudinal position, the string catch is in the second string catch position holding the bowstring, tension has been relieved from the trigger latch mechanism and the trigger latch force continues to be applied to the trigger latch; the winch assembly is selectively operable:
   (a) to receive a first rotational input of at least 360 degrees to rotate the drive gear in the spool in direction; to
   (b) rotate the spool gear; to
   (c) rotate the spool; to
   (d) apply tension to the tensile member; to
   (e) move the trigger latch into the first trigger latch position that does not engage the trigger surface;
3) when the bowstring is in the cocked position, the trigger latch is in the first trigger latch position that does not engage the trigger surface and the string catch is in the second string catch position holding the bowstring, the winch assembly is selectively operable:
   (a) to receive a second rotational input to rotate the drive gear in the spool out direction; to
   (b) rotate the spool gear; to
   (c) rotate the spool; to
   (d) unwrap the tensile member from the spool; to
   (e) move the trigger mechanism away from the trigger latch mechanism; to
   (f) move the bowstring from the cocked position to the un-cocked position;
4) when the clutch gear assembly is operatively engaged to the drive gear, the drive gear and pressure plate gear rotate together with the drive shaft;
5) when the clutch gear assembly is operatively disengaged from the drive gear:
   (a) the drive gear rotates with the drive shaft; and
   (b) the pressure plate gear does not rotate with the drive shaft; and
6) the receiver is adapted when rotated sufficiently:
   (a) in a first receiver direction with respect to the drive shaft, to operatively engage the clutch gear assembly to the drive gear; and (b) in a second receiver direction with respect to the drive shaft, opposite the first receiver direction, to operatively disengage the clutch gear assembly from the drive gear.

18. The crossbow of claim 17 wherein:

the pressure plate gear has plate gear teeth;

the winch assembly includes:

1) a one way bearing selectively rotatable in only one direction with respect to the winch housing; and 2) a brake gear:

(a) operatively engaged with the pressure plate gear teeth;

(b) operatively engaged with the one way bearing; and (c) selectively rotatable in the only one direction with respect to the winch housing;

3) a manually rotatable crank that:

(a) is selectively engageable to the crank receiving surface; and (b) selectively provides the first rotational input and the second rotational input; and when the clutch gear assembly is operatively engaged to the drive gear and the bowstring is positioned between the cocked position and the un-cocked position, defined as an intermediate bowstring position: removal of rotational input to the winch assembly results in the bowstring remaining in the intermediate bowstring position.

19. The crossbow of claim 18 wherein:

the trigger surface includes a convex surface;

the trigger latch includes:

1) a manually engageable surface that is selectively manually pressable to receive the trigger latch force on the trigger latch to relieve tension from the trigger latch mechanism; and 2) a concave surface that engages the convex surface when the trigger latch is in the second trigger latch position;

the crossbow has a casing with:

1) a first outer surface longitudinally and transversely positioned in line with the manually engageable surface; and 2) a second outer surface longitudinally and transversely positioned in line with the concave surface;

the manually engageable surface is positioned transversely outside the first outer surface;

the concave surface is positioned transversely inside the second outer surface; and the second outer surface has an opening permitting a user to see the concave surface and if it is engaged to the convex surface.

20. The crossbow of claim 19 wherein:

the spool gear has spool gear teeth;

the drive gear has drive gear teeth;

the spool gear teeth engage the drive gear teeth so that rotation of the drive gear causes the spool gear to rotate;

a gear stop implement has gear stop implement teeth that are selectively engageable with the spool gear teeth;

when the gear stop implement teeth are engaged with the spool gear teeth:

1) the spool gear, spool, drive gear and drive shaft are all prevented from rotating with respect to the winch housing and with respect to the main beam;

2) the receiver is rotatable with respect to the drive shaft; and when the gear stop implement teeth are disengaged from the spool gear teeth:

1) the spool gear, spool, drive gear and drive shaft are all rotatable with respect to the winch housing and with respect to the main beam; and 2) the receiver is rotatable with respect to the drive shaft;

the gear stop implement is biased by a biasing force into a first gear stop implement position where the gear stop implement teeth are disengaged from the spool gear teeth; and the gear stop implement has a surface that is selectively manually pressable to move the gear stop implement into a second gear stop implement position where the biasing force is overcome and the gear stop implement teeth are engaged to the spool gear teeth.

* * * * *